US006763883B2

(12) United States Patent
Green et al.

(10) Patent No.: US 6,763,883 B2
(45) Date of Patent: Jul. 20, 2004

(54) METHOD AND APPARATUS FOR IMPROVED COMMUNICATION IN A WELLBORE UTILIZING ACOUSTIC SIGNALS

(75) Inventors: Robert R. Green, Houston, TX (US); John W. Harrell, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/246,497

(22) Filed: Sep. 17, 2002

(65) Prior Publication Data

US 2003/0015319 A1 Jan. 23, 2003

Related U.S. Application Data

(60) Continuation of application No. 09/904,078, filed on Jul. 12, 2001, now Pat. No. 6,450,258, which is a division of application No. 08/734,055, filed on Oct. 18, 1996, now Pat. No. 5,995,449.

(60) Provisional application No. 60/005,745, filed on Oct. 20, 1995, and provisional application No. 60/026,084, filed on Aug. 26, 1996.

(51) Int. Cl.[7] ..... E21B 47/12

(52) U.S. Cl. ..... 166/250.17; 166/55.1

(58) Field of Search ..... 166/250.01, 250.15, 166/250.17, 55, 55.1, 297; 175/24, 40, 50; 367/82, 83

(56) References Cited

U.S. PATENT DOCUMENTS 5,597,042 A * 1/1997 Tubel et al. ..... 166/250.01
5,706,892 A * 1/1998 Aeschbacher, Jr. et al. ... 166/66
5,868,201 A * 2/1999 Bussear et al. ..... 166/53
5,960,883 A * 10/1999 Tubel et al. ..... 166/313
6,046,685 A * 4/2000 Tubel ..... 340/853.2

* cited by examiner

*Primary Examiner*—Frank Tsay
(74) *Attorney, Agent, or Firm*—Melvin A. Hunn

(57) ABSTRACT

A method and apparatus for acoustically actuating wellbore tools using two-way acoustic communication is disclosed.

1 Claim, 50 Drawing Sheets

METHOD AND APPARATUS FOR IMPROVED COMMUNICATION IN A WELLBORE UTILIZING ACOUSTIC SIGNALS

CROSS REFERENCE TO RELATED APPLICATIONS

The present application claims priority under 35 USC §120 to the following provisional U.S. patent applications:

1. Ser. No. 60/005,745, filed Oct. 20, 1995, entitled "Method and Apparatus for Improved Communication in a Wellbore Utilizing Acoustic Symbols".
2. Ser. No. 60/026,084, filed Aug. 26, 1996, entitled Method and Apparatus for Improved Communication in a Wellbore Utilizing Acoustic Signals".

The present application has disclosure that is common with:

1. Ser. No. 08/108,958, filed Aug. 18, 1993, entitled "Method and Apparatus for Communicating Data in a Wellbore for Detecting the Influx of Gas".

This application is a continuation of Ser. No. 09/904,078 filed Jul. 12, 2001, U.S. Pat. No. 6,450,258, which is a division of Ser. No. 08/734,055 filed Oct. 18, 1996 of U.S. Pat. No. 5,995,449.

BACKGROUND OF THE INVENTION

1. Field of the Invention

The present invention relates in general to a system for communicating in a wellbore, and in particular to a system for communicating in a wellbore utilizing acoustic signals.

2. Description of the Prior Art

At present, the oil and gas industry is expending significant amounts on research and development toward the problem of communicating data and control signals within a wellbore. Numerous prior art systems exist which allow for the passage of data and control signals within a wellbore, particularly during logging operations. However, a non-invasive communication technology for completion and production operations has not yet been perfected. The communication systems which may eventually be utilized during completion operations must be especially secure, and not susceptible to false actuation. This is true because many events occur during completion operations, such as the firing of perforating guns, the setting of liner hangers and the like, which are either impossible or difficult to reverse. This is, of course, especially true for perforation operations. If a perforating gun were to inadvertently or unintentionally discharge in a region of the wellbore which does not need perforations, considerable remedial work must be performed. In complex perforation operations, a plurality of perforating guns are carried by a completion string. It is especially important that the command signal which is utilized to discharge one perforating gun not be confused with command signals which are utilized to actuate other perforating guns.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

The detailed description of the preferred embodiment follows under the following specific topic headings:

1. OVERVIEW OF THE PRESENT INVENTION;
2. ACOUSTIC TONE GENERATOR AND RECEIVER WITH ADAPTABILITY TO COMMUNICATION CHANNELS;
3. ACOUSTIC TONE GENERATOR AND RECEIVER—SOFTWARE VERSION;
4. ACOUSTIC TONE GENERATOR AND RECEIVER—HARDWARE VERSION;
5. APPLICATIONS AND END DEVICES; and
6. LOGGING DURING COMPLETIONS.

1. Overview of the Present Invention

Figure 1:
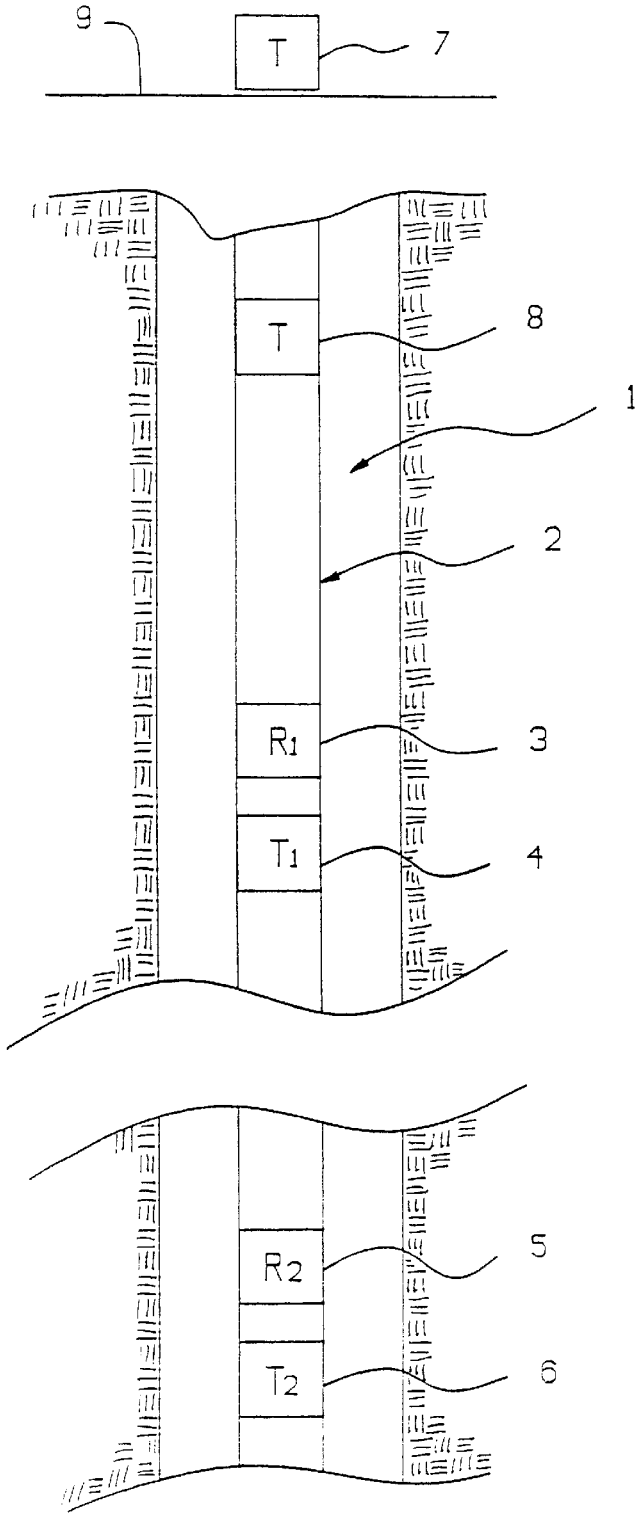
FIG. 1 is a simplified and schematic depiction of the present invention.

The present invention includes several embodiments which can be understood with reference to FIG. 1.

In its most basic form, the present invention requires that a tubular string 2 be lowered within wellbore 1. Tubular string 2 carries a plurality of receivers 3, 5, each of which is uniquely associated with a particular one of tools 4, 6. One or more transmitters 7, 8, which may be carried by tubular string 2 at an upborehole location or at a surface location 9 are utilized to send coded messages within wellbore 1, which are received by the receivers 3, 5, decoded, and utilized to activate particular ones of the wellbore tools 4, 6, in order to accomplish a particular completion or drill stem test objective.

Before, during, and after the particular wellbore operations are completed, the receivers 3, 5 are utilized to perform noise logging operations.

The present invention includes two, very different, embodiments of the acoustic activation system.

A very sophisticated system is described in Sections 2 and 3 below, which are entitled:

2. ACOUSTIC TONE GENERATOR AND RECEIVER WITH ADAPTABILITY TO COMMUNICATION CHANNELS; and
3. ACOUSTIC TONE GENERATOR AND RECEIVER—SOFTWARE VERSION.

A more simple hardware version is discussed below in Section 4 which is entitled: ACOUSTIC TONE GENERATOR AND RECEIVER—HARDWARE VERSION.

The operations and uses of either system (software or hardware) are discussed in Section 5, which is entitled: APPLICATIONS AND END DEVICES.

The use of the receivers 3, 5 to monitor the acoustic events within the wellbore before, during, and after a particular actuation (such as a completion or drill stem test event) is discussed in Section 5 which is entitled: LOGGING DURING COMPLETIONS.

2. Acoustic Tone Generator With Adaptability to Communication Channels

In this particular embodiment, the acoustic tone generator/receiver is a sophisticated acoustic device that can be utilized for two-way communication. One particularly attractive feature of this alternative is the ability to characterize and examine the communication channel in a manner which identifies the optimum frequency (or frequencies) of operation. In accordance with this particular approach, one transmitter/receiver pair is located at the surface, and one transmitter/receiver pair is located in the wellbore. The downhole transmitter/receiver is utilized to identify the optimum operating frequency. Then, the transmitter/receiver that is located at the surface is utilized to generate the acoustic tone command which is utilized to actuate a wellbore tool.

THE TRANSDUCER: The transducer of the present invention will be described with references to FIGS. 2 through 21.

Figure 2:
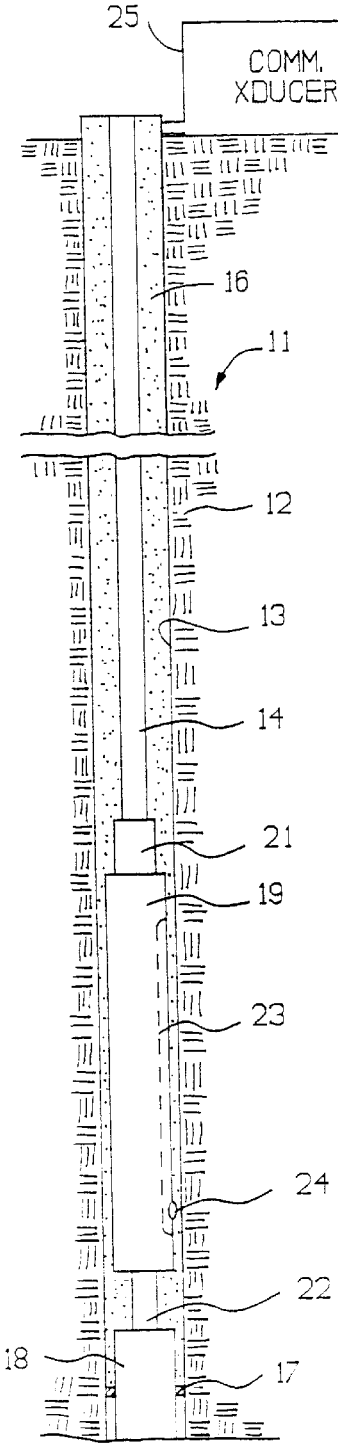
FIG. 2 is an overall schematic sectional view illustrating a potential location within a borehole of one alternative acoustic tone generator.

With reference to FIG. 2, a borehole, generally referred to by the reference numeral 11, is illustrated extending through the earth 12. Borehole 11 is shown as a petroleum product completion hole for illustrative purposes. It includes a casing 13 and production tubing 14 within which the desired oil or other petroleum product flows. The annular space between the casing and production tubing is filled with a completion liquid 16. The viscosity of this completion liquid could be any viscosity within a wide range of possible viscosities. Its density also could be of any value within a wide range, and it may include corrosive liquid components like a high density salt such as a sodium, potassium and/or bromide compound.

In accordance with conventional practice, a packer 17 is provided to seal the borehole and the completion fluid from the desired petroleum product. The production tubing 14 extends through packer 17. A plurality of remotely actuable wellbore tools may be carried by production tubing, on either side of packer 17. This is possible since acoustic command signals may be transmitted through such sealing members as packer 17, even though fluid will not pass through packer 17.

A carrier 19 for the transducer of the invention is provided on the lower end of tubing 14. As illustrated, a transition section 21 and one or more reflecting sections 22 (which will be discussed in more detail below) separate the carrier from the remainder of the production tubing. Such carrier includes slot 23 within which the communication transducer of the invention is held in a conventional manner, such as by strapping or the like. A data gathering instrument, a battery pack, and other components, also could be housed within slot 23.

Figure 3:
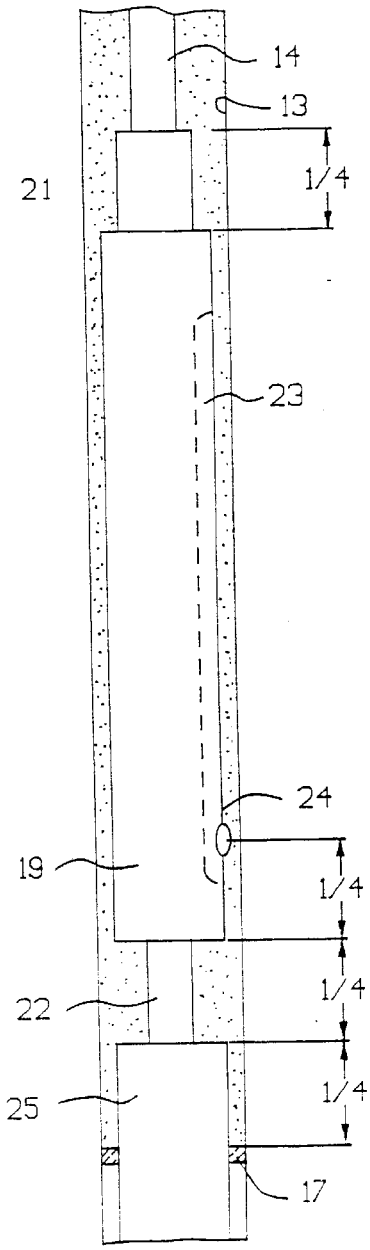
FIG. 3 is an enlarged schematic view of a portion of the arrangement shown in FIG. 2.
Figure 4:
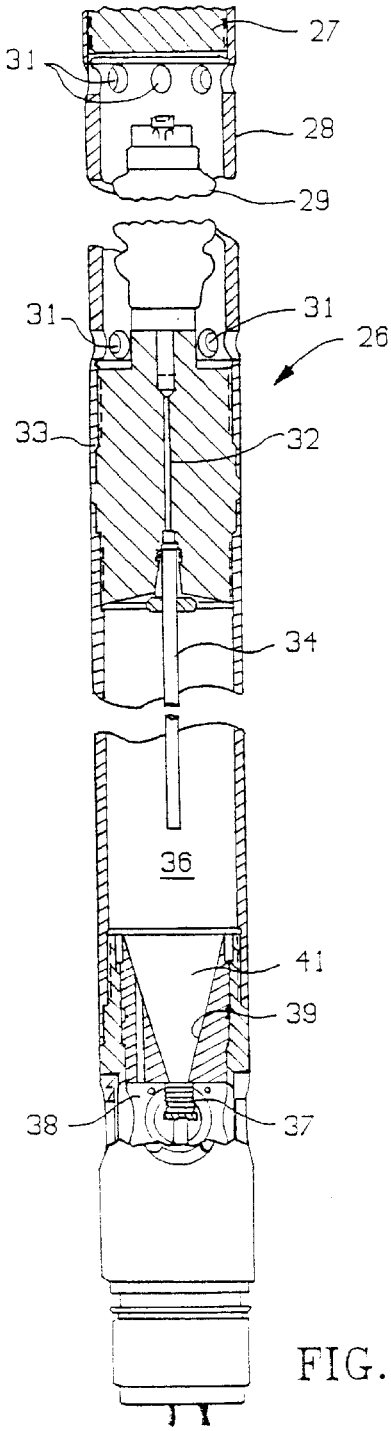
FIG. 4 is a fragmentary longitudinal section view of a transducer constructed in accordance with the present invention.
Figure 6:
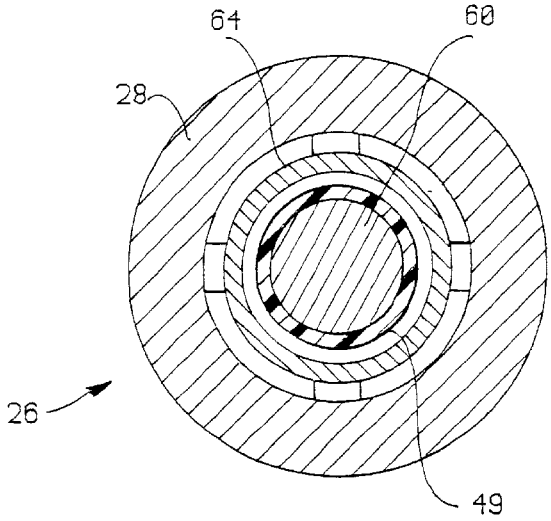
FIG. 6 is a transverse sectional view, taken on a plane indicated by the lines 5—5 in FIG. 5.
Figure 5:
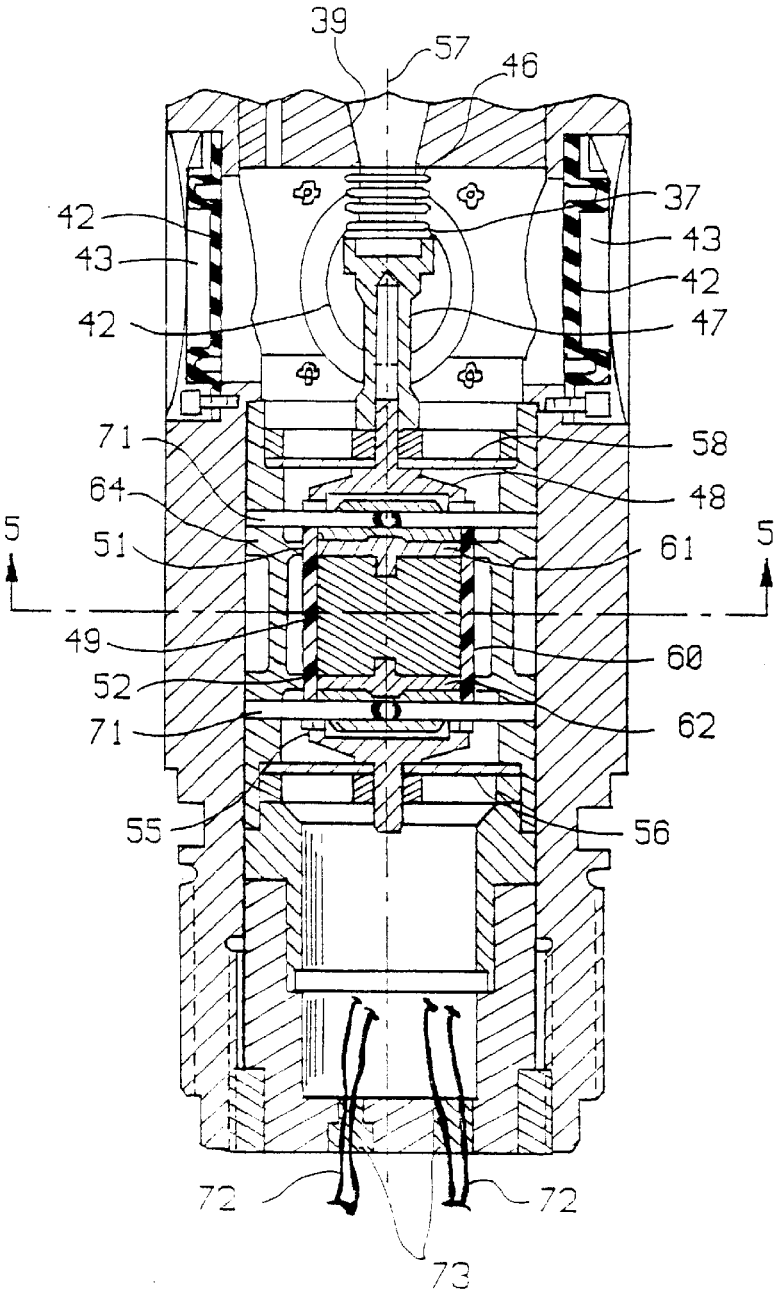
FIG. 5 is an enlarged sectional view of a portion of the construction shown in FIG. 4.

It is completion liquid 16 which acts as the transmission medium for acoustic waves provided by the transducer. Communication between the transducer and the annular space which confines such liquid is represented in FIGS. 2 and 3 by port 24. Data can be transmitted through the port 24 to the completion liquid and, hence, by the same in accordance with the invention. For example, a predetermined frequency band may be used for signaling by conventional coding and modulation techniques, binary data may be encoded into blocks, some error checking added, and the blocks transmitted serially by Frequency Shift Keying (FSK) or Phase Shift Keying (PSK) modulation. The receiver then will demodulate and check each block for errors.

The annular space at the carrier 19 is significantly smaller in cross-sectional area than that of the greater part of the well containing, for the most part, only production tubing 14. This results in a corresponding mismatch of acoustic characteristic admittances. The purpose of transition section 21 is to minimize the reflections caused by the mismatch between the section having the transducer and the adjacent section. It is nominally one-quarter wavelength long at the desired center frequency and the sound speed in the fluid, and it is selected to have a diameter so that the annular area between it and the casing 13 is a geometric average of the product of the adjacent annular areas, (that is, the annular areas defined by the production tubing 14 and the carrier 19). Further transition sections can be provided as necessary in the borehole to alleviate mismatches of acoustic admittances along the communication path.

Reflections from the packer (or the well bottom in other designs) are minimized by the presence of a multiple number of reflection sections or steps below the carrier, the first of which is indicated by reference numeral 22. It provides a transition to the maximum possible annular area one-quarter wavelength below the transducer communication port. It is followed by a quarter wavelength long tubular section 25 providing an annular area for liquid with the minimum cross-sectional area it otherwise would face. Each of the reflection sections or steps can be multiple number of quarter wavelengths long. The sections 19 and 21 should be an odd number of quarter wavelengths, whereas the section 25 should be odd or even (including zero), depending on whether or not the last step before the packer 17 has a large or small cross-section. It should be an even number (or zero) if the last step before the packer is from a large cross-section to a small cross-section.

While the first reflection step or section as described herein is the most effective, each additional one that can be added improves the degree and bandwidth of isolation. (Both the transition section 21, the reflection section 22, and the tubular section can be considered as parts of the combination making up the preferred transducer of the invention.)

Figure 12:
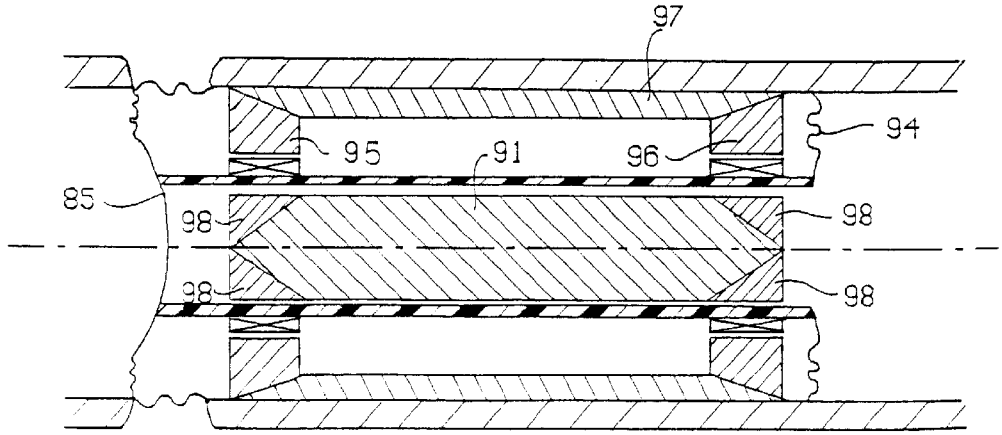

A communication transducer for receiving the data is also provided at the location at which it is desired to have such data. In most arrangements this will be at the surface of the well, and the electronics for operation of the receiver and analysis of the communicated data also are at the surface or in some cases at another location. The receiving transducer 22 most desirably is a duplicate in principle of the transducer being described. (It is represented in FIG. 12 by box 25 at the surface of the well). The communication analysis electronics is represented by box 26.

It will be recognized by those skilled in the art that the acoustic transducer arrangement of the invention is not limited necessarily to communication from downhole to the surface. Transducers can be located for communication between two different downhole locations. It is also important to note that the principle on which the transducer of the invention is based lends itself to two-way design: a single transducer can be designed to both convert an electrical communication signal to acoustic communication waves, and vice versa.

An implementation of the transducer of the invention is generally referred to by the reference numeral 26 in FIGS. 4 through 7. This specific design terminates at one end in a coupling or end plug 27 which is threaded into a bladder housing 28. A bladder 29 for pressure expansion is provided in such housing. The housing 28 includes ports 31 for free flow into the same of the borehole completion liquid for interaction with the bladder. Such bladder communicates via a tube with a bore. 32 extending through a coupler 33. The bore 32 terminates in another tube 34 which extends into a resonator 36. The length of the resonator is nominally $\lambda/4$ in the liquid within resonator 36. The resonator is filled with a liquid which meets the criteria of having low density, viscosity, sound speed, water content, vapor pressure and thermal expansion coefficient. Since some of these requirements are mutually contradictory, a compromise must be made, based on the condition of the application and design constraints. The best choices have thus far been found among the 200 and 500 series Dow Corning silicone oils, refrigeration oils such as Capella B and lightweight hydrocarbons such as kerosene. The purpose of the bladder construction is to enable expansion of such liquid as necessary in view of the pressure and temperature of the borehole liquid at the downhole location of the transducer.

The transducer of the invention generates (or detects) acoustic wave energy by means of the interaction of a piston in the transducer housing with the borehole liquid. In this implementation, this is done by movement of a piston 37 in a chamber 38 filled with the same liquid which fills resonator 36. Thus, the interaction of piston 37 with the borehole liquid is indirect: the piston is not in direct contact with such borehole liquid. Acoustic waves are generated by expansion and contraction of a bellows type piston 37 in housing chamber 38. One end of the bellows of the piston arrangement is permanently fastened around a small opening 39 of a horn structure 41 so that reciprocation of the other end of the bellows will result in the desired expansion and contraction of the same. Such expansion and contraction causes corresponding flexures of isolating diaphragms 42 in windows 43 to impart acoustic energy waves to the borehole liquid on the other side of such diaphragms. Resonator 36 provides a compliant back-load for this piston movement. It should be noted that the same liquid which fills the chamber of the resonator 36 and chamber 38 fills the various cavities of the piston driver to be discussed hereinafter, and the change in volumetric shape of chamber 38 caused by reciprocation of the piston takes place before pressure equalization can occur.

One way of looking at the resonator is that its chamber 36 acts, in effect, as a tuning pipe for returning in phase to piston 37 that acoustical energy which is not transmitted by the piston to the liquid in chamber 38 when such piston first moves. To this end, piston 37, made up of a steel bellows 46 (FIG. 5), is open at the surrounding horn opening 39. The other end of the bellows is closed and has a driving shaft 47 secured thereto. The horn structure 41 communicates the resonator 36 with the piston, and such resonator aids in assuring that any acoustic energy generated by the piston that does not directly result in movement of isolating diaphragms 42 will reinforce the oscillatory motion of the piston. In essence, its intercepts that acoustic wave energy developed by the piston which does not directly result in radiation of acoustic waves and uses the same to enhance such radiation. It also acts to provide a compliant back-load for the piston 37 as stated previously. It should be noted that the inner wall of the resonator could be tapered or otherwise contoured to modify the frequency response.

The driver for the piston will now be described. It includes the driving shaft 47 secured to the closed end of the bellows. Such shaft also is connected to an end cap 48 for a tubular bobbin 49 which carries two annular coils or windings 51 and 52 in corresponding, separate radial gaps 53 and 54 (FIG. 7) of a closed loop magnetic circuit to be described. Such bobbin terminates at its other end in a second end cap 55 which is supported in position by a flat spring 56. Spring 56 centers the end of the bobbin to which it is secured and constrains the same to limited movement in the direction of the longitudinal axis of the transducer, represented in FIG. 5 by line 57. A similar flat spring 58 is provided for the end cap 48.

In keeping with the invention, a magnetic circuit having a plurality of gaps is defined within the housing. To this end, a cylindrical permanent magnet 60 is provided as part of the driver coaxial with the axis 57. Such permanent magnet generates the magnetic flux needed for the magnetic circuit and terminates at each of its ends in a pole piece 61 and 62, respectively, to concentrate the magnetic flux for flow through the pair of longitudinally spaced apart gaps 53 and 54 in the magnetic circuit. The magnetic circuit is completed by an annular magnetically passive member of magnetically permeable material 64. As illustrated, such member includes a pair of inwardly directed annular flanges 66 and 67 (FIG. 7) which terminate adjacent the windings 51 and 52 and define one side of the gaps 52 and 54.

Figure 7:
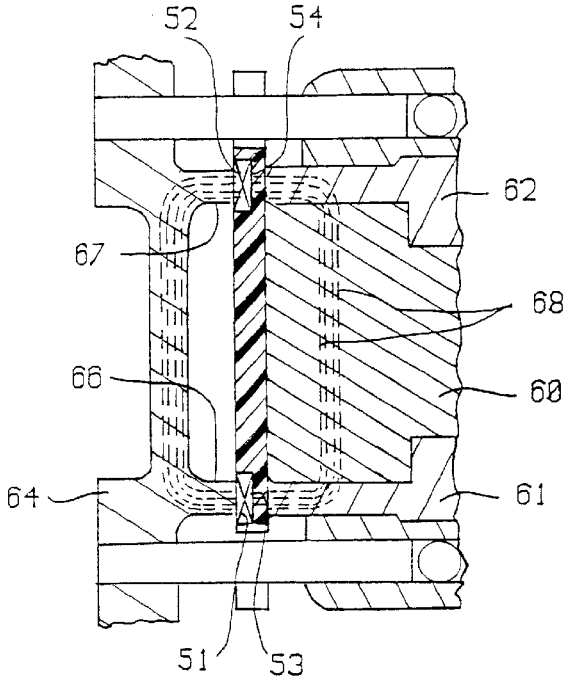
FIG. 7 is a partial, somewhat schematic sectional view showing the magnetic circuit provided by the implementation illustrated in FIGS. 4–6.

The magnetic circuit formed by this implementation is represented in FIG. 7 by closed loop magnetic flux lines 68. As illustrated, such lines extend from the magnet 60, through pole piece 61, across gap 53 and coil 51, through the return path provided by member 64, through gap 54 and coil 52, and through pole piece 62 to magnet 60. With this arrangement, it will be seen that magnetic flux passes radially outward through gap 53 and radially inward through gap 54. Coils 51 and 52 are connected in series opposition, so that current in the same provides additive force on the common bobbin. Thus, if the transducer is being used to transmit a communication, an electrical signal defining the same is passed through the coils 51 and 52 will cause corresponding movement of the bobbin 49 and, hence, the piston 37. Such piston will interact through the windows 43 with the borehole liquid and impart the communicating acoustic energy thereto. Thus, the electrical power represented by the electrical signal is converted by the transducer to mechanical power, in the form of acoustic waves.

When the transducer receives a communication, the acoustic energy defining the same will flex the diaphragms 42 and correspondingly move the piston 37. Movement of the bobbin and windings within the gaps 62 and 63 will generate a corresponding electrical signal in the coils 51 and 52 in view of the lines of magnetic flux which are cut by the same. In other words, the acoustic power is converted to electrical power.

In the implementation being described, it will be recognized that the permanent magnet 60 and its associated pole pieces 61 and 62 are generally cylindrical in shape with the axis 57 acting as an axis of a figure of revolution. The bobbin is a cylinder with the same axis, with the coils 51 and 52 being annular in shape. Return path member 64 also is annular and surrounds the magnet, etc. The magnet is held centrally by support rods 71 (FIG. 5) projecting inwardly from the return path member, through slots in bobbin 49. The flat springs 56 and 58 correspondingly centralize the bobbin while allowing limited longitudinal motion of the same as aforesaid. Suitable electrical leads 72 for the windings and other electrical parts pass into the housing through potted feedthroughs 73.

Figure 8A:
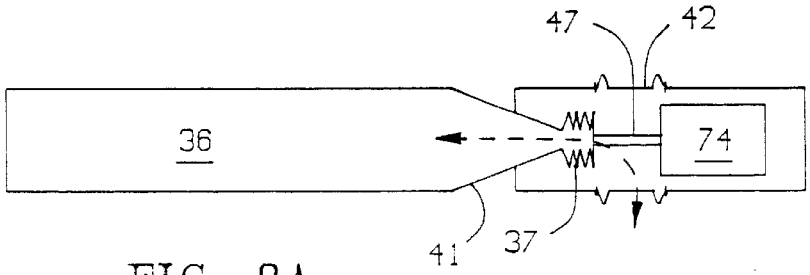
FIG. 8A is a schematic view corresponding to the implementation of the invention shown in FIGS. 4–6.
Figure 8B:
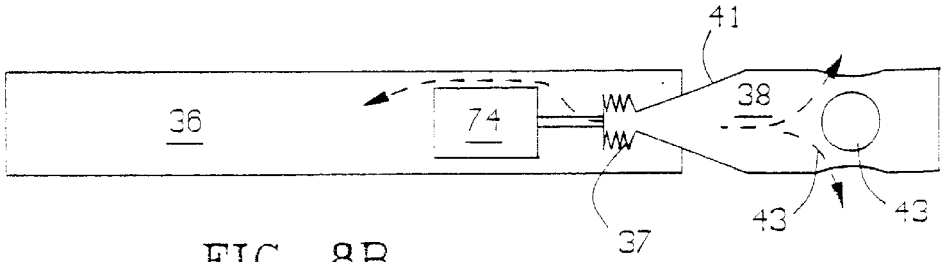
FIG. 8B is a variation on such implementation.

FIG. 8A illustrates the implementation described above in schematic form. The resonator is represented at 36, the horn structure at 41, and the piston at 37. The driver shaft of the piston is represented at 47, whereas the driver mechanism itself is represented by box 74. FIG. 8B shows an alternate arrangement in which the driver is located within the resonator 76 and the piston 37 communicates directly with the borehole liquid which is allowed to flow in through windows 43. The windows are open; they do not include a diaphragm or other structure which prevents the borehole liquid from entering the chamber 38. It will be seen that in this arrangement the piston 37 and the horn structure 41 provide fluid-tight isolation between such chamber and the resonator 36. It will be recognized, though, that it also could be designed for the resonator 36 to be flooded by the borehole liquid. It is desirable, if it is designed to be so flooded, that such resonator include a small bore filter or the like to exclude suspended particles. In any event, the driver itself should have its own inert fluid system because of close tolerances, and strong magnetic fields. The necessary use of certain materials in the same makes it prone to impairment by corrosion and contamination by particles, particularly magnetic ones.

Figure 9:
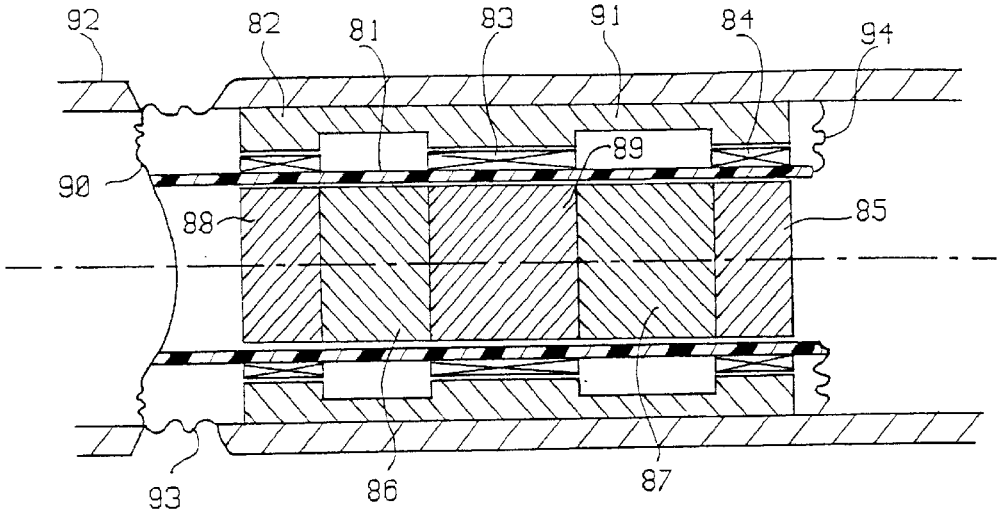
FIGS. 9 through 12 illustrate various alternate constructions.

FIGS. 9 through 13 are schematic illustrations representing various conceptual approaches and modifications for the transducer. FIG. 9 illustrates the modular design of the invention. In this connection, it should be noted that the invention is to be housed in a pipe of restricted diameter, but length is not critical. The invention enables one to make the best possible use of cross-sectional area while multiple modules can be stacked to improve efficiency and power capability.

The bobbin, represented at 81 in FIG. 9, carries three separate annular windings represented at 82–84. A pair of magnetic circuits are provided, with permanent magnets represented at 86 and 87 with facing magnetic polarities and poles 88–90. Return paths for both circuits are provided by an annular passive member 91.

It will be seen that the two magnetic circuits of the FIG. 9 configuration have the central pole 89 and its associated gap in common. The result is a three-coil driver with a transmitting efficiency (available acoustic power output/electric power input) greater than twice that of a single driver, because of the absence of fringing flux at the joint ends. Obviously, the process of "stacking" two coil drivers as indicated by this arrangement with alternating magnet polarities can be continued as long as desired with the common bobbin being appropriately supported. In this schematic arrangement, the bobbin is connected to a piston 85 which includes a central domed part and bellows of the like sealing the same to an outer casing represented at 92. This flexure seal support is preferred to sliding seals and bearings because the latter exhibit restriction that introduced distortion, particularly at the small displacements encountered when the transducer is used for receiving.

Alternatively, a rigid piston can be sealed to the case with a bellows and a separate spring or spider used for centering. A spider represented at 94 can be used at the opposite end of the bobbin for centering the same. If such spider is metal, it can be insulated from the case and can be used for electrical connections to the moving windings, eliminating the flexible leads otherwise required.

Figure 10:
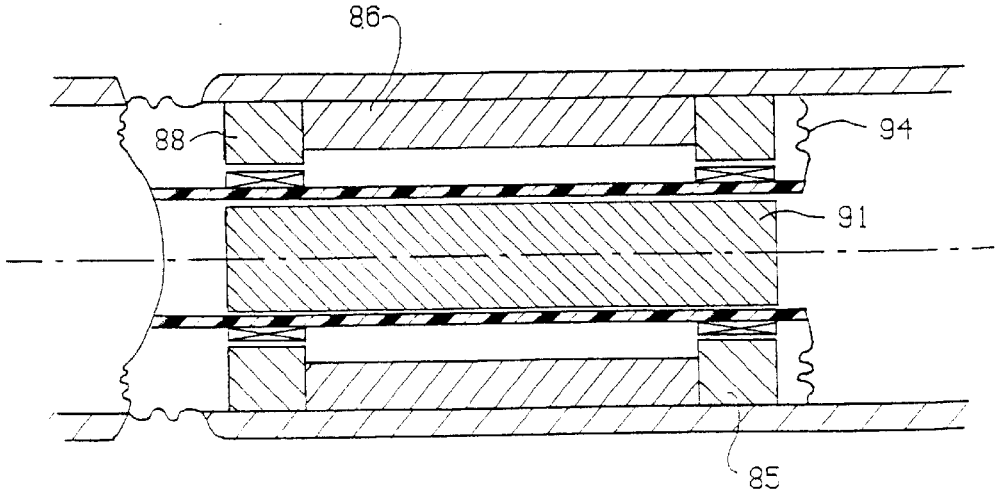

In the alternative schematically illustrated in FIG. 10, the magnet 86 is made annular and it surrounds a passive flux return path member 91 in its center. Since passive materials are available with saturation flux densities about twice the remanence of magnets, the design illustrated has the advantage of allowing a small diameter of the poles represented at 88 and 90 to reduce coil resistance and increase efficiency. The passive flux return path member 91 could be replaced by another permanent magnet. A two-magnet design, of course, could permit a reduction in length of the driver.

Figure 11:
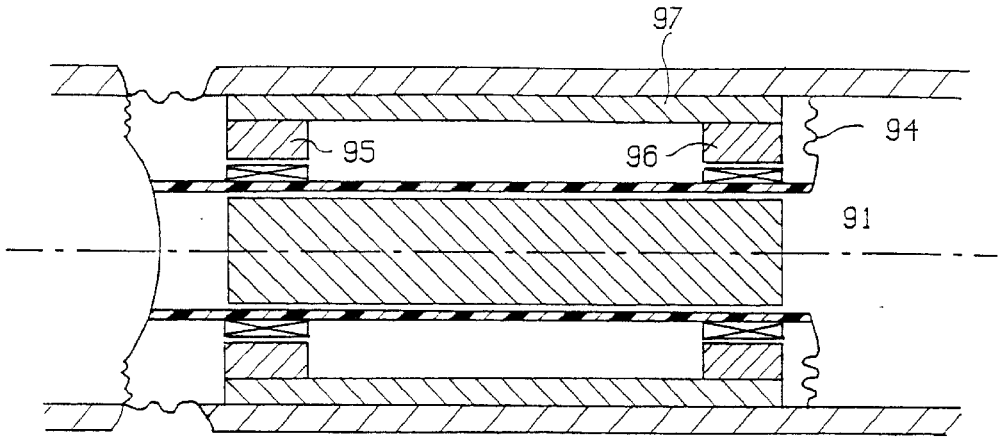

FIG. 11 schematically illustrates another magnetic structure for the driver. It includes a pair of oppositely radially polarized annular magnets 95 and 96. As illustrated, such magnets define the outer edges of the gaps. In this arrangement, an annular passive magnetic member 97 is provided, as well as a central return path member 91. While this arrangement has the advantage of reduced length due to a reduction of flux leakage at the gaps and low external flux leakage, it has the disadvantage of more difficult magnet fabrication and lower flux density in such gaps.

Conical interfaces can be provided between the magnets and pole pieces. Thus, the mating junctions can be made oblique to the long axis of the transducer. This construction maximizes the magnetic volume and its accompanying available energy while avoiding localized flux densities that could exceed a magnet remanence. It should be noted that any of the junctions, magnet-to-magnet, pole piece-to-pole piece and of course magnet-to-pole piece can be made conical. FIG. 12 illustrates one arrangement for this feature. It should be noted that in this arrangement the magnets may includes pieces 98 at the ends of the passive flux return member 91 as illustrated.

Figure 13:
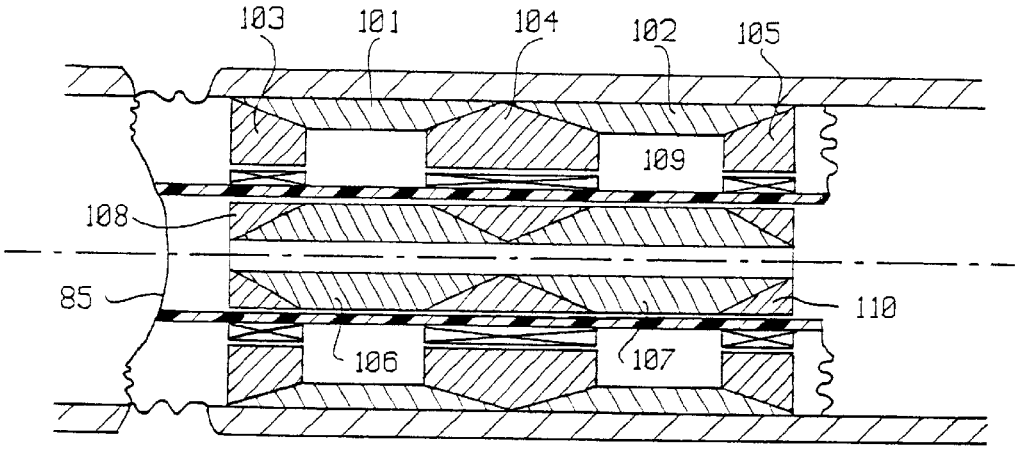
FIG. 13 illustrates in schematic form a preferred combination of such elements.

FIG. 13 schematically illustrates a particular combination of the options set forth in FIGS. 9 through 12 which could be considered a preferred embodiment for certain applications. It includes a pair of pole pieces 101, and 102 which mate conically with radial magnets 103, 104 and 105. The two magnetic circuits which are formed include passive return path members 106 and 107 terminating at the gaps in additional magnets 108 and 110.

THE COMMUNICATION SYSTEM: The communication system of the present invention will be described with reference to FIGS. 14 through 21.

Figure 14:
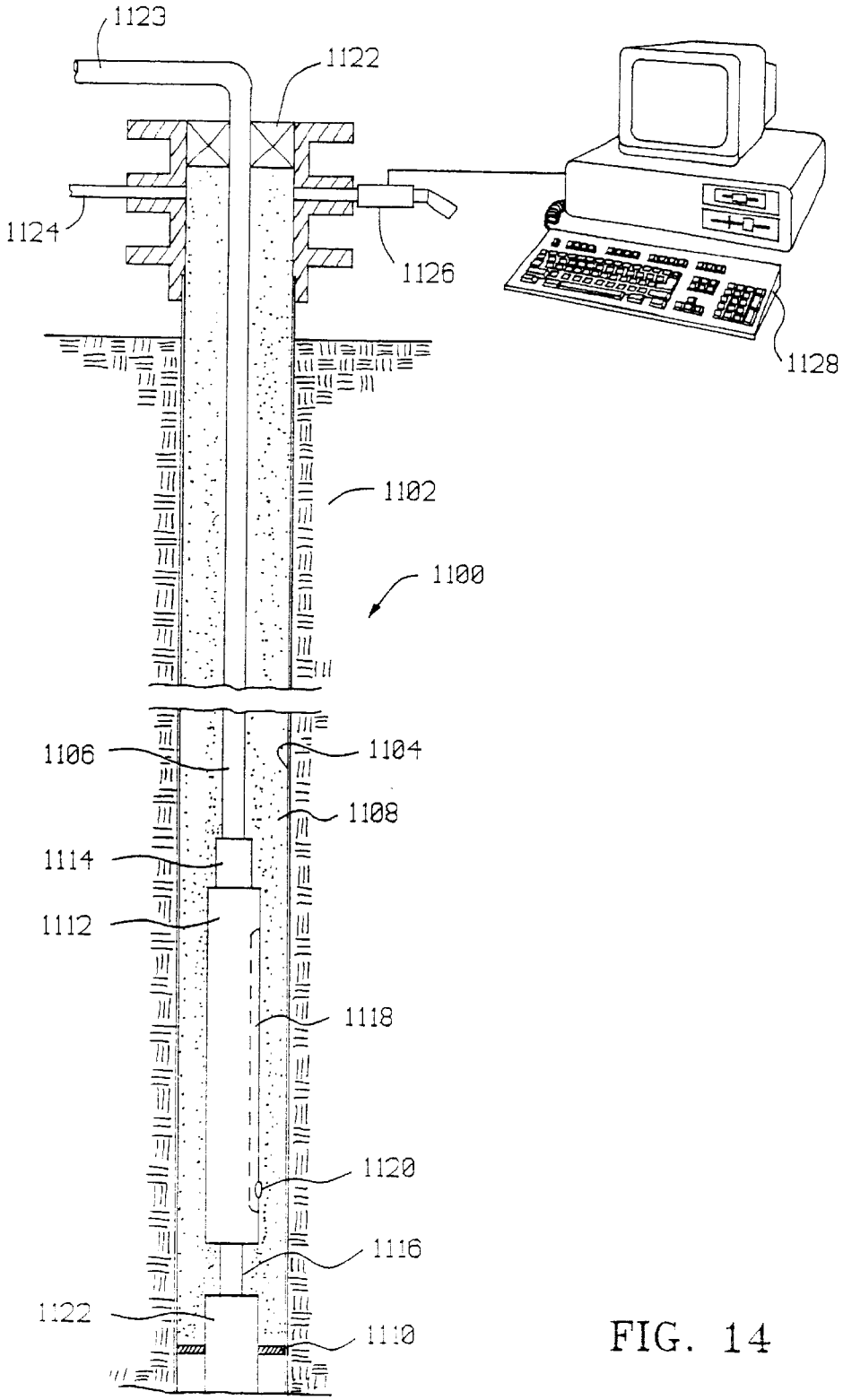
FIG. 14 is an overall somewhat diagrammatic sectional view illustrating an implementation of the invention.

With reference to FIG. 14, a borehole 1100 is illustrated extending through the earth 1102. Borehole 1100 is shown as a petroleum product completion hole for illustrative purposes. It includes a casing 1104 and production tubing 1106 within which the desired oil or other petroleum product flows. The annular space between the casing and production tubing is filled with borehole completion liquid 1108. The properties of a completion fluid vary significantly from well to well and over time in any specific well. It typically will include suspended particles or partially be a gel. It is non-Newtonian and may include non-linear elastic properties. Its viscosity could be any viscosity within a wide range of possible viscosities. Its density also could be of any value within a wide range, and it may include corrosive solid or liquid components like a high density salt such as a sodium, calcium, potassium and/or a bromide compound.

A carrier 1112 for a downhole acoustic transceiver (DAT) and its associated transducer is provided on the lower end of the tubing 1106. As illustrated, a transition section 1114 and one or more reflecting sections 1116 are included and separate carrier 1112 from the remainder of production tubing 1106. Carrier 1112 includes numerous slots in accordance with conventional practice, within one of which, slot 1118, the downhole acoustic transducer (DAT) of the invention is held by strapping or the like. One or more data gathering instruments or a battery pack also could be housed within slot 1118. It will be appreciated that a plurality of slots could be provided to serve the function of slot 1118. The annular space between the casing and the production tubing is sealed adjacent the bottom of the borehole by packer 1110. The production tubing 1106 extends through the packer and 1110 a safety valve, data gathering instrumentation, and other wellbore tools, may be included.

Figure 17A:
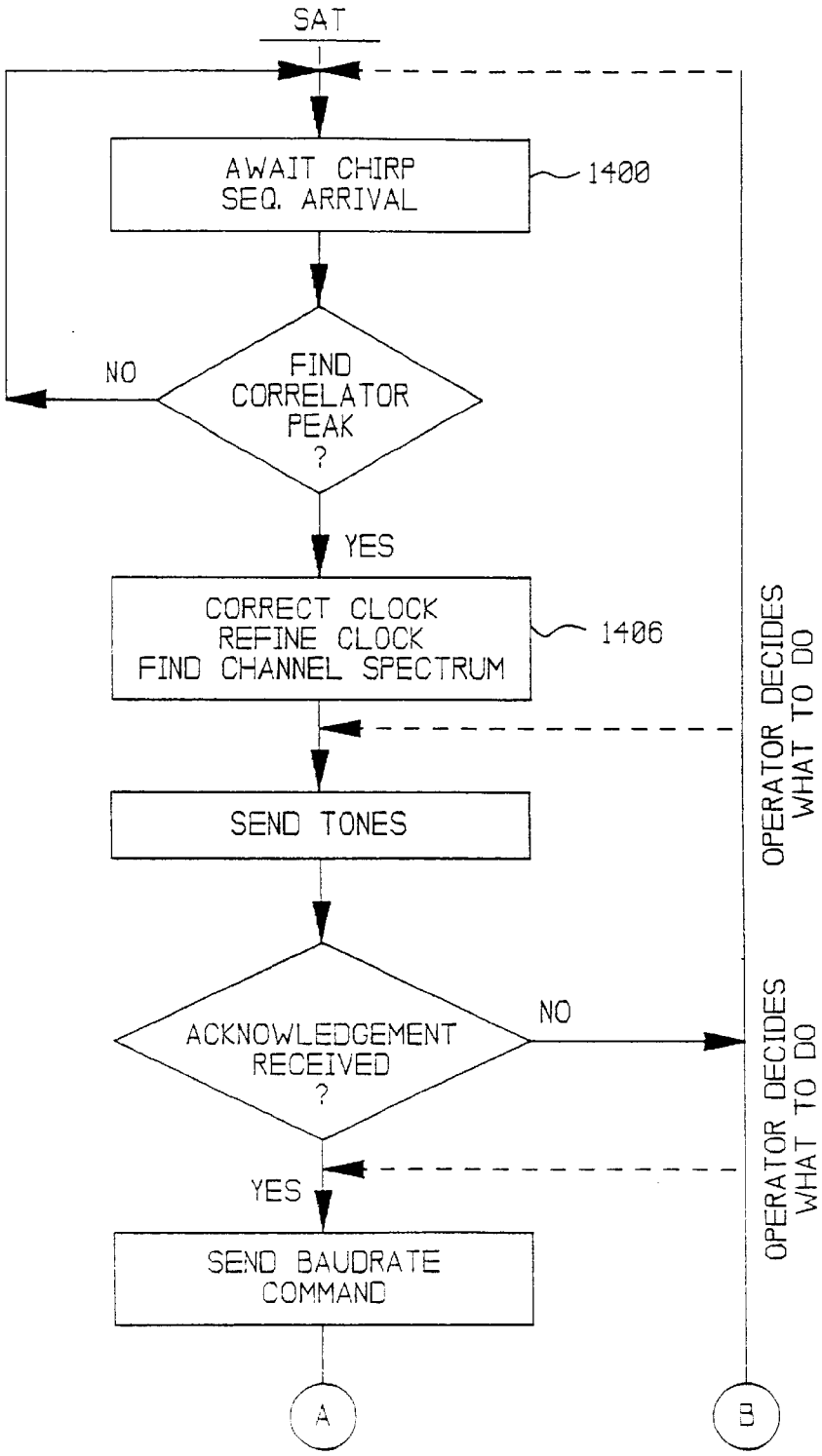
FIG. 17 is a flowchart representation of the channel characterization and data transmission operations.
Figure 17B:
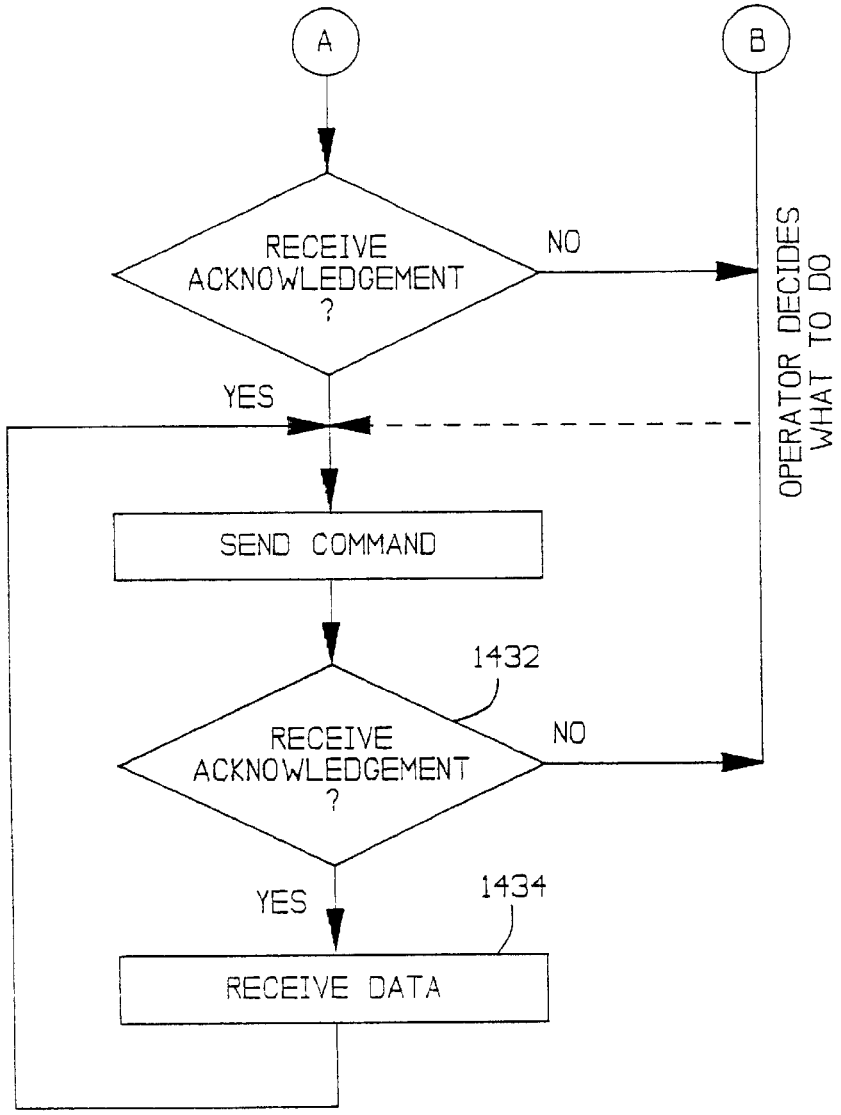

It is the completion liquid 1108 which acts as the transmission medium for acoustic waves provided by the transducer. Communication between the transducer and the annular space which confines such liquid is represented in FIG. 17 by port 1120. Data can be transmitted through the port 1120 to the completion liquid via acoustic signals. Such communication does not rely on flow of the completion liquid.

A surface acoustic transceiver (SAT) 1126 is provided at the surface, communicating with the completion liquid in any convenient fashion, but preferably utilizing a transducer in accordance with the present invention. The surface configuration of the production well is diagrammatically represented and includes an end cap on casing 1124. The production tubing 1106 extends through a seal represented at 1122 to a production flow line 1123. A flow line for the completion fluid 1124 is also illustrated, which extends to a conventional circulation system.

In its simplest form, the arrangement converts information laden data into an acoustic signal which is coupled to the borehole liquid at one location in the borehole. The acoustic signal is received at a second location in the borehole where the data is recovered. Alternatively, communication occurs between both locations in a bidirectional fashion. And as a further alternative, communication can occur between multiple locations within the borehole such that a network of communication transceivers are arrayed along the borehole. Moreover, communication could be through the fluid in the production tubing through the product which is being produced. Many of the aspects of the specific communication method described are applicable as mentioned previously to communication through other transmission medium provided in a borehole, such as in the walls of the tubing 1106, through air gaps contained in a third column, or through wellbore tools such as packer 1101.

Figure 15:
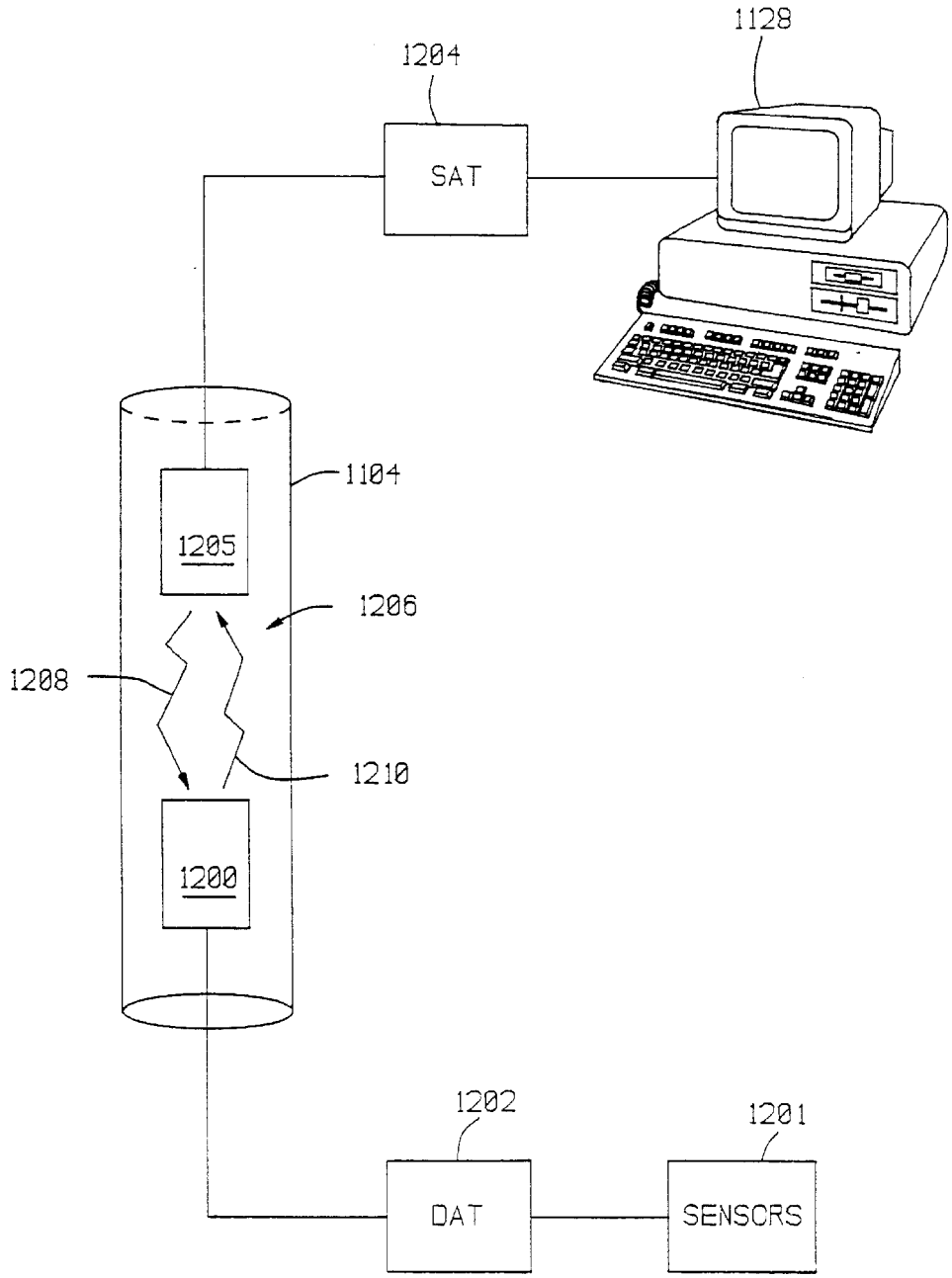
FIG. 15 is a block diagram of a preferred embodiment of the invention.

Referring to FIG. 15, the transducer 1200 at the downhole location is coupled to a downhole acoustic transceiver (DAT) 1202 for acoustically transmitting data collected from the DAT's associated sensors 1201. The DAT 1202 is capable of both modulating an electrical signal used to stimulate the transducer 1200 for transmission, and of demodulating signals received by the transducer 1200 from the surface acoustic transceiver (SAT) 1204. In other words, the DAT 1202 both receives and transmits information. Similarly, the SAT 1204 both receives and transmits information. The communication is directly between the DAT 1202 and the SAT 1204. Alternatively, intermediary transceivers could be positioned within the borehole to accomplish data relay. Additional DATs could also be provided to transmit independently gathered data from their own sensors to the SAT or to another DAT.

More specifically, the bidirectional communication system of the invention establishes accurate data transfer by conducting a series of steps designed to characterize the borehole communication channel 1206, choose the best center frequency based upon the channel characterization, synchronize the SAT 1204 with the DAT 1202, and, finally, bi-directionally transfer data. This complex process is undertaken because the channel 1206 through which the acoustic signal must propagate is dynamic, and thus time variant. Furthermore, the channel is forced to be reciprocal: the transducers are electrically loaded as necessary to provide for reciprocity.

In an effort to mitigate the effects of the channel interference upon the information throughput, the inventive communication system characterizes the channel in the uphole direction 1210. To do so, the DAT 1202 sends a repetitive chirp signal which the SAT 1204, in conjunction with its computer 1128, analyzes to determine the best center frequency for the system to use for effective communication in the uphole direction. It will be recognized that the downhole direction 1208 could be characterized rather than, or in addition to, characterization for uphole communication.

Each transceiver could be designed to characterize the channel in the incoming communication direction: the SAT 1204 could analyze the channel for uphole communication 1210 and the DAT 1202 could analyze for downhole communication 1208, and then command the corresponding transmitting system to use the best center frequency for the direction characterized by it.

In addition to choosing a proper channel for transmission, system timing synchronization is important to any coherent communication system. To accomplish the channel characterization and timing synchronization processes together, the DAT begins transmitting repetitive chirp sequences after a programmed time delay selected to be longer than the expected lowering time.

Figure 18A:
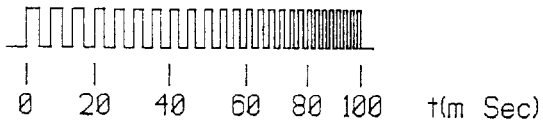
FIGS. 18A, 18B, and 18C depict the synchronization signal structure.
Figure 18B:
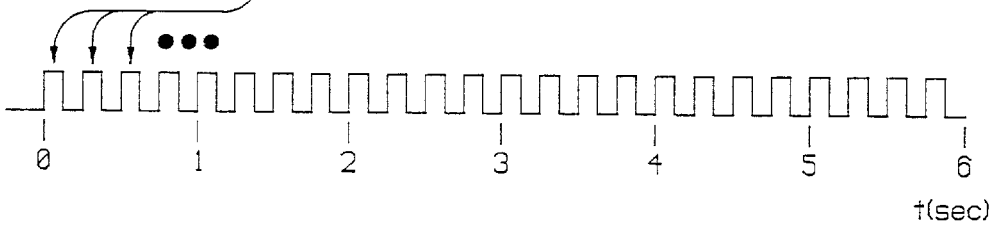
Figure 18C:
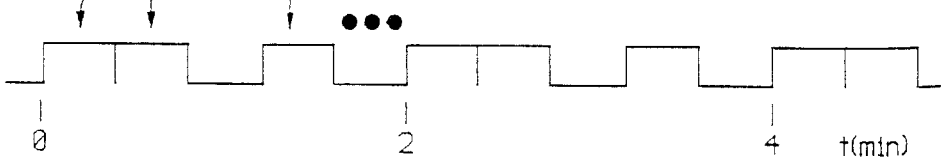

FIGS. 18A–18C depict the signalling structure for the chirp sequences. In a preferred implementation, a single chirp block is one hundred milliseconds in duration and contains three cycles of one hundred fifty (150) Hertz signal, four cycles of two hundred (200) Hertz signal, five cycles of two hundred and fifty (250) Hertz signal, six cycles of three hundred (300) Hertz signal, and seven cycles of three hundred and fifty (350) Hertz cycles. The chirp signal structure is depicted in FIG. 18A. Thus, the entire bandwidth of the desired acoustic channel, one hundred and fifty to three hundred and fifty (150–350) Hertz, is chirped by each block.

As depicted in FIG. 18B, the chirp block is repeated with a time delay between each block. As shown in FIG. 18C, this sequence is repeated three times at two minute intervals. The first two sequences are transmitted sequentially without any delay between them, then a delay is created before a third sequence is transmitted. During most of the remainder of the interval, the DAT 1202 waits for a command (or default tone) from the SAT 1204. The specific sequence of chirp signals should not be construed as limiting the invention: variations on the basic scheme, including but not limited to different chirp frequencies, chirp durations, chirp pulse separations, etc., are foreseeable. It is also contemplated that PN sequences, an impulse, or any variable signal which occupies the desired spectrum could be used.

Figure 20:
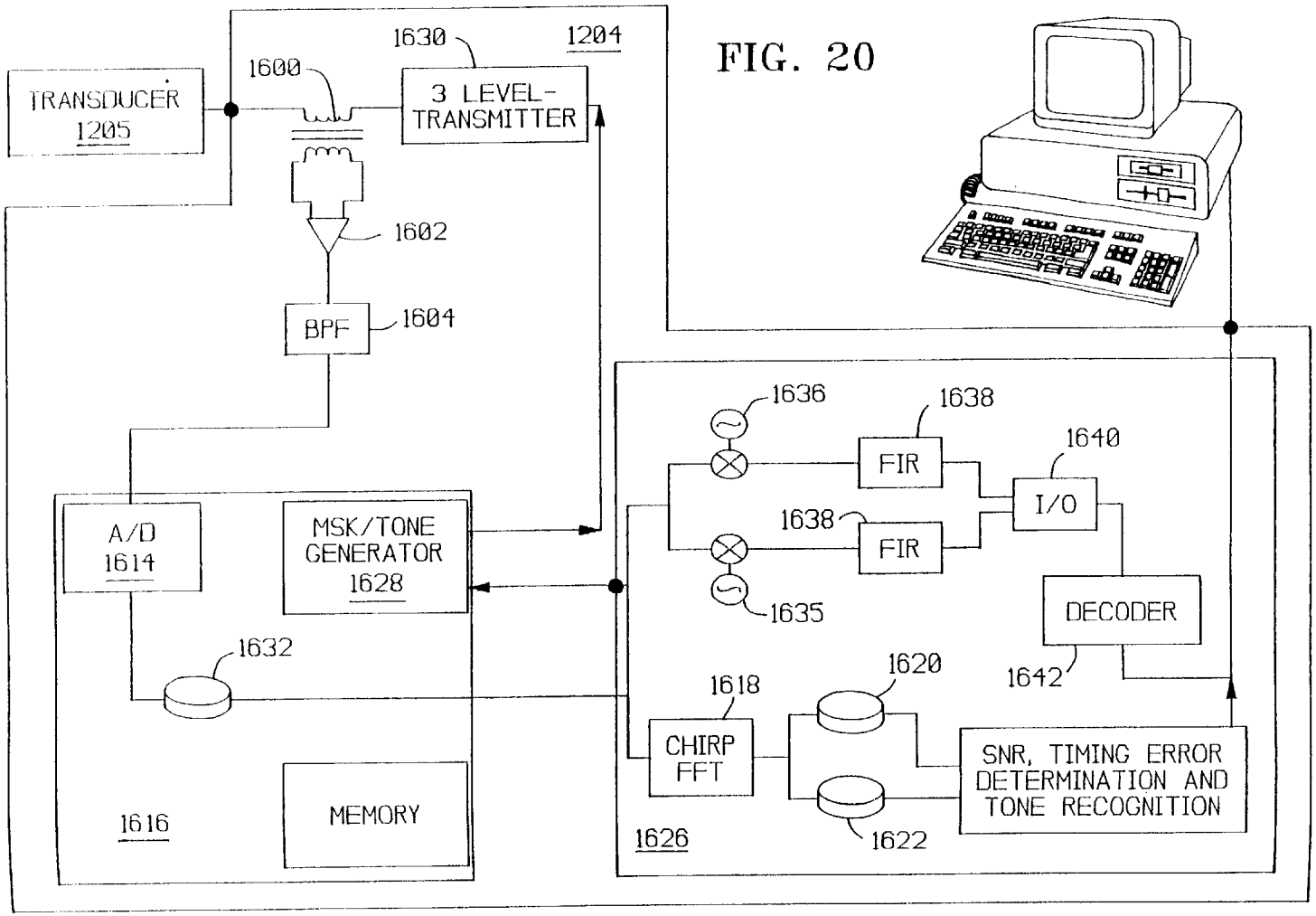
FIG. 20 is a detailed block diagram of the surface acoustic transceiver.

As shown in FIG. 20, the SAT 1204 of the preferred embodiment of the invention uses two microprocessors 1616, 1626 to effectively control the SAT functions. The host computer 1128 controls all of the activities of the SAT 1204 and is connected thereto via one of two serial channels of a Model 68000 microprocessor 1626 in the SAT 1204. The 68000 microprocessor accomplishes the bulk of the signal processing functions that are discussed below. The second serial channel of the 68000 microprocessor is connected to a 68HC11 processor 1616 that controls the signal digitization with Analog-to-Digital Converter 1614, the retrieval of received data, and the sending of tones and commands to the DAT. The chirp sequence is received from the DAT by the transducer 1205 and converted into an electrical signal from an acoustic signal. The electrical signal is coupled to the receiver through transformer 1600 which provides impedance matching. Amplifier 1602 increases the signal level, and the bandpass filter 1604 limits the noise bandwidth to three hundred and fifty (350) Hertz centered at two hundred and fifty (250) Hertz and also functions as an anti-alias filter.

Figure 19:
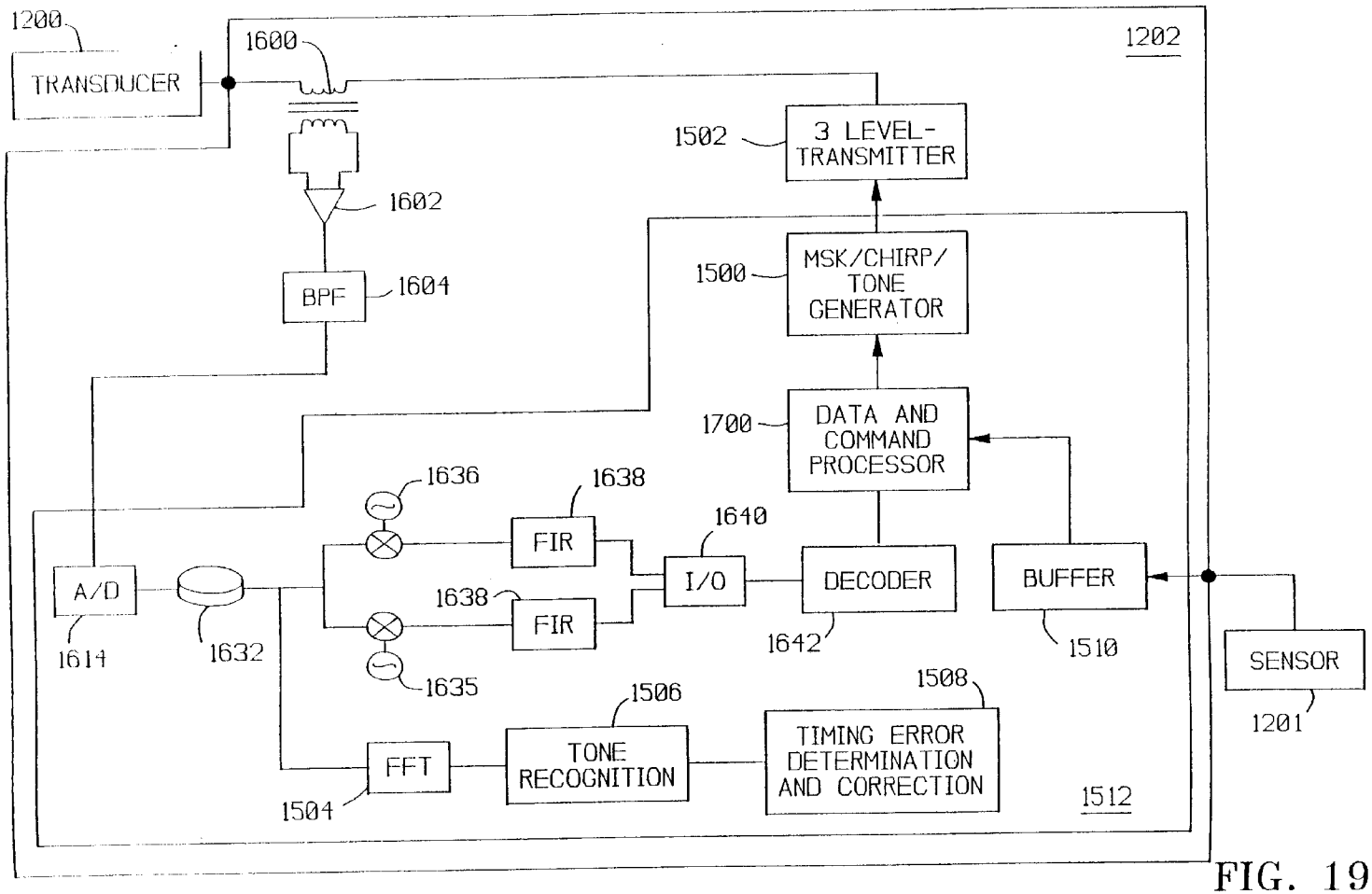
FIG. 19 is a detailed block diagram of the downhole acoustic transceiver.

Referring to FIG. 19, the DAT 1202 has a single 68HC11 microprocessor 1512 that controls all transceiver functions, the data logging activities, logged data retrieval and transmission, and power control. For simplicity, all communications are interrupt-driven. In addition, data from the sensors are buffered, as represented by block 1510, as it arrives. Moreover, the commands are processed in the background by algorithms 1700 which are specifically designed for that purpose.

The DAT 1202 and SAT 1204 include, though not explicitly shown in the block diagrams of FIGS. 19 and 20, all of the requisite microprocessor support circuitry. These circuits, including RAM, ROM, clocks, and buffers, are well known in the art of microprocessor circuit design.

In order to characterize the communication channel for upward signals, generation of the chirp sequence is accomplished by a digital signal generator controlled by the DAT microprocessor 1512. Typically, the chirp block is generated by a digital counter having its output controlled by a microprocessor to generate the complete chirp sequence. Circuits of this nature are widely used for variable frequency clock signal generation. The chirp generation circuitry is depicted as block 1500 in FIG. 19, a block diagram of the DAT 1202. Note that the digital output is used to generate a three level signal at 1502 for driving the transducer 1200. It is chosen for this application to maintain most of the signal energy in the acoustic spectrum of interest: one hundred and fifty Hertz to three hundred and fifty Hertz. The primary purpose of the third state is to terminate operation of the transmitting portion of a transceiver during its receiving mode: it is, in essence, a short circuit.

Figure 16:
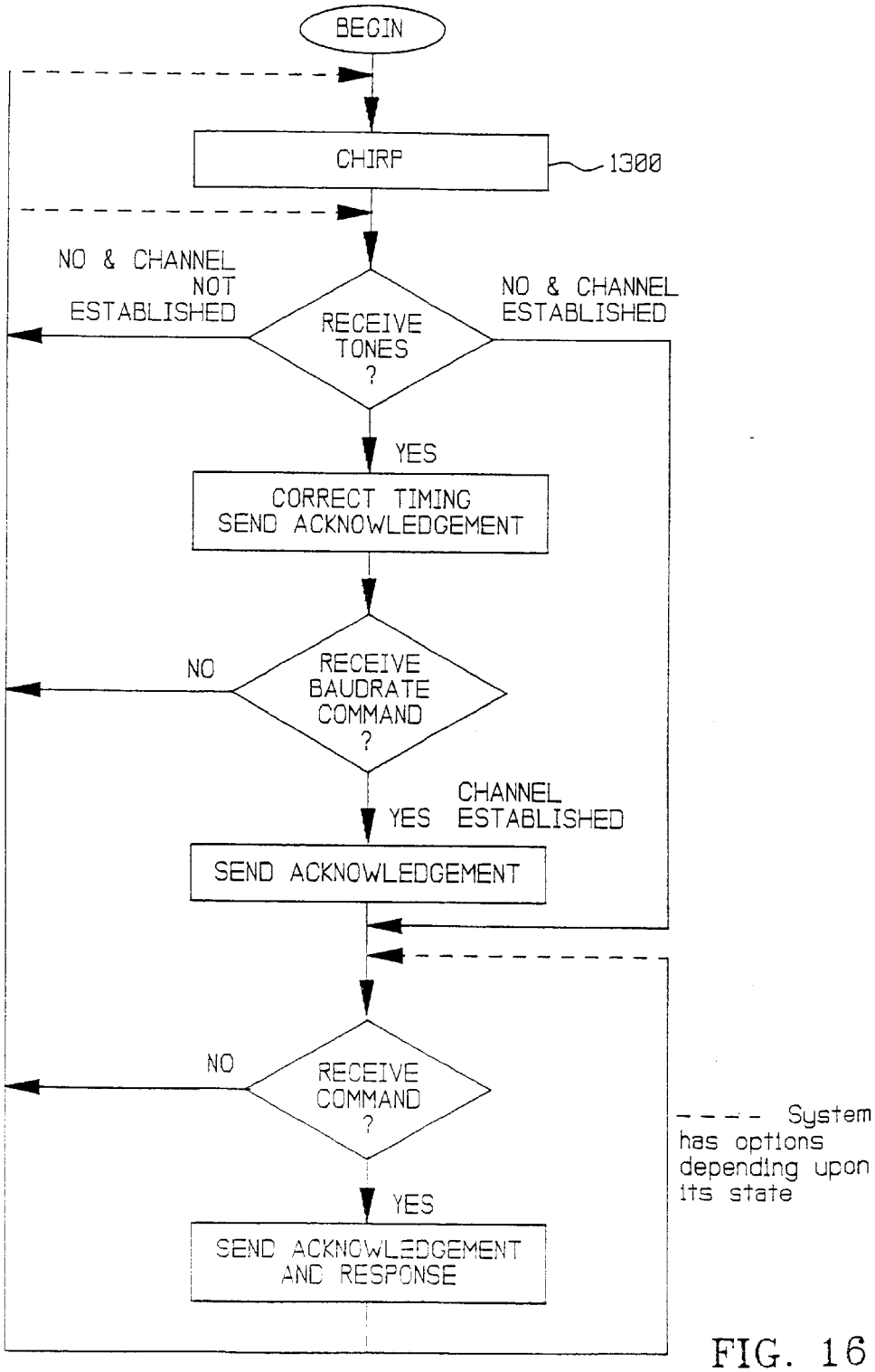
FIG. 16 is a flow chart depicting the synchronization process of the downhole acoustic transceiver portion of the preferred embodiment of FIG. 15.

FIG. 16 and FIG. 17 are flow charts of the DAT and SAT operations, respectively. The chirp sequences are generated during step 1300. Prior to the first chirp pulse being transmitted after the selected time delay, the surface transceiver awaits the arrival of the chirp sequences in accordance with step 1400 in FIG. 17. The DAT is programmed to transmit a burst of chirps every two minutes until it receives two tones: fc and fc+1. Initial synchronization starts after a "characterize channel" command is issued at the host computer. Upon receiving the "characterize channel" command, the SAT starts digitizing transducer data. The raw transducer data is conditioned through a chain of amplifiers, anti-aliasing filters, and level translators, before being digitized. One second data block (1024 samples) is stored in a buffer and pipelined for subsequent processing.

The functions of the chirp correlator are threefold. First, it synchronizes the SAT TX/RX clock to that of the DAT. Second, it calculates a clock error between the SAT and DAT timebases, and corrects the SAT clock to match that of the DAT. Third, it calculates a one Hertz resolution channel spectrum.

The correlator performs a FFT ("Fast Fourier Transform") on a 0.25 second data block, and retains FFT signal bins between one hundred and forty Hertz to three hundred and sixty Hertz. The complex valued signal is added coherently to a running sum buffer containing the FFT sum over the last six seconds (24 FFTs). In addition, the FFT bins are incoherently added as follows: magnitude squared, to a running sum over the last 6 seconds. An estimate of the signal to noise ratio (SNR) in each frequency bin is made by a ratio of the coherent bin power to an estimated noise bin power. The noise power in each frequency bin is computed as the difference of the incoherent bin power minus the coherent bin power. After the SNR in each frequency bin is computed, an "SNR sum" is computed by summing the individual bin SNRs. The SNR sum is added to the past twelve and eighteen second SNR sums to form a correlator output every 0.25 seconds and is stored in an eighteen second circular buffer. In addition, a phase angle in each frequency bin is calculated from the six second buffer sum and placed into an eighteen second circular phase angle buffer for later use in clock error calculations.

After the chirp correlator has run the required number of seconds of data through and stored the results in the correlator buffer, the correlator peak is found by comparing each correlator point to a noise floor plus a preset threshold. After detecting a chirp, all subsequent SAT activities are synchronized to the time at which the peak was found.

After the chirp presence is detected, an estimate of sampling clock difference between the SAT and DAT is computed using the eighteen second circular phase angle buffer. Phase angle difference (■$\phi$) over a six second time interval is computed for each frequency bin. A first clock error estimation is computed by averaging the weighted phase angle difference over all the frequency bins. Second and third clock error estimations are similarly calculated respectively over twelve and one hundred and eighty-five second time intervals. A weighted average of three clock error estimates gives the final clock error value. At this point in time, the SAT clock is adjusted and further clock refinement is made at the next two minute chirp interval in similar fashion.

After the second clock refinement, the SAT waits for the next set of chirps at the two minute interval and averages twenty-four 0.25 second chirps over the next six seconds. The averaged data is zero padded and then FFT is computed to provide one Hertz resolution channel spectrum. The surface system looks for a suitable transmission frequency in the one hundred and fifty Hertz to three hundred and fifty Hertz. Generally, a frequency band having a good signal to noise ratio and bandwidths of approximately two Hertz to forty Hertz is acceptable. A width of the available channel defines the acceptable baud rate.

The second phase of the initial communication process involves establishing an operational communication link between the SAT 1204 and the DAT 1202. Toward this end, two tones, each having a duration of two seconds, are sequentially sent to the DAT 1202. One tone is at the chosen center frequency and the other is offset from the center frequency by exactly one hertz. This step in the operation of the SAT 1204 is represented by block 1406 in FIG. 17.

The DAT is always looking for these two tones: fc and fc+1, after it has stopped chirping. Before looking for these tones, it acquires a one second block of data at a time when it is known that there is no signal. The noise collection generally starts six seconds after the chirp ends to provide time for echoes to die down, and continues for the next thirty seconds. During the thirty second noise collection interval, a power spectrum of one second data block is added to a three second long running average power spectrum as often as the processor can compute the 1024 point (one second) power spectrum.

The DAT starts looking for the two tones approximately thirty-fix seconds after the end of the chirp and continues looking for them for a period of four seconds (tone duration) plus twice the maximum propagation time. The DAT again calculates the power spectrum of one second blocks as fast as it can, and computes signal to noise ratios for each one Hertz wide frequency bins. All the frequency components which are a preset threshold above a noise floor are possible candidates. If a frequency is a candidate in two successive blocks, then the tone is detected at its frequency. If the tones are not recognized, the DAT continues to chirp at the next two minute interval. When the tones are received and properly recognized by the DAT, the DAT transmits the same two tones back to the SAT followed by an ACK at the selected carrier frequency fc.

Figure 21:
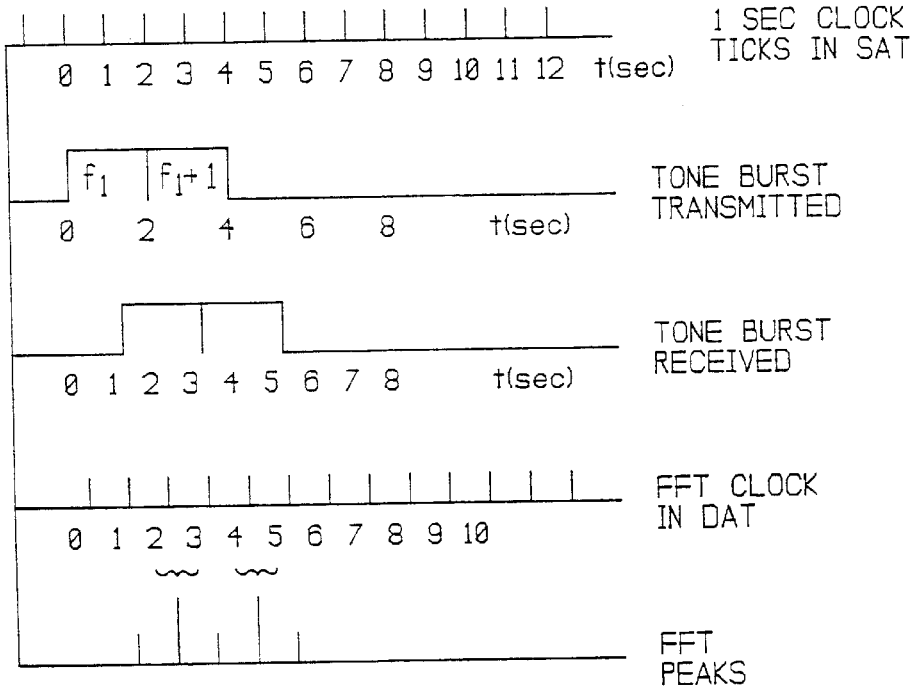
FIG. 21 depicts the second synchronization signals and the resultant correlation signals.

A by-product of the process of recognizing the tones is that it enables the DAT to synchronize its internal clock to the surface transceiver's clock. Using the SAT clock as the reference clock, the tone pair can be said to begin at time t=0. Also assume that the clock in the surface transceiver produces a tick every second as depicted in FIG. 21. This alignment is desirable to enable each clock to tick off seconds synchronously and maintain coherency for accurately demodulating the data. However, the DAT is not sure when it will receive the pair, so it conducts an FFT every second relative to its own internal clock which can be assumed not to be aligned with the surface clock. When the four seconds of tone pair arrive, they will more than likely cover only three one second FFT interval fully and only two of those will contain a single frequency. FIG. 21 is helpful in visualizing this arrangement. Note that the FFT periods having a full one second of tone signal located within it will produce a maximum FFT peak.

Once received, an FFT of each two second tone produces both amplitude and phase components of the signal. When the phase component of the first signal is compared with the phase component of the second signal, the one second ticks of the downhole clock can be aligned with the surface clock. For example, a two hundred Hertz tone followed immediately by a two hundred and one Hertz tone is sent from the transceiver at time t=0. Assume that the propagation delay is one and one-half seconds and the difference between the one second ticking of the clocks is 0.25 seconds. This interval is equivalent to three hundred and fifty cycles of two hundred Hertz Hz signal and 351.75 cycles of two hundred and one Hertz tone. Since an even number of cycles has passed for the first tone, its phase will be zero after the FFT is accomplished. However, the phase of the second tone will be two hundred and seventy degrees from that of the first tone. Consequently, the difference between the phases of each tone is two hundred and seventy degrees which corresponds to an offset of 0.75 seconds between the clocks. If the DAT adjusts its clock by 0.75 seconds, the one second ticks will be aligned. In general, the phase difference defines the time offset. This offset is corrected in this implementation. The timing correction process is represented by step 1308 in FIG. 16 and is accomplished by the software in the DAT, as represented by the software blocks in the DAT block diagram.

It should be noted that the tones are generated in both the DAT and SAT in the same manner as the chirp signals were generated in the DAT. As described previously, in the preferred embodiment of the invention, a microprocessor controlled digital signal generator 1500, 1628 creates a pulse stream of any frequency in the band of interest. Subsequent to generation, the tones are converted into a three level signal at 1502, 1630 for transmission by the transducer 1200, 1205 through the acoustic channel.

After tone recognition and retransmission, the DAT adjusts its clock, then switches to the Minimum Shift Keying (MSK) modulation receiving mode. (Any modulation technique can be used, although it is preferred that MSK be used for the invention for the reasons discussed below.) Additionally, if the tones are properly recognized by the SAT as being identical to the tones which were sent, it transmits a MSK modulated command instructing the DAT as to what baud rate the downhole unit should use to send its data to achieve the best bit energy to noise ratio at the SAT. The DAT is capable of selecting 2 to 40 baud in 2 baud increments for its transmissions. The communication link in the downhole direction is maintained at a two baud rate, which rate could be increased if desired. Additionally, the initial message instructs the downhole transceiver of the proper transmission center frequency to use for its transmissions.

If, however, the tones are not received by the downhole transceiver, it will revert to chirping again. SAT did not receive the ACK followed by tones since DAT did not transmit them. In this case the operator can either try sending tones however many times he wants to or try recharacterizing channel which will essentially resynchronize the system. In the case of sending two tones again, SAT will wait until the next tone transmit time during which the DAT would be listening for the tones.

If the downhole transceiver receives the tones and retransmits them, but the SAT does not detect them, the DAT will have switched to this MSK mode to await the MSK commands, and it will not be possible for it to detect the tones which are transmitted a second time, if the operator decides to retransmit rather than to recharacterize. Therefore, the DAT will wait a set duration. If the MSK command is not received during that period, it will switch back to the synchronization mode and begin sending chirp sequences every two minutes. This same recovery procedure will be implemented if the established communication link should subsequently deteriorate.

As previously mentioned, the commands are modulated in an MSK format. MSK is a form of modulation which, in effect, is binary frequency shift keying (FSK) having continuous phase during the frequency shift occurrences. As mentioned above, the choice of MSK modulation for use in the preferred embodiment of the invention should not be construed as limiting the invention. For example, binary phase shift keying (BPSK), quadrature phase shift keying (QPSK), or any one of the many forms of modulation could be used in this acoustic communication system.

In the preferred embodiment, the commands are generated by the host computer 1128 as digital words. Each command is encoded by a cyclical redundancy code (CRC) to provide error detection and correction capability. Thus, the basic command is expanded by the addition of the error detection bits. The encoded command is sent to the MSK modulator portion of the 68HC11 microprocessor's software. The encoded command bits control the same digital frequency generator 1628 used for tone generation to generate the MSK modulated signals. In general, each encoded command bit is mapped, in this implementation, onto a first frequency and the next bit is mapped to a second frequency. For example, if the channel center frequency is two hundred and thirteen Hertz, the data may be mapped onto frequencies two hundred and eighteen Hertz, representing a "1", and two hundred and eight Hertz, representing a "0". The transitions between the two frequencies are phase continuous.

Upon receiving the baud rate command, the DAT will send an acknowledgement to the SAT. If an acknowledgement is not received by the SAT, it will resend the baud rate command if the operator decides to retry. If an operator wishes, the SAT can be commanded to resynchronize and recharacterize with the next set of chirps.

A command is sent by the SAT to instruct the DAT to begin sending data. If an acknowledgement is not received, the operator can resend the command if desired. The SAT resets and awaits the chirp signals if the operator decides to resynchronize. However, if an acknowledgement is sent from the DAT, data are automatically transmitted by the DAT directly following the acknowledgement. Data are received by the SAT at the step represented at 1434.

Nominally, the downhole transceiver will transmit for four minutes and then stop and listen for the next command from the SAT. Once the command is received, the DAT will transmit another 4 minute block of data. Alternatively, the transmission period can be programmed via the commands from the surface unit.

It is foreseeable that the data may be collected from the sensors 1201 in the downhole package faster than they can be sent to the surface. Therefore, the DAT may include buffer memory 1510 to store the incoming data from the sensors 1201 for a short duration prior to transmitting it to the surface.

The data is encoded and MSK modulated in the DAT in the same manner that the commands were encoded and modulated in the SAT, except the DAT may use a higher data rate: two to forty baud, for transmission. The CRC encoding is accomplished by the microprocessor 1512 prior to modulating the signals using the same circuitry 1500 used to generate the chirp and tone bursts. The MSK modulated signals are converted to tri-state signals 1502 and transmitted via the transducer 1200.

In both the DAT and the SAT, the digitized data are processed by a quadrature demodulator. The sine and cosine waveforms generated by oscillators 1635, 1636 are centered at the center frequency originally chosen during the synchronization mode. Initially, the phase of each oscillator is synchronized to the phase of the incoming signal via carrier transmission. During data recovery, the phase of the incoming signal is tracked to maintain synchrony via a phase tracking system such as a Costas loop or a squaring loop.

The I and Q channels each use finite impulse response (FIR) low pass filters 1638 having a response which approximately matches the bit rate. For the DAT, the filter response is fixed since the system always receives thirty-two bit commands. Conversely, the SAT receives data at varying baud rates; therefore, the filters must be adaptive to match the current baud rate. The filter response is changed each time the baud rate is changed.

Subsequently, the I/Q sampling algorithm 1640 optimally samples both the I and Q channels at the apex of the demodulated bit. However, optimal sampling requires an active clock tracking circuit, which is provided. Any of the many traditional clock tracking circuits would suffice: a tau-dither clock tracking loop, a delay-lock tracking loop, or the like. The output of the I/Q sampler is a stream of digital bits representative of the information.

The information which was originally transmitted is recovered by decoding the bit stream. To this end, a decoder 1642 which matches the encoder used in the transmitter process: a CRC decoder, decodes and detects errors in the received data. The decoded information carrying data is used to instruct the DAT to accomplish a new task, to instruct the SAT to receive a different baud rate, or is stored as received sensor data by the SATs host computer.

The transducer, as the interface between the electronics and the transmission medium, is an important segment of the current invention; therefore, it was discussed separately above. An identical transducer is used at each end of the communications link in this implementation, although it is recognized that in many situations it may be desirable to use differently configured transducers at the opposite ends of the communication link. In this implementation, the system is assured when analyzing the channel that the link transmitter and receiver are reciprocal and only the channel anomalies are analyzed. Moreover, to meet the environmental demands of the borehole, the transducers must be extremely rugged or reliability is compromised.

3. Acoustic Tone Generator And Receiver—Software Version

In accordance with one embodiment of the present invention, a predominantly software version is utilized to send and decode acoustic coded messages which are utilized to individually and selectively actuate particular wellbore tools carried within a completion and/or drill stem test string.

Figure 22:
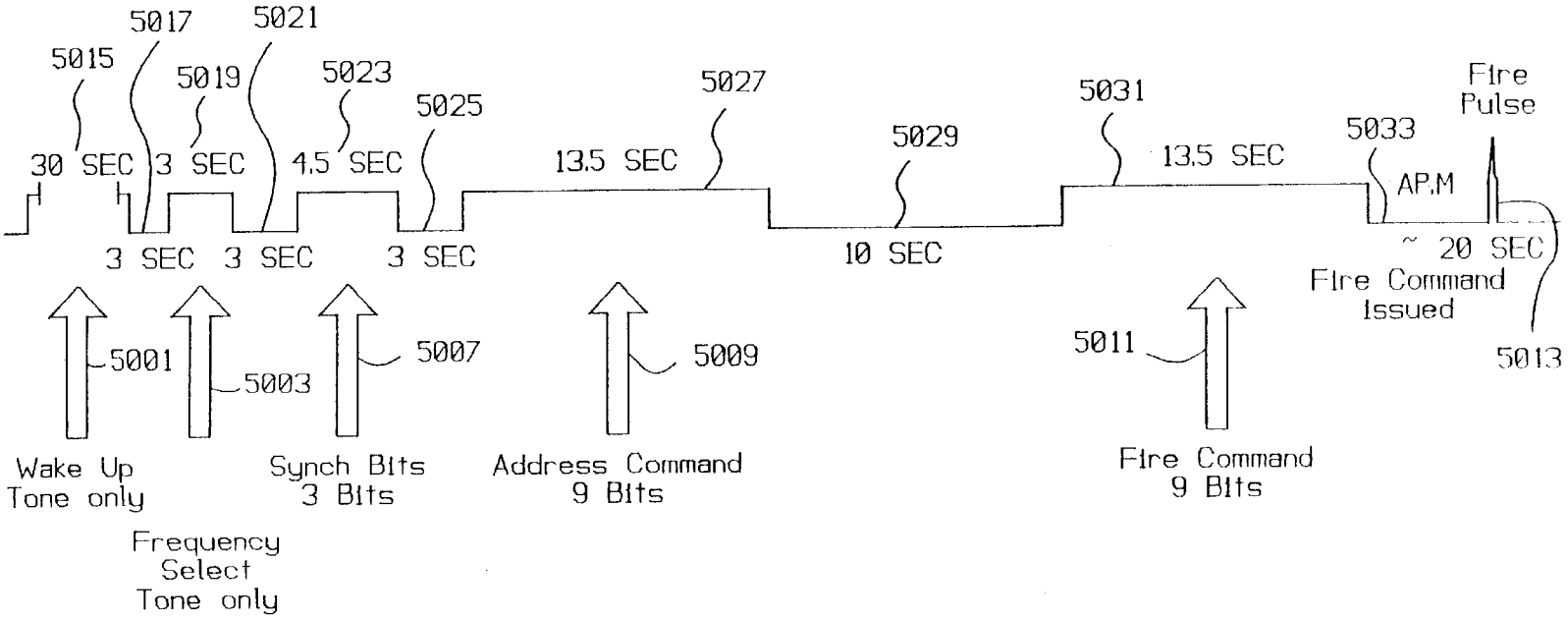
FIG. 22 is a timing and signal transmission diagram for a software implemented embodiment of the present invention.

Utilizing the acoustic transducer and communication system (described and depicted in connection with FIGS. 2 through 21), a series of coded acoustic messages are generated at an uphole or surface location for transmission to a downhole location, and reception and decoding by a controller associated with a transceiver located therein. FIG. 22 is a graphical depiction of the types of signals communicated within the wellbore and the relative timing of the signals. Since the quality of the communication channel is unknown, the series of signals depicted in FIG. 22 may be repeated for different frequencies until communication with the wellbore receiver is obtained and actuation of a particular wellbore tool is accomplished. In the preferred embodiment of the present invention, the wake-up tone 5001 is stepped through a predetermined number of different frequencies until it is determined that actuation of the particular wellbore tool has occurred. In the preferred embodiment of the present invention, on the first pass, the wake-up tone utilized is 22 Hertz. If no actuation occurs, the process is repeated a second time at 44 Hertz; still, if no actuation is detected, the entire process is repeated with a wake-up tone at 88 Hertz.

As is shown in FIG. 22, the wake-up tone 5001 is transmitted within the wellbore within time interval 5015, which is preferably a 30-second interval. A pause is provided during time interval 5017, having a 3-second duration. Then, a frequency select tone 5003 is communicated within the wellbore during time interval 5019, which is also preferably a 3-second time interval. The frequency select tone is, as discussed above in connection with the basic communication technology, a chirp including a variety of predetermined frequencies which are utilized to determine the carrier or communication frequencies for subsequent communications. In frequency shift keying modulation, the frequency select tone 5003 is utilized to select a first frequency (F1) and a second frequency (F2) which are representative of binary 0 and binary 1 in a frequency shift keying scheme. After the frequency select tone 5003 is transmitted, a pause is provided during time interval 5021 which has a duration of three seconds. During this interval, a downhole processor is utilized to analyze the chirp and to determine the optimum frequency segments which may be utilized for the frequency shift keying. Next, during time interval 5023 (which is preferably 4.5 seconds) synchronizing bits 5007 are communicated between the downhole and surface equipment in order to synchronize the downhole and surface systems. A pause is provided during time interval 5025 (which is preferably 3 seconds). Then, during time interval 5027 (which is preferably 13.5 seconds), a nine-bit address command 5009 is communicated. The nine-bit address command 5009 is identified with a particular one of the plurality of wellbore tools maintained in the subsurface location. After the nine-bit address command 5009 is communicated, a pause is provided during time interval 5029 (which is preferably 10 seconds). Next, during time interval 5031 (which is preferably 13.5 seconds) a nine-bit fire command 5011 is communicated which initiates actuation of the particular wellbore tool. If the fire command 5011 is recognized, a fire condition ensues during time interval 5033 (which is preferably about 20 seconds). During that time interval, a fire pulse 5013 is communicated to the end device in order to actuate it.

Figure 23:
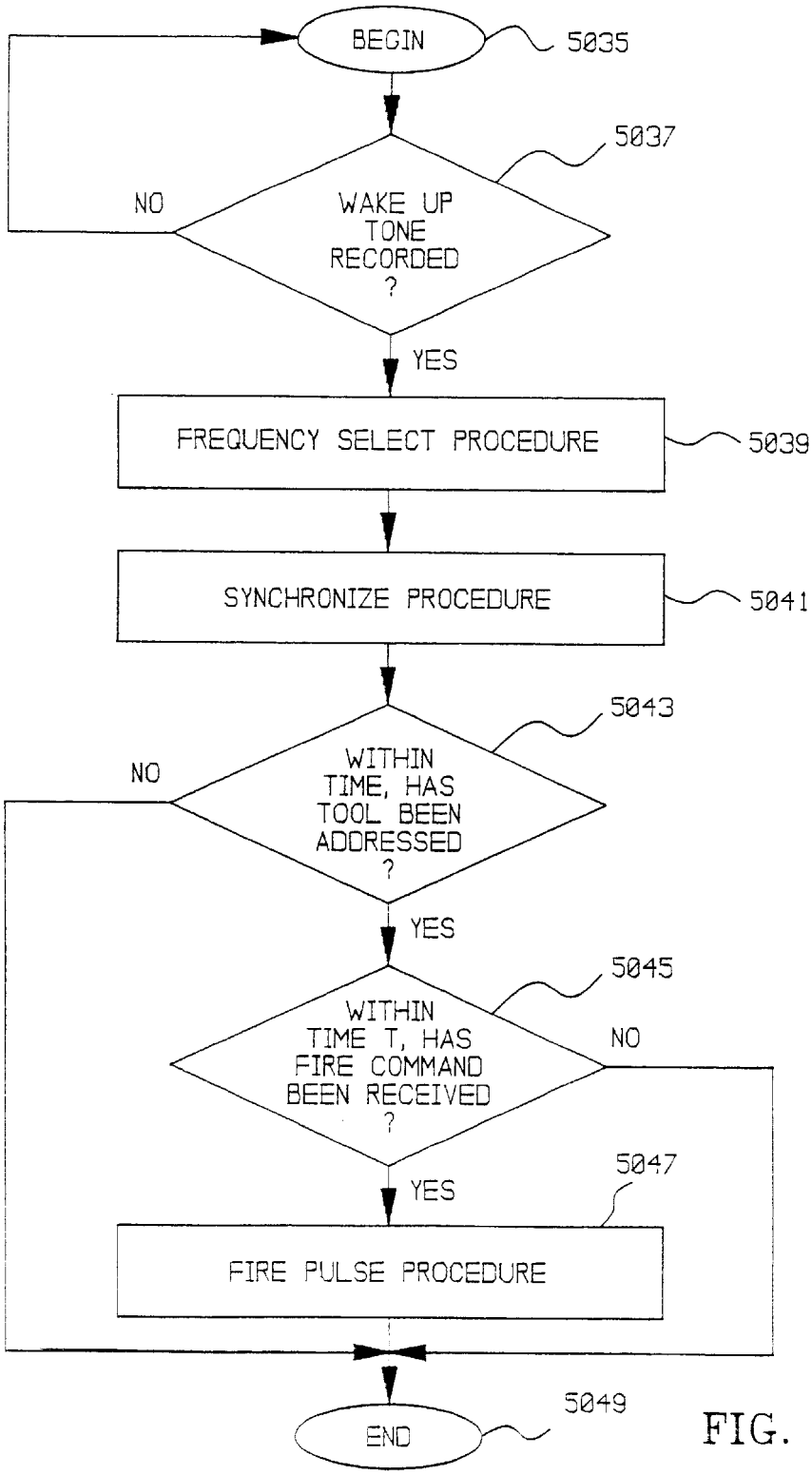
FIG. 23 is a flowchart depiction of the basic steps utilized to implement the software implemented embodiment of FIG. 22.

FIG. 23 is a flowchart representation of the technique utilized in the software version of the present invention in order to actuate particular wellbore tools. The process begins at software block 5035, and continues at software block 5037, wherein the software is utilized to determine whether a wake-up tone has been received; if not, control returns to software 5035; if a wake-up tone has been received, control passes to software block 5039, wherein the frequency select procedure is implemented. Then, in accordance with software block 5041, the synchronized procedure is implemented. Next, in accordance with software block 5043, the controller and associated software is utilized to determine whether a particular tool has been addressed; if not, the controller continues monitoring for the 13.5 second interval of time interval 5027 of FIG. 22. If no tool is addressed during that time interval, the process is aborted. However, if a particular tool has been addressed, control passes to software block 5045, wherein it is determined whether, within the time interval 5031 of FIG. 22, a fire command has been received; if no fire command is received during this 13.5 second time interval, control passes to software block 5049, wherein the controller and associated software is utilized to determine whether, within the time interval 5031 of FIG. 22, a fire command has been received; if not, control passes to software block 5049, wherein the process is aborted; if so, control passes to software block 5047, which is a fire pulse procedure which initiates a fire pulse to actuate the particular end device. After the fire pulse procedure 5047 is completed, control passes to software block 5049 wherein the process is terminated.

4. The Acoustic Tone Generator and Receiver—Hardware Version

An alternative hardware embodiment will now be discussed.

The acoustic tone actuator (ATA) includes an acoustic tone generator 4100 which is located preferably at a surface location and which is in communication with an acoustic communication pathway within a wellbore. A portion of the acoustic tone generator 4100 is depicted in block diagram form in FIG. 24. The acoustic tone actuator also includes an acoustic tone receiver 4200 which is preferably located in a subsurface portion of a wellbore, and which is in communication with a fluid column which extends between the acoustic tone generator 4100 and the acoustic tone receiver 4200 The acoustic tone receiver 4200 is depicted in block diagram and electrical schematic form in FIGS. 25 through 28. FIGS. 29A through 29G depict timing charts for various components and portions of the acoustic tone generator 4100 of FIG. 24 and the acoustic tone receiver 4200 of FIGS. 25 through 28.

Figure 30:
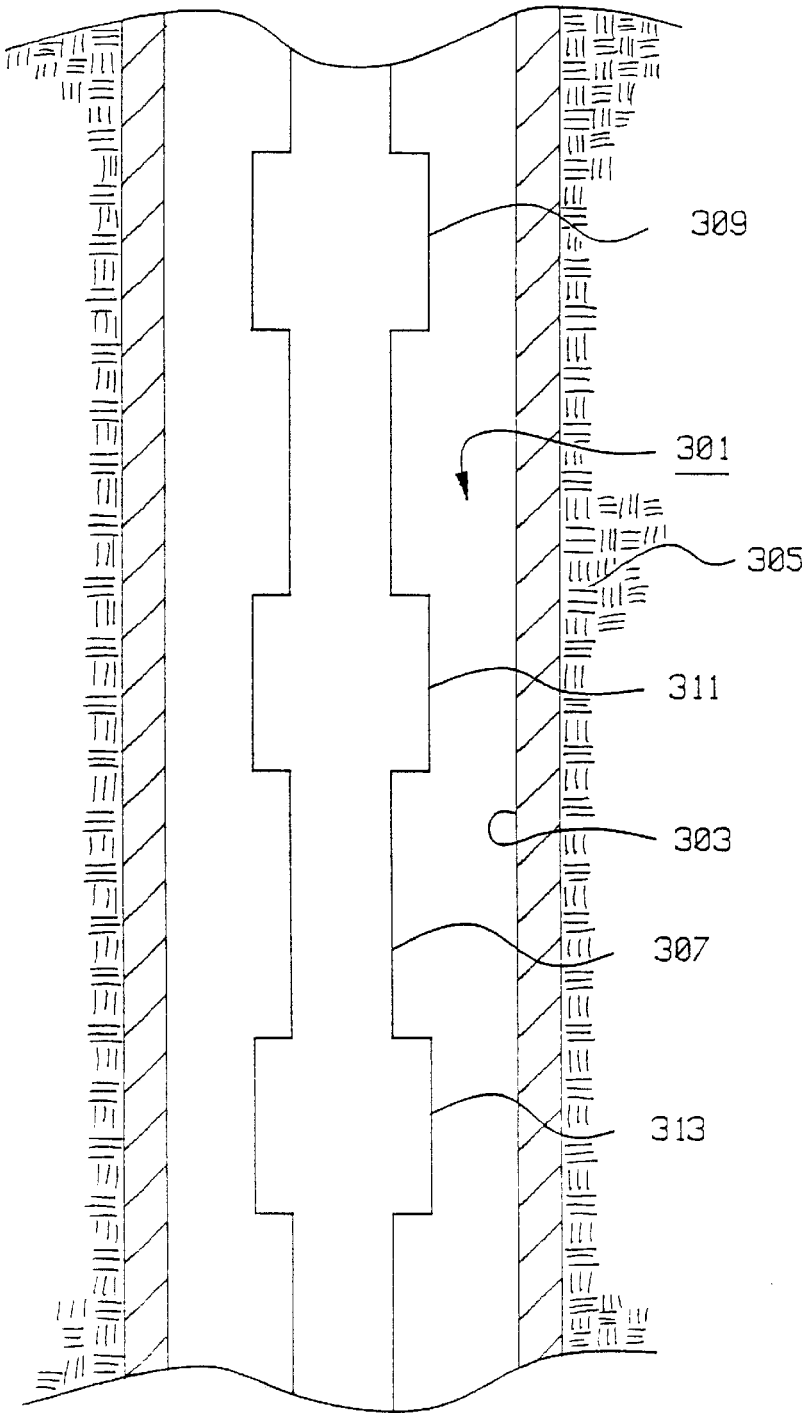
FIG. 30 and FIG. 31 depict an exemplary application of the acoustic tone activator of the present invention.

FIG. 30 graphically depicts the intended and preferred use of the acoustic tone actuator. As is shown, wellbore 301 includes casing 303 which is fixed in position relative to formation 305 and which serves to prevent collapse or degradation of wellbore 301. A tubular string 307 is located within the central bore of casing 303 and includes upper perforating gun 309, middle perforating gun 311, and lower perforating gun 313. The acoustic tone actuator may be utilized to individually and selectively actuate each of the perforating guns 309, 311, 313. Preferably, each of perforating guns 309, 311, 313 is hard-wired configured to be responsive to a particular one of a plurality of discreet available acoustic tone coded messages which are transmitted from acoustic tone generator 4100 of FIG. 24 and which are received by acoustic tone receiver 4200 of FIGS. 25 through 28. When a particular one of perforating guns 309, 311, 313 is actuated, an electrical current is supplied to an electrically-actuable explosive charge which causes an explosion which propels piercing bodies outward from tubing string 307 toward casing 303, perforating casing 303, and thus allowing the communication of gases and fluids between formation 305 and the central bore of casing 303.

Figure 24:
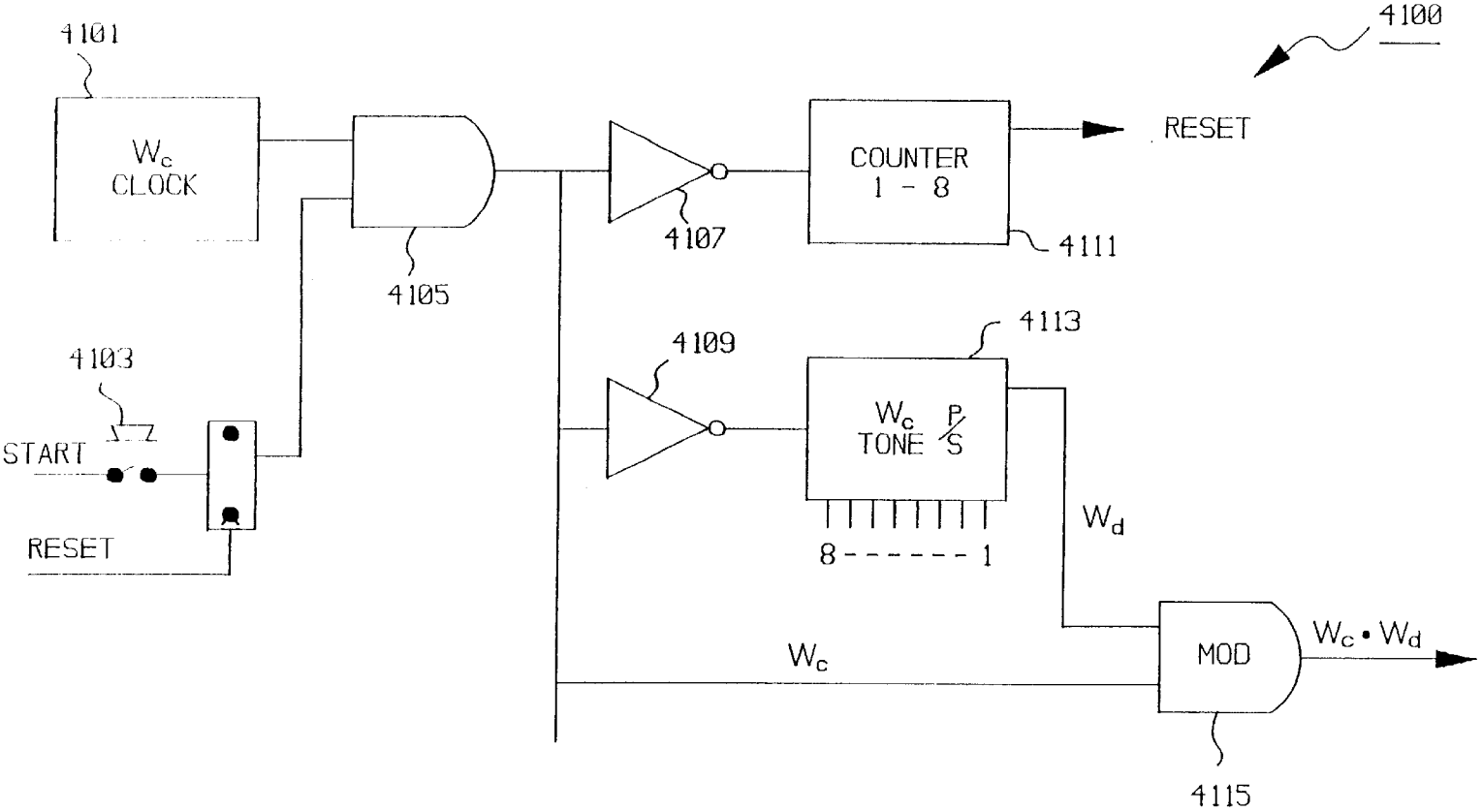
FIG. 24 depicts an acoustic tone generator in accordance with a hardware embodiment of the present invention.

The preferred acoustic tone generator 4100 will now be described with reference to FIG. 24, and the timing chart of FIGS. 29A through 29G. With reference now to FIG. 24, acoustic tone generator 4100 includes clock 4101 which generates a uniform timing pulse, such as that depicted in the timing chart of FIG. 29A. A pulse of a particular duration is automatically generated by clock 101 at a clock frequency $w_c$. Operation of acoustic tone generator 4100 is initiated by actuation of start button 4103. The output of clock 4101 and the output of start button 4103 are provided to AND-gate 4105. When both of the inputs to AND-gate 105 are high, the output of AND-gate 105 will be high. All other input combinations will result in an output of a binary zero from AND-gate 105. The reset line of start button 103 may be utilized to switch back to an off-condition. The output of AND-gate 105 is supplied to inverter 107, inverter 109, and modulating AND-gate 115. The output of inverter 107 is supplied to counter 111. Counter 111 operates to count eight consecutive pulses from clock 103, and then to provide a reset signal to the reset line of start button 103. The output of inverter 109 is supplied to universal asynchronous receiver/transmitter (UART) 113 which is adapted to receive an eight-bit binary parallel input, and to provide an eight-bit binary serial output. The input of bits 1–8 is provided by any conventional means such as an eight-pin dual-in-line-package switch, also known as a "DIP switch". In alternative embodiments, the eight-bit parallel input may be provided by any other conventional means. The serial output of UART 113 is provided as an input to modulating AND-gate 115. The output of AND-gate 105 is also supplied as an input to modulating AND-gate 115. The output of modulating AND-gate 115 is the bit-by-bit binary product of the clock signal $w_c$ and the eight-bit serial binary output of UART 113 $w_d$. The output of modulating AND-gate 115 is supplied as a control signal to an electrically-actuated pressure pulse generator 175, such as has been described above. Therefore, the eight bit serial data is supplied in the form of acoustic pulses or tones to a predefined acoustic communication path which extends from the acoustic tone generator 100 of FIG. 6 to the acoustic tone receiver 200 of FIG. 7, where it is detected.

Figures 29A, 29B, 29C, 29D, 29E, 29F, 29G:
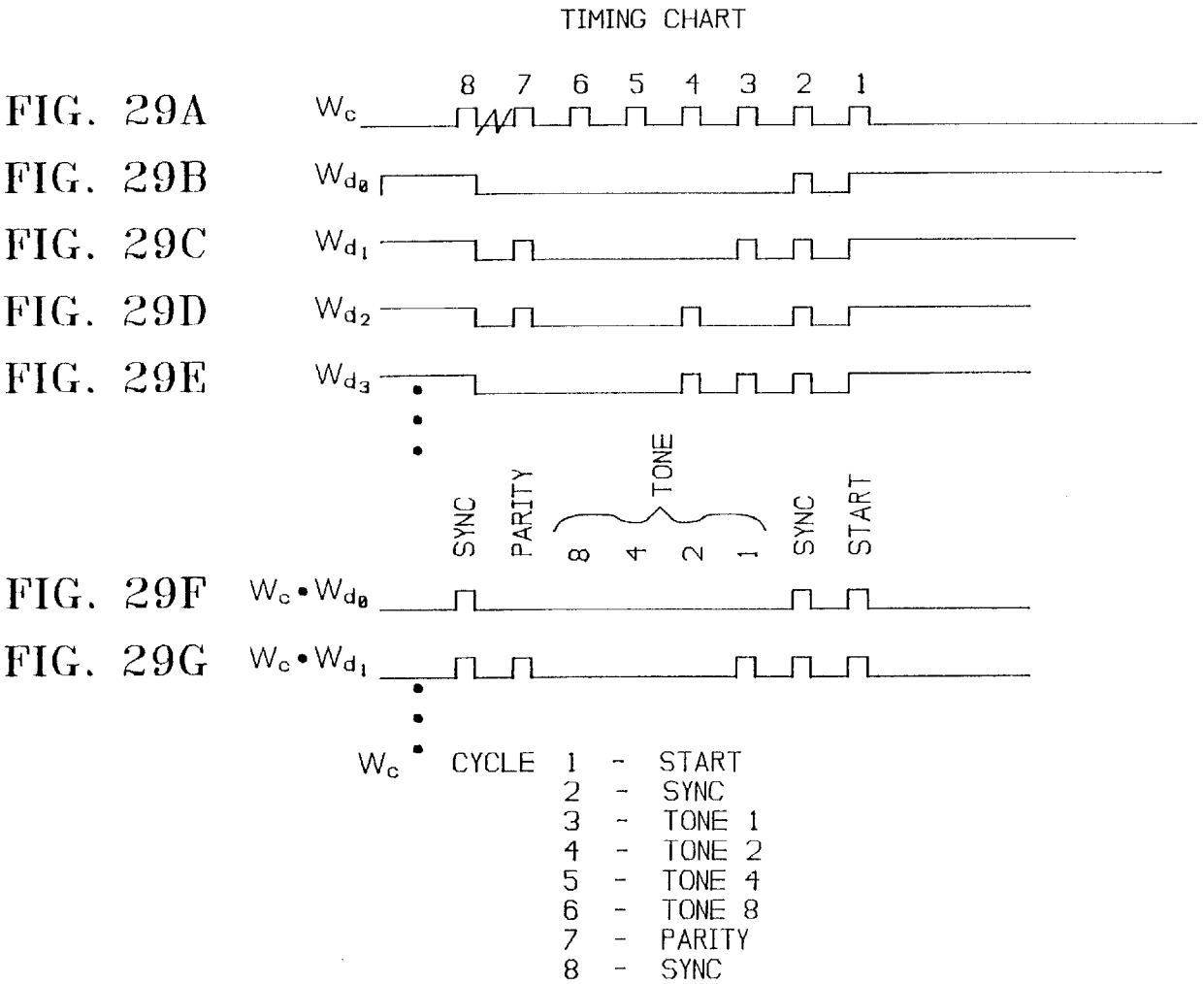
FIG. 29A through FIG. 29G are timing charts which illustrate the operation of the acoustic tone receiver and acoustic tone generator.

With reference now to FIGS. 29A through 29G, the eight-bit serial binary data will be discussed and described in detail. FIG. 29A depicts eight consecutive pulses from clock 4103. Bit number 1 defines a start pulse which alerts the remotely located receiver that binary data follows. Bit number 2 represents a synchronization bit which allows the remotely located acoustic pulse receiver 4200 to determine if it is in synchronized operation with the acoustic tone generator 4100. Bits 3, 4, 5, and 6 represent a four-bit binary word which is determined by the serial input to UART 4113 of FIG. 24. Bit number 7 represents a parity bit which is either high or low depending upon the content of bits 3 through 6 in a particular parity scheme or protocol. The parity bit is useful in determining whether a correct signal has been received by acoustic tone receiver 4200. FIGS. 29B through 29E represent three different binary values for bits 3 through 6. The timing chart of FIG. 29B represents a binary value of zero for bits 3 through 6. The timing chart of FIG. 29C represents a binary value of one for bits 3 through 6. The timing chart of FIG. 29D represents a binary value of two for bits 3 through 6. The timing chart of FIG. 29E represents a binary value of three for bits 3 through 6. Since four binary bits are available to represent coded messages, a total of sixteen possible different codes may be provided (with binary values of 0 through 15). The timing chart of FIG. 29F represents the bit-by-bit product of the timing pulse and a binary value of zero for bits 3 through 6. In contrast, timing chart of FIG. 29G represents the bit-by-bit product of the timing pulse and a binary value of one for bits 3 through 6. Since the binary value of bits 3 through 6 of timing chart 29F is zero (and thus even) the value of parity bit 7 is a binary zero. In contrast, since the binary value of bits 3 through 6 of timing chart 29G is one (and thus odd) the binary value of parity bit 7 is one.

Figure 25:
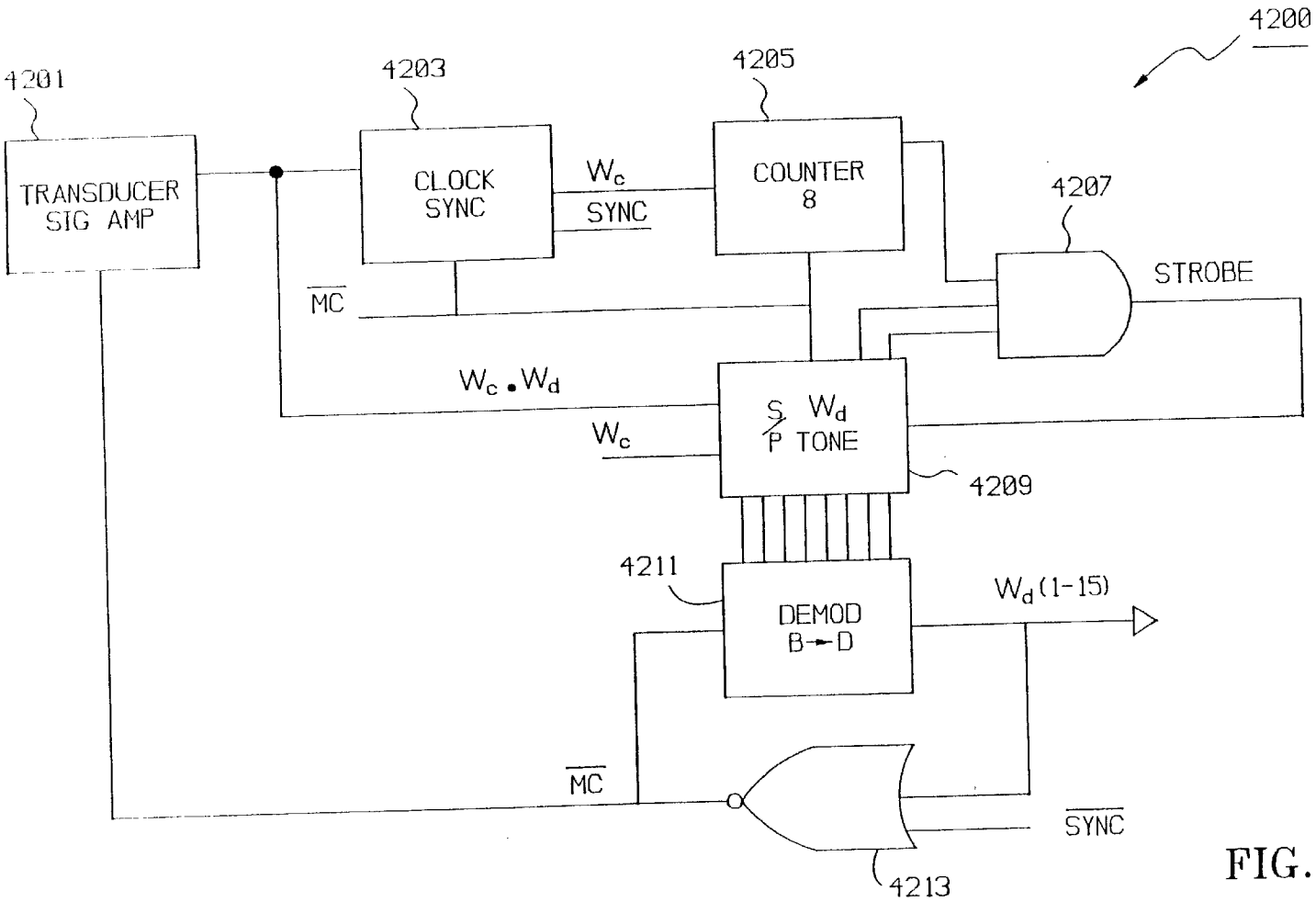
FIGS. 25 and 26 are circuit diagrams for an acoustic tone receiver of the hardware embodiment of the present invention.
Figure 26:
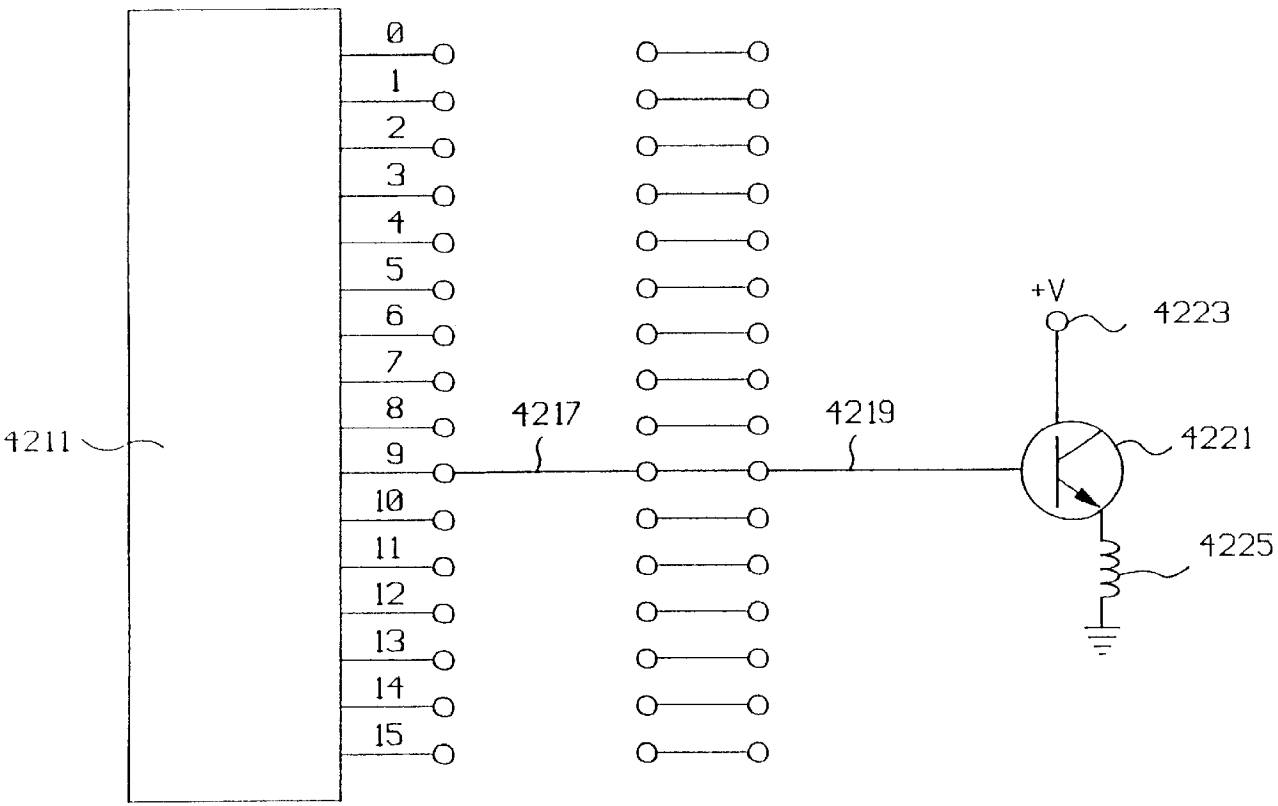

FIG. 25 is a block diagram and electrical schematic depiction of acoustic tone receiver 4200. Reception circuit 4201 includes transducers and at least one stage of signal amplification. Synchronizing clock 4203 is provided to provide a clock signal $w_c$ with the same pulse frequency of clock 4101 of acoustic tone generator 4100 of FIG. 24. Additionally, synchronizing clock 4203 provides a synchronizing pulse like the synchronizing pulses of bits 2 and 8 of FIGS. 8A through 8G. The output of synchronizing clock 4203 is provided to counter 4205 which provides a binary one for every eight clock pulses counted. The output of counter 4205 is supplied as one input to AND-gate 4207. The other two inputs to AND-gate 4207 will be supplied from two particular bits of data present in shift register 4209. Shift register 4209 receives as an input the acoustic pulses detected by receiver circuit 4201. Namely, it receives the bit-by-bit product of $w_c$ and $w_d$, as a serial input. Additionally, shift register 4209 is clocked by the clock output of synchronizing clock 4203. Thus, the acoustic pulses detected by receiving circuit 4201 are clocked into shift register 4209 one-by-one at a rate established by synchronizing clock 4203. The parity bit and a synchronizing bit are supplied from shift register 4209 as the other two inputs to AND-gate 4207. When ail the input lines to AND-gate 4207 are high, AND-gate provides a binary strobe which actuates shift register 4209, causing it to pass the eight-bit serial binary data from shift register 4209 to demodulator 4211. Preferably, demodulator 4211 receives a multi-bit parallel input, and maps that to a particular one of sixteen available output lines. Demodulator 4211 is depicted in FIG. 29B. As is shown, sixteen available output pins are provided. The input of a particular binary (or hexadecimal) input will produce a high voltage at a particular pin associated with the particular binary or hexadecimal value. For example, demodulator 4211 may supply a high voltage at pin 9 if binary 9 is received as an input. In that particular case, jumpers 4217, 4219 may be utilized to allow the application of the high voltage from pin 9 to the base of switching transistor 4221. In this configuration, when pin 9 goes high, switching transistor 4221 is switched from a non-conducting condition to a conducting condition, allowing current to flow from pin 4223 (which is at +V volts) through switching transistor 4221 and perforation actuator 4225. Preferably, the perforating guns include a thermally-actuated power charge, and element 4225 comprises a heating wire extending through the power charge.

With reference now to FIG. 29A, simultaneous with the generation of a voltage of a particular pin of demodulator 4211, the voltage from that particular pin is applied as an input to NOR-gate 4213. Additionally, the synchronizing pulse train generated by synchronizing clock 4203 is supplied as an input to NOR-gate 4213. The output of NOR-gate 4213 is a master-clear line which is utilized to reset demodulator 4211, synchronizing clock 4213, counter 4205, and reception circuit 4201. This places the circuit components in a condition for receiving an additional acoustic pulse train from acoustic tone generator 4100 of FIG. 24.

Figure 27A:
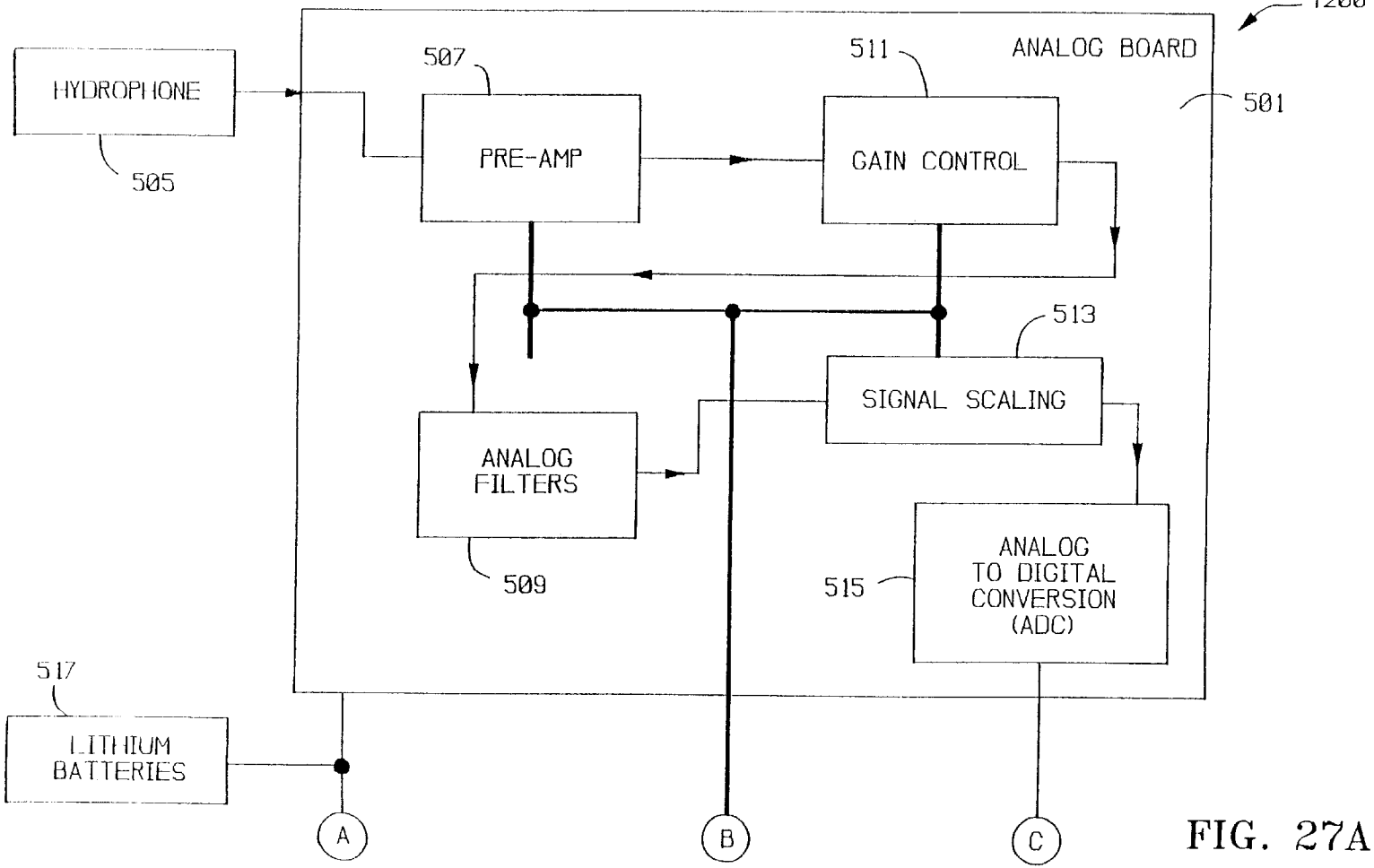
FIG. 27 is a block diagram depiction of an alternative embodiment of the acoustic tone receiver.
Figure 27B:
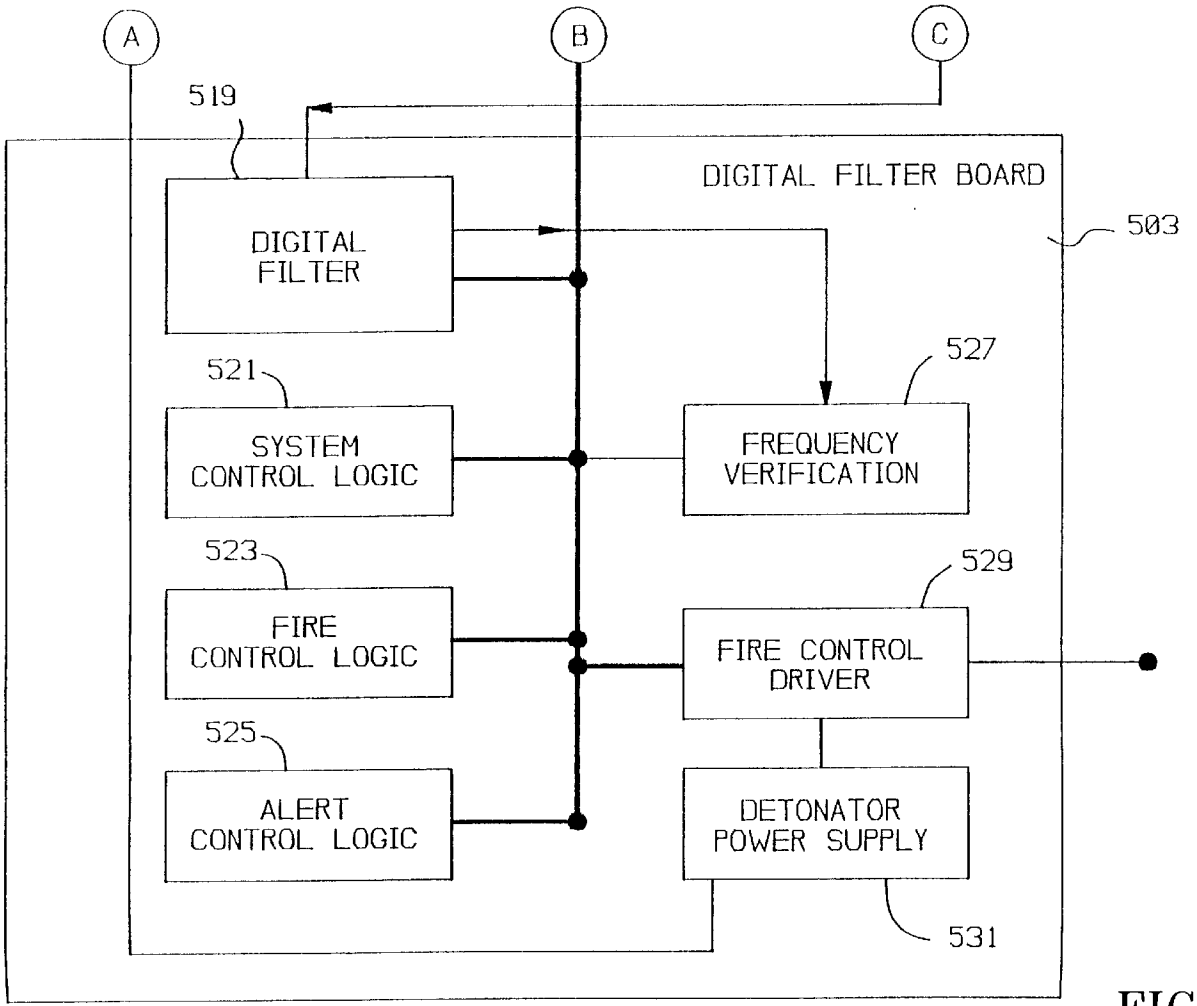

FIG. 27 is a block diagram representation of one preferred embodiment of the acoustic tone receiver 4200. As is shown, hydrophone 505 is utilized to detect the acoustic signals and direct electrical signals corresponding to the acoustic signals to analog board 501. The electrical signal generated by hydrophone 505 is provided to preamplifier 507. Gain control circuit 511 is utilized to control the gain of preamplifier 507. Analog filers 509 are utilized to condition the signal and eliminate noise components. Signal scaling circuit 513 is utilized to scale the signal to allow analog-to-digital conversion by analog-to-digital conversion circuit 515. The output of the analog-to-digital conversion circuit 515 is provided to a digital board 503 of acoustic tone receiver 200. Filter 519 receives the digital output of analog-to-digital conversion circuit 515. The output of digital filter 519 is provided as an input to code verification circuit 527, which is depicted in FIG. 25. Systems control logic circuit 521 is utilized for starting and resetting the digital circuit components of acoustic tone receiver 200. The fire control logic 523 is similar to the control logic depicted in FIG. 26. The fire control driver circuit 529 is utilized to supply current to an electrically actuable detonator circuit. Preferably, a detonator power supply 531 is provided to energize the detonation. Additionally, an abort circuit is present in abort control logic 525.

Figure 28A:
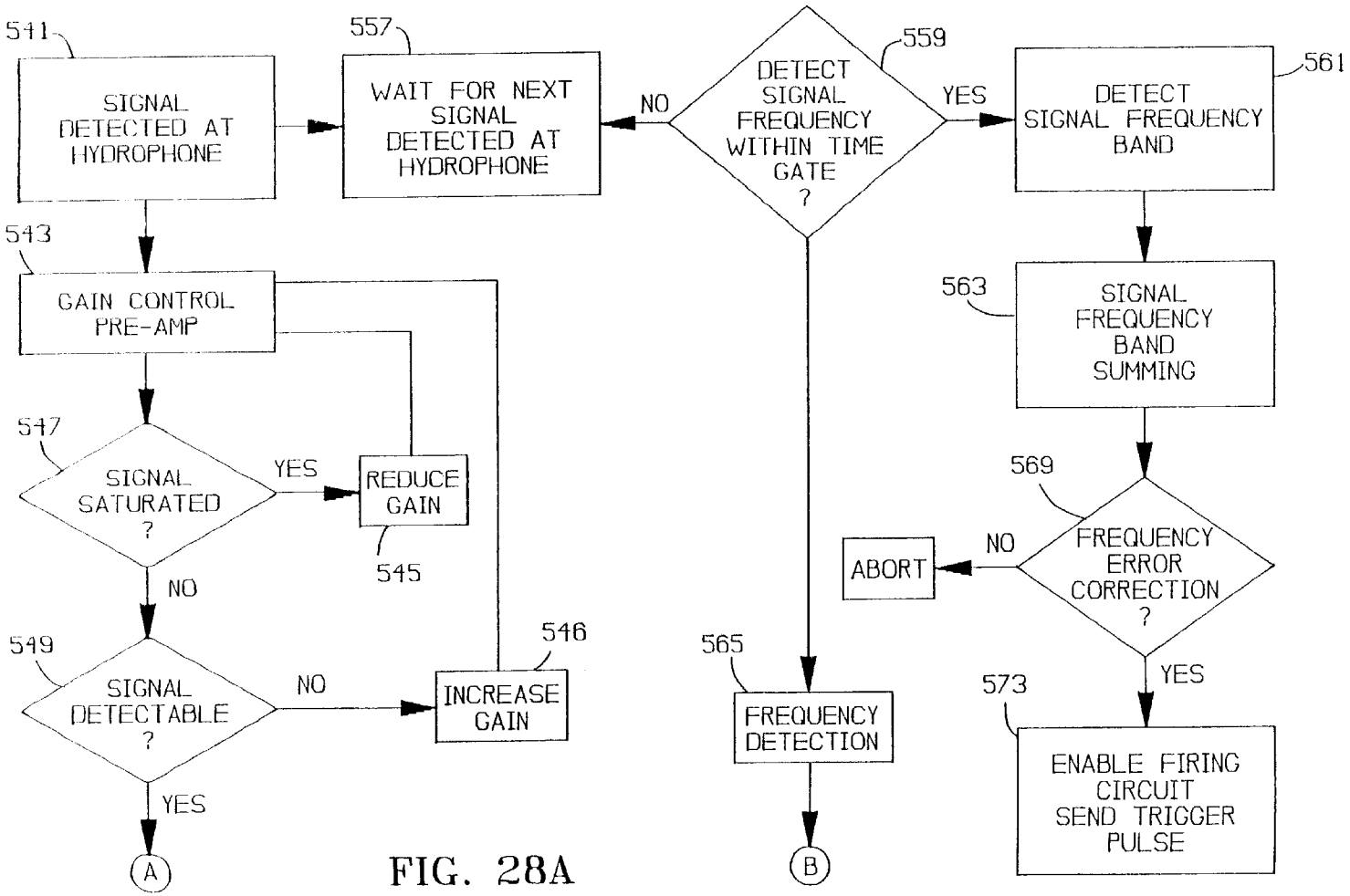
FIG. 28 is a flowchart of the operation of the embodiment of FIG. 29.
Figure 28B:
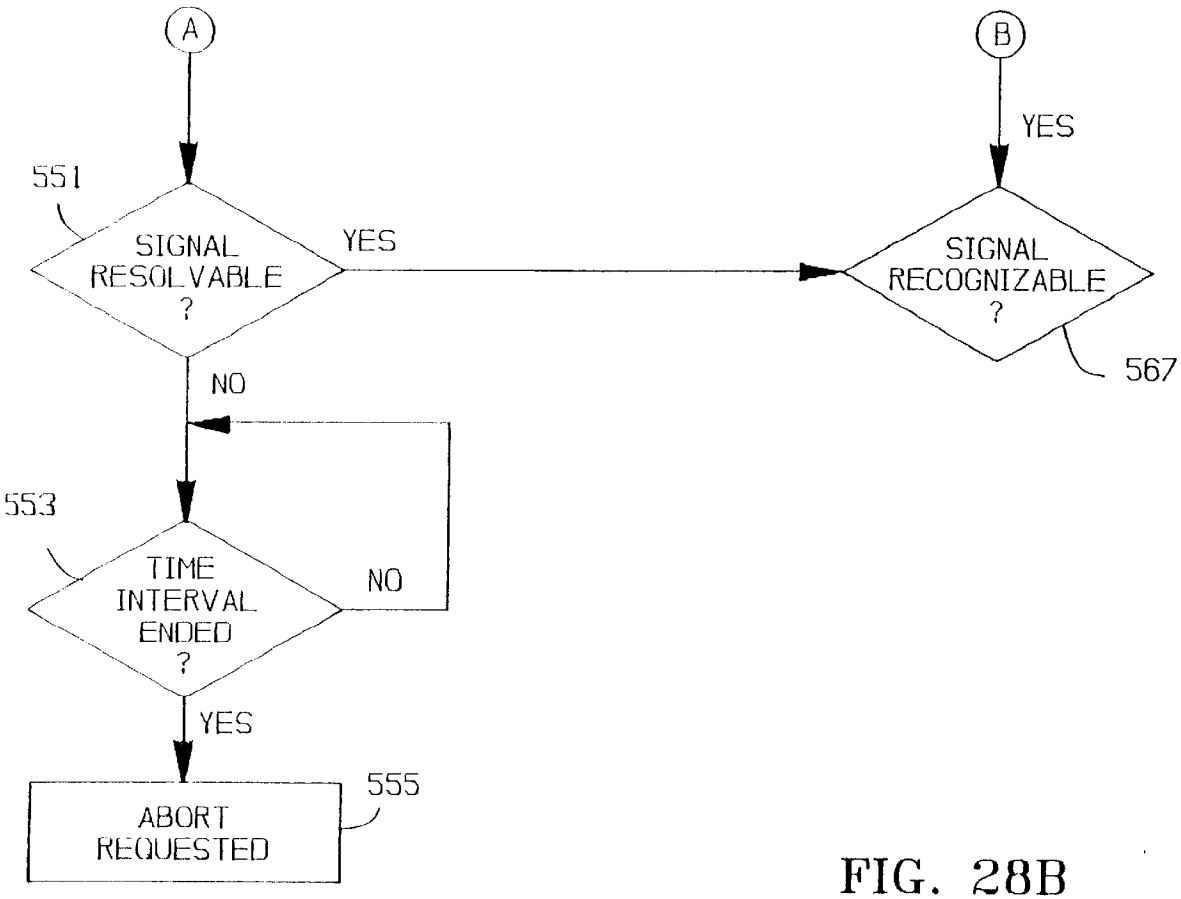

FIG. 28 is a flowchart depiction of the operations performed by the acoustic tone receiver 4200. At flowchart block 541, a signal is detected at the hydrophone. The signal is provided to the gain control amplifier in accordance with software block 543. In accordance with software blocks 547, 549, the analog signal is examined and determined whether it is saturated, and determined whether it is detectable. If the signal is determined to be saturated in software block 547, the process continues at software block 549, wherein the gain is reduced. If it is determined at software block 549 that the signal is not detectable, then in accordance with software block 546, the gain is increased. In accordance with software block 551, it is determined whether or not the signal is resolvable. If the signal is resolvable, control is passed to software block 567; however, if it is determined that the signal is not resolvable, in accordance with software block 553, and 555, a predetermined time interval is allowed to pass (during which the signal is examined to determine whether it is resolvable). If it is determined that the signal is not resolvable within the predetermined time interval, the actuation of the downhole tool associated with the acoustic tone receiver 200 is aborted, in accordance with software block 555. If it is determined at software block 551 that the signal is resolvable, and it is further determined at software block 567 that the signal is recognizable, then it is determined that a "tone" has been detected. The detection of a tone is represented by software block 565. Software blocks 557 and 559 together determine whether a tone is detected in the appropriate time interval. Together software blocks 561, 563, 569, and 571 determine whether or not a series of acoustic tones which have been detected correspond to a particular command signal which is associated with a particular wellbore tool. The series of acoustic tones can be considered to be either a series of binary characters, or a series of transmission frequencies which together define a command signal. The flowchart set forth in FIG. 7D utilizes the transmission frequency analysis, and thus examines the signal frequency band for the series of acoustic tones. If the series of acoustic tones do not match the preprogrammed command signal, the process aborts in accordance with software block 571; however, if the series of acoustic tones matches the programmed command signal, a firing circuit is enabled in accordance with software block 573.

5. Applications and end Devices

Figure 31:
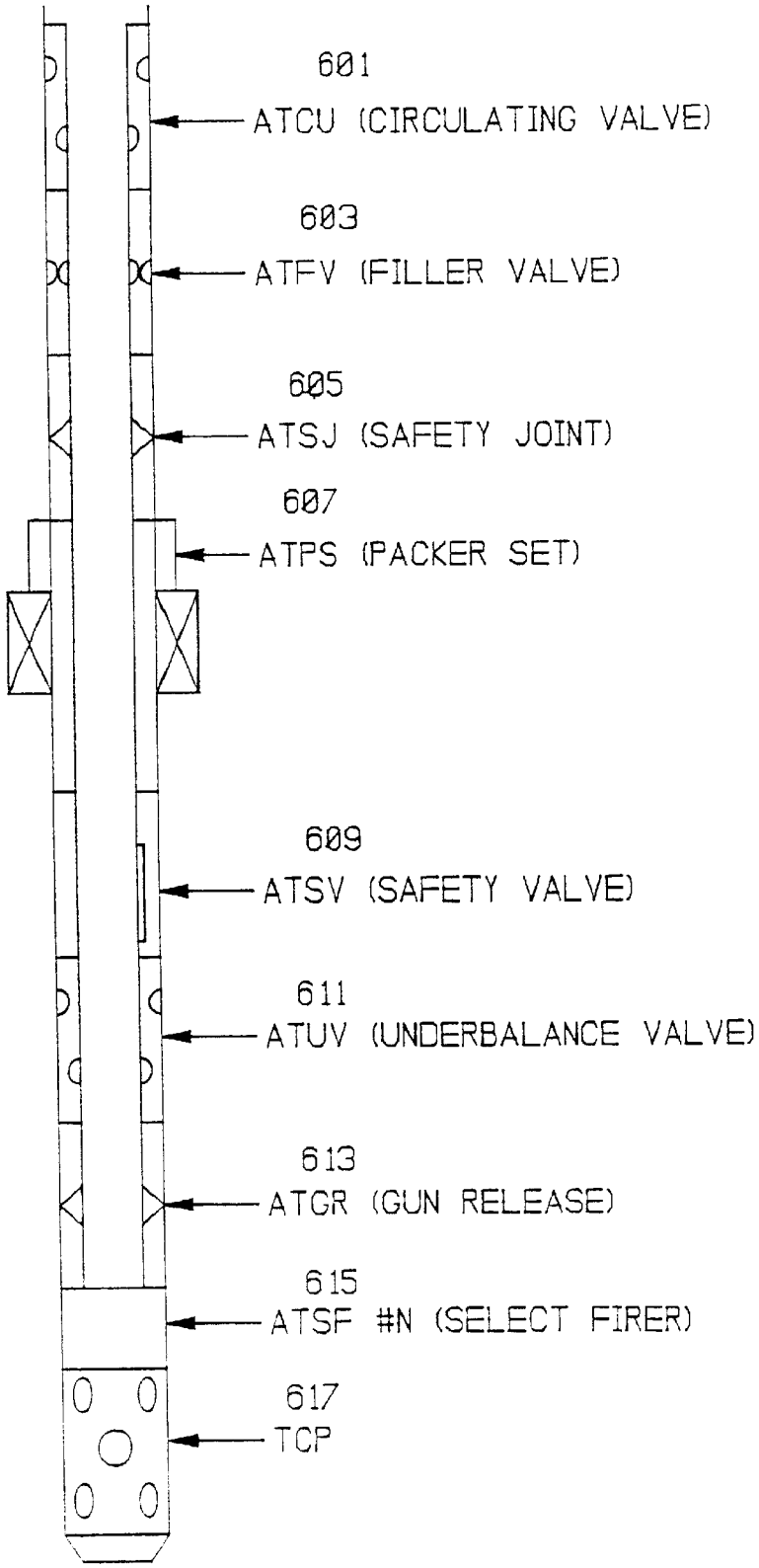
Figure 32:
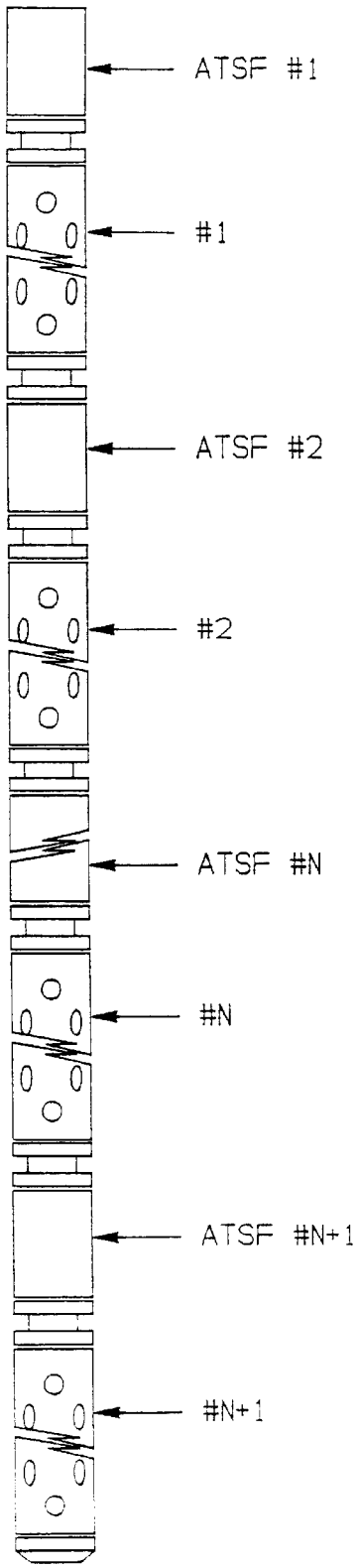
FIG. 32 is a flow chart representation of the computer control of the acoustic tone generator.

FIGS. 31 through 43 will now be utilized to describe one particular use of the communication system of the present invention, and in particular to describe utilization of the communication system of the present invention in a complex completion activity. FIG. 31 is a schematic depiction of a completion string with a plurality of completion tools carried therein, each of which is selectively and remotely actuable utilizing the communication system of the present invention. More particularly, each particular completion tool in the string of FIG. 31 is identified with the particular command signal, prior to lowering the completion string into the wellbore. The particular command signals are recorded at the surface, and utilized to selectively and remotely actuate the wellbore tools during completion operations in a particular operator-determined sequence. In the particular example shown in FIG. 31, the completion string includes an acoustic tone circulating valve 601, an acoustic tone filler valve 603, an acoustic tone safety joint 605, an acoustic tone packer 607, an acoustic tone safety valve 609, an acoustic tone underbalance valve 611, an acoustic gun release 613, and an acoustic tone select firer 615, as well as a perforating gun assembly 617. FIG. 32 is a schematic depiction of one preferred acoustic tone select firer 615 of FIG. 31. As is shown, a plurality of acoustic tone select firing devices are carried along with an associated perforating gun. As is conventional, spacers may be provided between the perforating guns to define the distance between perforations within the wellbore.

Returning now to FIG. 31, the operation of the various wellbore tools will now be described. Circulating valve 601 is utilized to control the flow of fluid between the central bore of the completion string and the annulus. The acoustic tone circulating valve 601 may be run-in in either an open condition or closed condition. A command signal may be communicated within the wellbore to change the condition of the valve to either prevent or allow circulation of fluid between the central bore of the completion string and the annulus. Acoustic tone filler valve 603 is utilized to prevent or allow the filling of the central bore of the completion string with fluid. The valve may be run in in either an open condition or a closed condition. The command signal uniquely associated with the acoustic tone filler valve 603 may be communicated in a wellbore to change the condition of the valve. Acoustic tone safety joint 605 is a mechanical mechanism which couples upper and lower portions of the completion string together. If the lower portion of the completion string becomes stuck, the acoustic tone safety joint 605 may be remotely actuated to release the lower portion of the completion string and allow retrieval of the upper portion of the completion string. The acoustic tone safety joint is in a locked condition during run-in, and may be unlocked by directing the appropriate command signal within the wellbore. The acoustic tone packer set 607 is run into the wellbore in a radially reduced running condition. The packer may be set to engage and seal against a wellbore tubular such as a casing string. The acoustic tone safety valve 609 is a valve apparatus which includes a flapper valve component which prevents communication of fluid through the central bore of the completion string. Typically, the acoustic tone safety valve 609 is run into the wellbore in an open condition (thus allowing communication of fluid within the completion string); however, if the operator desires that the fluid path be closed, a command signal may be directed downward within the wellbore to move the acoustic tone safety valve 609 from an open condition to a closed condition. The acoustic tone underbalance valve 611 is provided in the completion string to allow or prevent an underbalanced condition. Therefore, it may be run into the wellbore in either an open condition or a closed condition. In a closed condition, the acoustic tone underbalance valve 611 prevents communication of fluid between the central bore of the completion string and the annulus. The acoustic tone gun release 613 couples the completion string to the acoustic tone select firer 615 and the tubing conveyed perforating gun 617. The acoustic tone gun release 613 mechanically latches the completion string to the acoustic tone select firer 615 during running operations. If the operator desires to drop the perforating guns, and remove the completion string, a command signal is directed downward within the wellbore which causes the acoustic tone gun release to unlatch and allow separation of the completion string from the acoustic tone select firer 615 and tubing conveyed perforating gun 617. The acoustic tone select firer 615 allows for the remote and selective actuation of a particular tubing conveyed perforating gun 617 which is associated therewith.

FIG. 32 depicts a multiple gun completion string. Each of these fire and gun assemblies may be mutually and selectively actuated by remote control commands which are initiated at a remote wellbore location, such as the surface of the wellbore.

Figure 33:
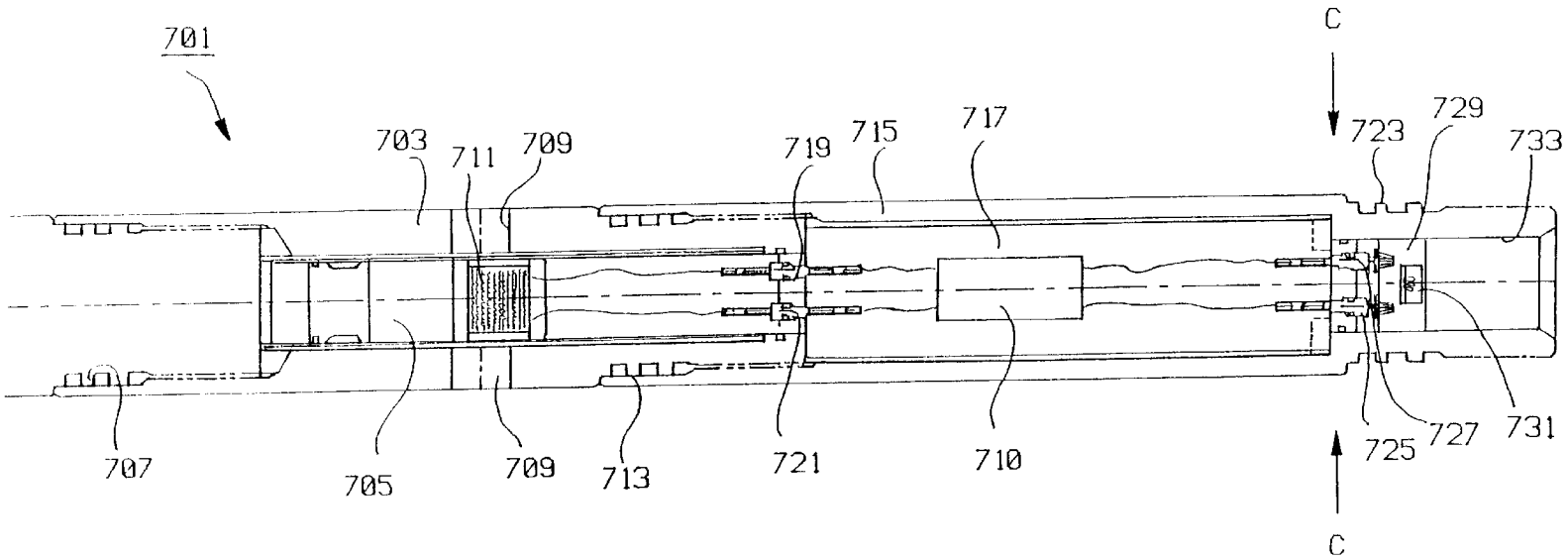
FIG. 33 is a longitudinal section view of a gas generating end device which may be activated by the acoustic tone activator of the present invention.
Figure 35:
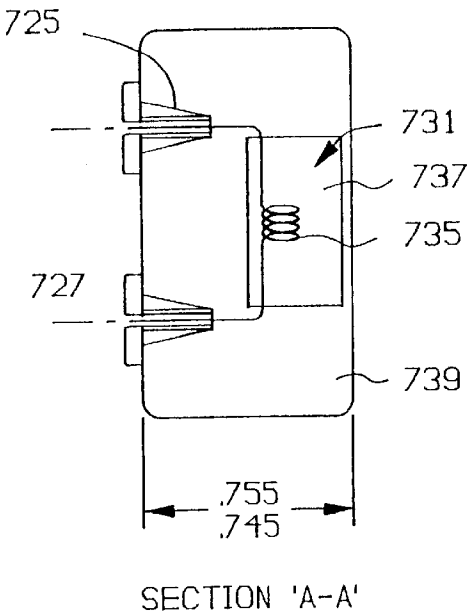
FIGS. 34 through 38 are longitudinal and cross section views of the gas generating end devices.

FIG. 33 is a longitudinal section view of a tool which can be utilized to house the sensors, electronics, and actuation mechanism, in accordance with the present invention. As is shown, actuator assembly 701 includes a sensor package assembly 703 which includes a central cavity 705 which communicates with the wellbore fluid through ports 709. The housing includes internal threads 707 at its upper end to allow connection in a completion string. Sensor 711 (such as a hydrophone) is located within cavity 705. Electrical wires from sensor 711 are directed through Kemlon connectors 719, 721 to allow passage of the electrical signal indicative of the acoustic tone to the analog and digital circuit components. The sensor package housing is coupled to an electronics housing by threaded coupling 713. Electronic housing 715 includes a sealed cavity 717 which carries the analog and digital circuit components described above. Both components are shown schematically as box 710 The electric conductors provide the output of the electronics sub assembly through Kemlon connectors 725, 727 to chamber 729 which includes an igniter member as well as the power charge material. Preferably, the igniter comprises an electrically-actuated heating element which is surrounded by a primary charge. The primary charge serves to ignite the secondary power charge. In FIG. 35, the igniter 731 is shown as communicating with sealed chamber 731, which preferably forms a stationary cylinder body which can be filled with gas as the power charge ignites. The gas can be utilized to drive a piston-type member, all of which will be discussed in detail further below.

Figure 34:
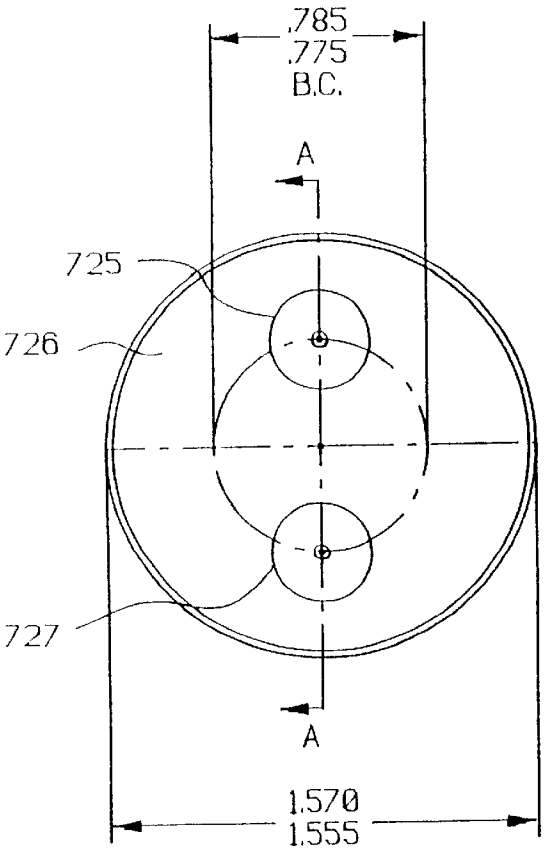

FIG. 34 is a cross sectional view of the assembly of FIG. 33 along section line C—C. As is shown, Kemlon connector 725, 727 are spaced apart in a central portion of a gas-impermeable plug 726. FIG. 35 is a longitudinal sectional view as seen along sectional line A—A of FIG. 34. As is shown, Kemlon connectors 725, 727 allow the passage of an electrical conductor into a sealed chamber. The electrical conductors are connected to firing mechanism 731 which includes electrically-actuated heating element 735 which is embedded in a primary charge 737. Heat generated by passing electricity through heating element 735 causes primary charge 737 to ignite. Primary charge 737 is completely surrounded by a secondary charge 739. Ignition of the primary charge 737 causes ignition of the secondary charge at 739. The resulting gas fills the sealed chamber which drives moveable mechanical components, such as pistons.

Figure 37:
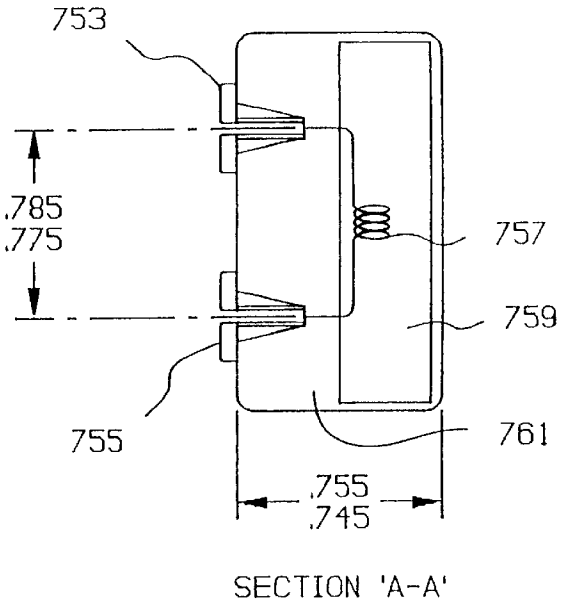
Figure 36:
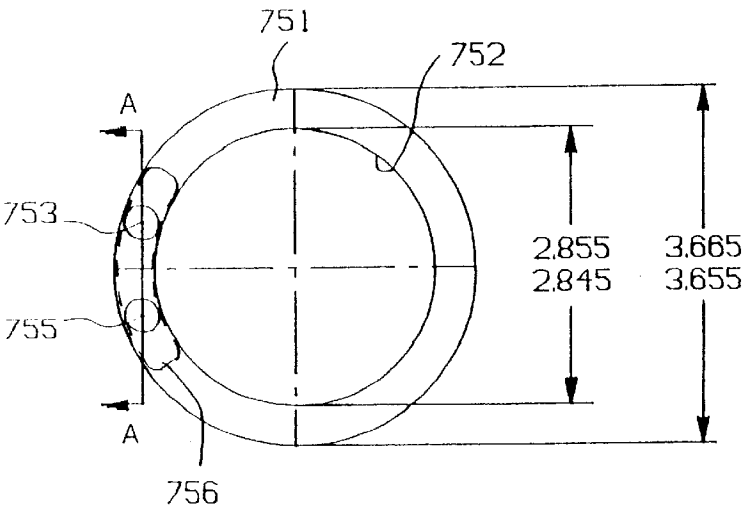

The housing depicted in FIGS. 32 and 33 are utilized by select firer 615 wherein a flow passage is not required. FIGS. 36 and 37 depict sectional views of the configuration of the actuator components when a central bore is required. In FIG. 36, completion string 751 as shown in cross-sectional view. Central bore 752 defined therein for the passage of fluids. Preferably, the sensor assembly, analog and digital electrical components and actuator assembly are carried in cavities defined within the walls of the completion string. FIG. 36 depicts the Kemlon connectors 753, 755, and the cavity 756 which is defined therein for tubular 751. FIG. 37 is a longitudinal sectional view seen along section line A—A of FIG. 35. As shown, Kemlon connectors 753, 755 allow the passage of electrical conductor into the sealed chamber. The electrical conductors communicate with heating element 757 which is completely embedded in primary charge 759 which is surrounded by secondary charge of 761. The passage of electrical current through heating element 757 causes primary charge 759 to ignite, which in turn ignites secondary charge 761. The gas produced by the ignition of this material can be utilized to drive a mechanical component, in a piston-like manner.

Figure 38:
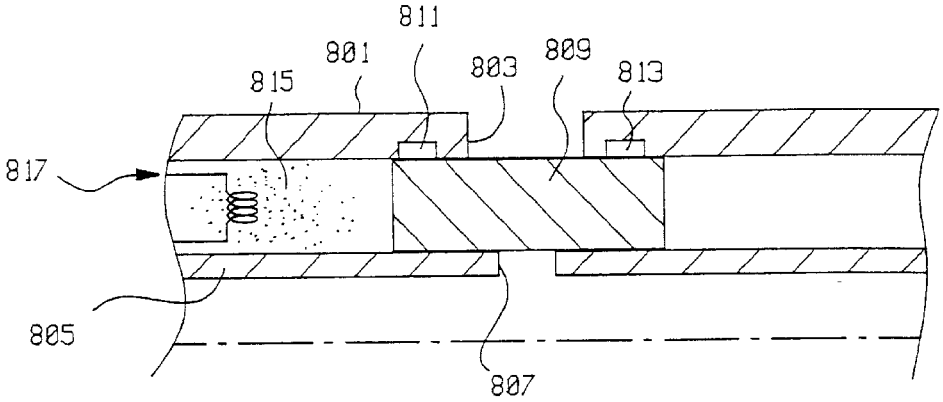
Figure 39:
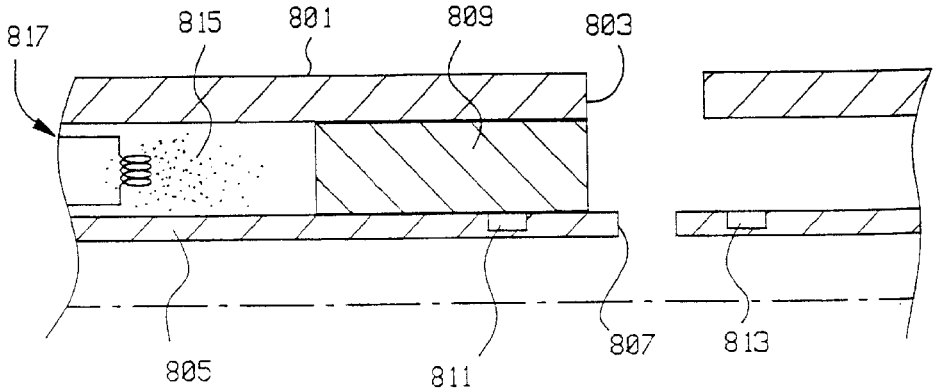
FIGS. 39 through 43 are simplified longitudinal views of exemplary end devices.

FIGS. 38 through 43 schematically depict utilization of a power charge to actuate various completion tools, including those completion tools shown schematically in FIG. 31. All of the valve components depicted schematically in FIG. 31 can be moved between open and closed conditions as is shown in FIGS. 38 and 39. FIG. 38 is a fragmentary longitudinal sectional view of a normally-closed valve assembly. As is shown, outer tubular 801 includes outer port 803 and inner tubular 805 includes inner port 807. Piston member 809 is located intermediate outer tubular 801 and inner tubular 805 in a position which blocks the flow of fluid between outer port 803 and inner port 307. Preferably, one or more seal glands, such as seal glands 811, 813 are provided to seal at the sliding interface of piston member 809 and the tubulars. Power charge 815 is maintained within a sealed cavity, and is electrically actuated by heating element 817. When an operator desires to move the valve from a normally-closed condition to an open condition, a coded signal is directed downward within the wellbore, causing the passage of electrical current through heating element 317, which generates gas which drives piston member 809 into a position which no longer blocks the passage of fluid between inner and outer ports 803, 807.

FIG. 39 is a fragmentary longitudinal sectional view of a normally-open valve. As is shown, outer tubular 801 includes outer port 803 and inner tubular 805 includes inner port 807. Piston member 809 is located intermediate outer tubular 801 and inner tubular 805 in a position which does not block the flow of fluid between outer port 803 and inner port 807. Preferably, one or more sealed glands, such as seal glands 811, 813 are provided to seal at the sliding interface of piston member 809 and the tubulars. Power charge 815 is maintained within a sealed cavity, and is electrically actuated by heating element 817. When an operator desires to move the valve from a normally-open condition to a close condition, a coded signal is directed downward within the wellbore, causing the passage of electrical current through heating element 817, which generates gas which drives piston member 809 into a position which then blocks the passage of fluid between inner and outer ports 803, 807.

Figure 40:
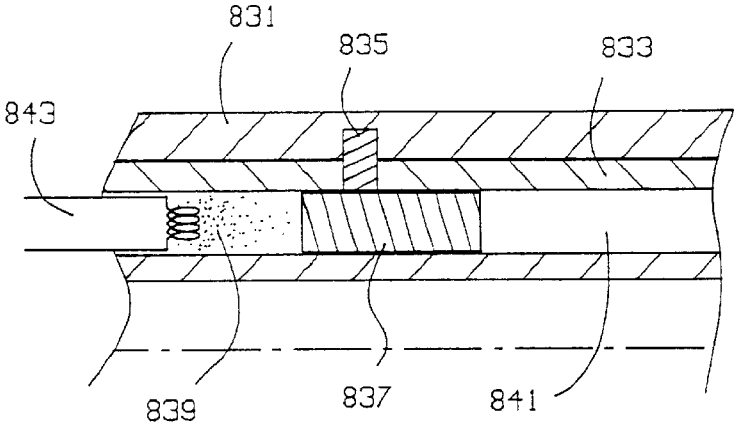

FIG. 40 is a simplified and fragmentary longitudinal sectional view of a safety joint which utilizes the present invention. As is shown, tubular 831 and tubular 833 are physically connected by locking dog 835. Locking dog 835 is held in position by piston member 837. When the operator desires to release tubular 831 from tubular 833, a coded signal is directed downward into the wellbore. Upon detection, currents pass through heating element 843 which ignites power charge 839 within a sealed chamber, causing displacement of piston 837. Displacement of piston 837 allows locking dog 835 to move, thus allowing separation of tubular 831 from tubular 833.

Figure 41:
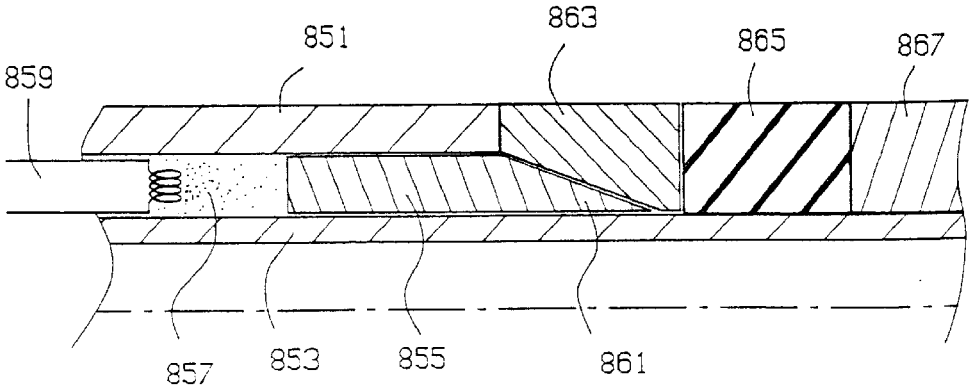

FIG. 41 is a simplified longitudinal sectional view of a packer which may be set in accordance with the present invention. As is shown, piston member 855 is located between outer tubular 851 and inner tubular 853. One end of piston 855 is in contact with a sealed chamber which contains power charge 857. Heating element 859 is utilized to ignite power charge 857, once a valid command has been received. The other end of piston member 855 is a slip 861 which engages slip 863. Together, slips 861, 863 serve to energize and expand radially outward elastomer sleeve 865 which may be buttressed at the other end by buttress member 867.

Figure 42:
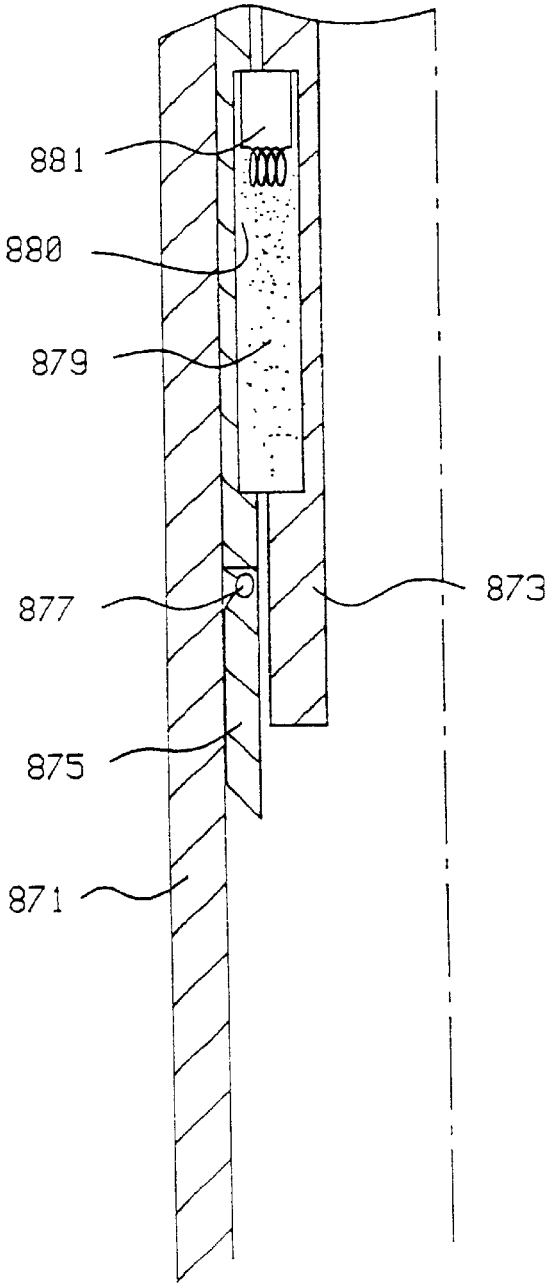

FIG. 42 is a simplified and schematic partial longitudinal depiction of a flapper valve assembly. As is shown, a flapper valve 875 is located intermediate outer tubular 871 and inner tubular 873. As is shown, flapper valve 875 is retained in a normally-open position by inner tubular 873. Spring 877 operates to bias flapper valve 875 outward to obstruct the flowpath of a completion string. A sealed chamber 880 is provided which is partially filled with a power charge 879 which may be ignited by heating element 881. Differential areas may be utilized to urge inner tubular 873 upward when power charge is ignited. Movement of inner tubular 873 upward will allow spring 877 to bias flapper valve 875 outward into an obstructing position. In accordance with the present invention, when an operator desires to move normally-open flapper valve to a closed position, the command signal associated with particular flapper valve is communicated into the wellbore, and received by the acoustic tone receiver. If the command signal matches the preprogrammed code, an electrical current is passed through heating element 881, causing displacement of inner tubular 873, and the outward movement of flapper valve 875.

Figure 43:
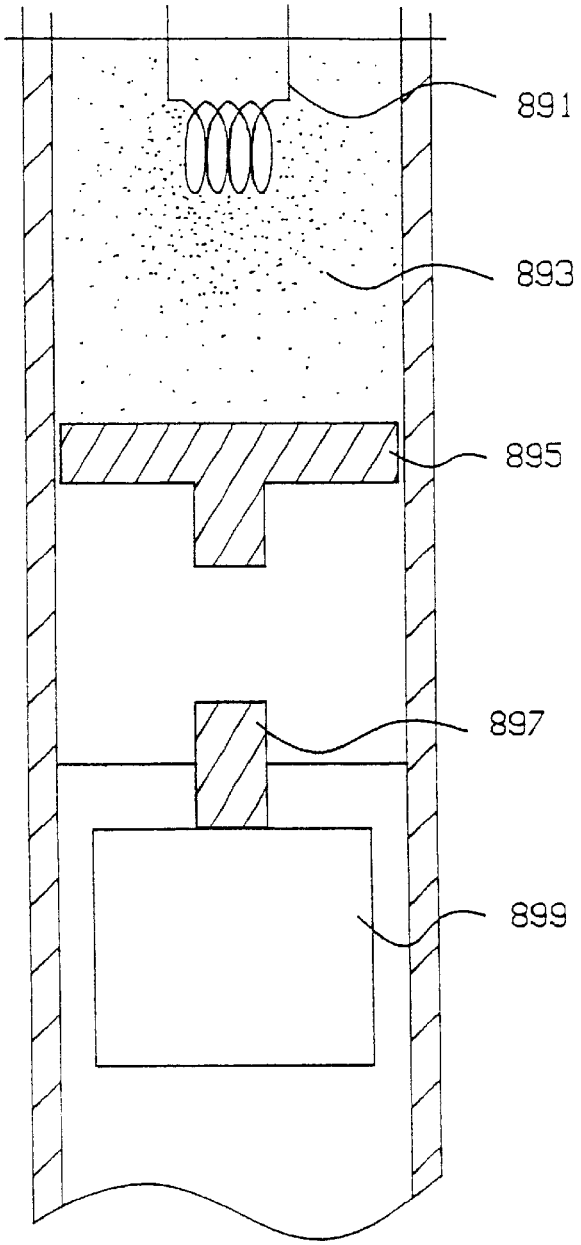

FIG. 43 is simplified and schematic depiction of the operation of the firing system for tubing conveyed perforating guns. As is shown, the passing of electrical current through heating element 891 causes the ignition of power charge 893 within a sealed chamber which generates gas which drives firing pin 895 into physical contact with a percussive firing pin 897 which serves to actuate perforating gun 899.

6. Logging During Completions

An alternative embodiment of the present invention will now be described which utilizes an acoustic actuation signal sent from a remote location (typically, a surface location) to a subsurface location which is associated with a particular completion or drill stem testing tool. The coded signal is received by any conventional or novel acoustic signal reception apparatus, including the reception devices discussed above, but preferably utilizing a hydrophone. The acoustic transmission is decoded and, if it matches a particular tool located within the completion and drill stem testing string, a power charge is ignited, causing actuation of the tool, such as switching the tool between mechanical conditions such as set or unset conditions, open or closed conditions, and the like.

In accordance with the present invention, particular ones (and sometimes all) of the mechanic devices located within the completion and drill stem testing string are also equipped with a transmitter device which may be utilized to transmit information, such as data and commands, from a particular tool to a remote location, such as a surface location where the data may be recovered, recorded, and interpreted. In accordance with the present invention, the acoustic tone generator is utilized for transmitting information (such as data and commands) away from the tool. In the preferred embodiment of the present invention, the acoustic tone generator need not necessarily utilize its ability to adapt the communication frequencies to the particular communication channels, since that particular feature may not be necessary.

In accordance with the present invention, a processor is provided within the downhole tools in order to process a variety of sensor data inputs. In the preferred embodiment of the present invention, the sensor inputs include: (1) a measure of the noise generated by fluid as it is produced through perforations in the wellbore tubulars; (2) downhole temperature; (3) downhole pressure; and (4) wellbore fluid flow. In the preferred embodiment of the present invention, the downhole noise that is measured is subjected to a Fourier (or other) transform into the frequency domain. The frequency domain components are analyzed in order to determine: (1) whether or not flow is occurring at that particular time interval, or (2) the likely rate of flow of wellbore fluids, if flow is detected.

In the preferred embodiment of the present invention, a redundancy is provided for the sensors, the processors, the receivers, and the transmitters provided in the various tools in the completion and drill stem testing string. This is especially important since, during perforating operations, significant explosions occur which may damage or impair the operation of the various sensors, processors, and communication devices.

In the preferred embodiment of the present invention, the downhole processors are utilized to monitor sensor data and actuate one or more subsurface valves in a predetermined and programmed manner in order to perform drill stem test operations. Such operations occur after the casing has been perforated. The operating steps include:

(1) utilizing an acoustic sensor (such as the hydrophone) in order to determine whether or not a wellbore flow has commenced;

(2) utilizing the controller to actuate the one or more valves which allow communication of fluid between an adjacent zone and the completion string;

(3) allowing wellbore fluid buildup for a predetermined interval;

(4) all the while, sensing temperature and pressure of the wellbore fluid;

(5) opening the valves to allow flow;

(6) monitoring temperature, pressure, flow, and the subsurface acoustic noise in order to generate data pertaining to the production;

(7) intermittently communicating data to the surface pertaining to the drill stem test; and (8) recording raw and processed data in memory for either retrieval with the string or transmission to the surface utilizing acoustic signals or through a wireline conveyed data recorder/retriever.

These and other objectives and advantages will be readily apparent with the reference to FIGS. 44A through 51.

Figure 44A:
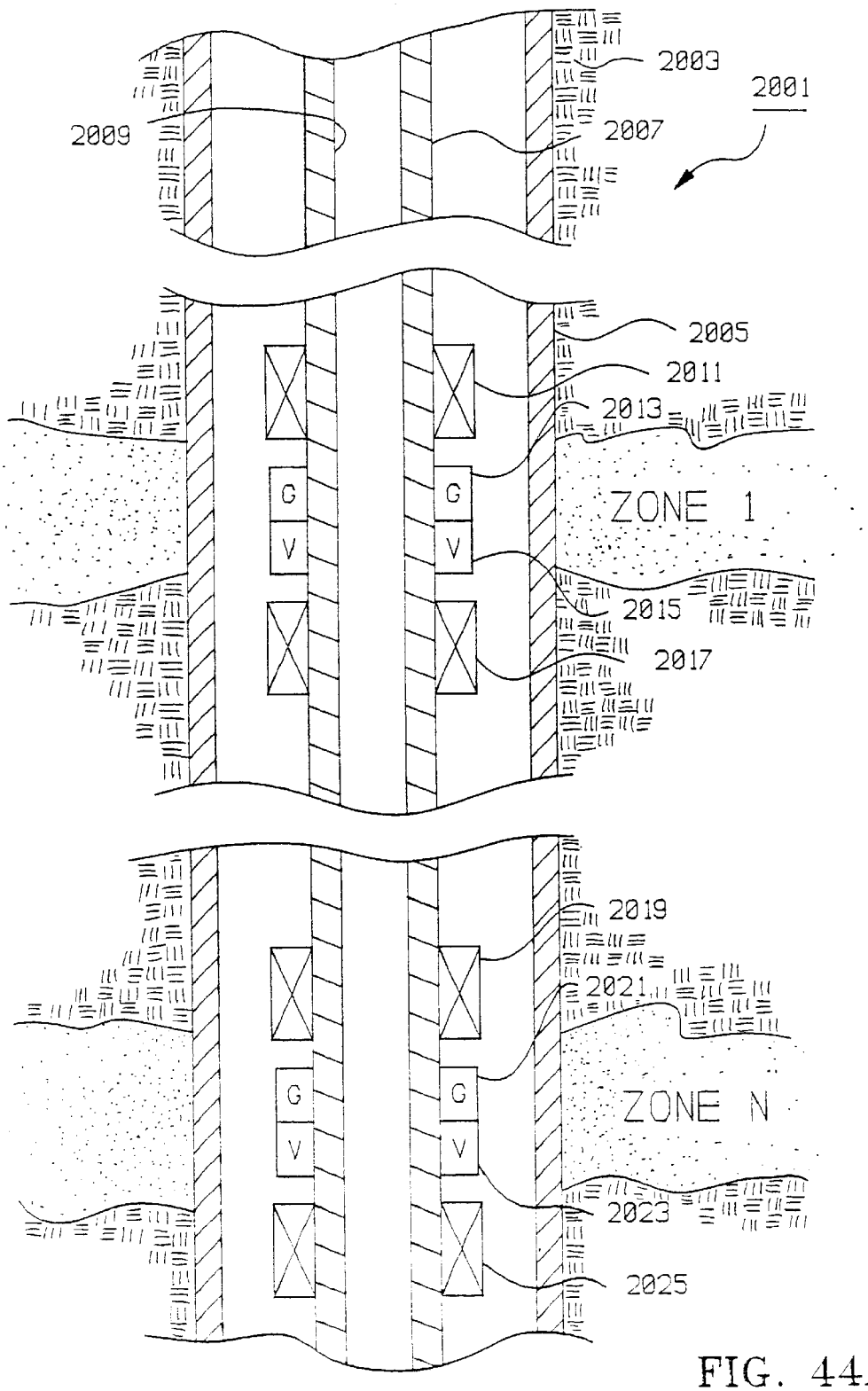
FIG. 44A is a pictorial representation of the utilization of the present invention during completion and drill stem testing operations.

FIG. 44A is a pictorial representation of wellbore 2001 which extends through formation 2003, and which utilizes casing string 2005 to prevent the collapse or deterioration of the wellbore. Completion string 2007 extends downward through casing 2005. A central bore 2009 is defined within completion string 2007. Completion string 2007 serves several functions. First, it serves to carry completion tools from a surface location to a subsurface location, and allows for the positioning of the completion tools adjacent particular zones of interest, such as Zone 1 and Zone N which are depicted in FIG. 46A. Second, completion string 2007 is utilized for the passing of fluids downward from a surface location to a subsurface location (such as a formation of interest) during the completion operations, as well as to allow for the passage upward of wellbore fluids through central bore 2009 and/or the annular space during and after drill stem test operations. In the view of FIG. 44A, completion string 2007 is shown as locating completion tools adjacent Zone 1 and Zone N. The tools carried adjacent Zone 1 include upper packer 2011, perforating gun 2013, valve 2015, and lower packer 2017. Likewise, completion string 2007 locates other completion tools adjacent Zone N, including upper packer 2019, perforating gun 2021, valve 2023, and lower packer 2025. During completion and drill stem test operations, the upper and lower packers are utilized to seal the region between tubing string 2007 and casing string 2005. The perforating guns 2013, 2021 are then fired to perforate the adjacent casing and allow for the passage of wellbore fluid from the formation 2003 into wellbore 2001. The valves 2015, 2023 are provided to selectively allow for the passage of fluids between central bore 2009 of completion string 2007 and the zones of interest (such as Zone 1 and Zone N).

Figure 44B:
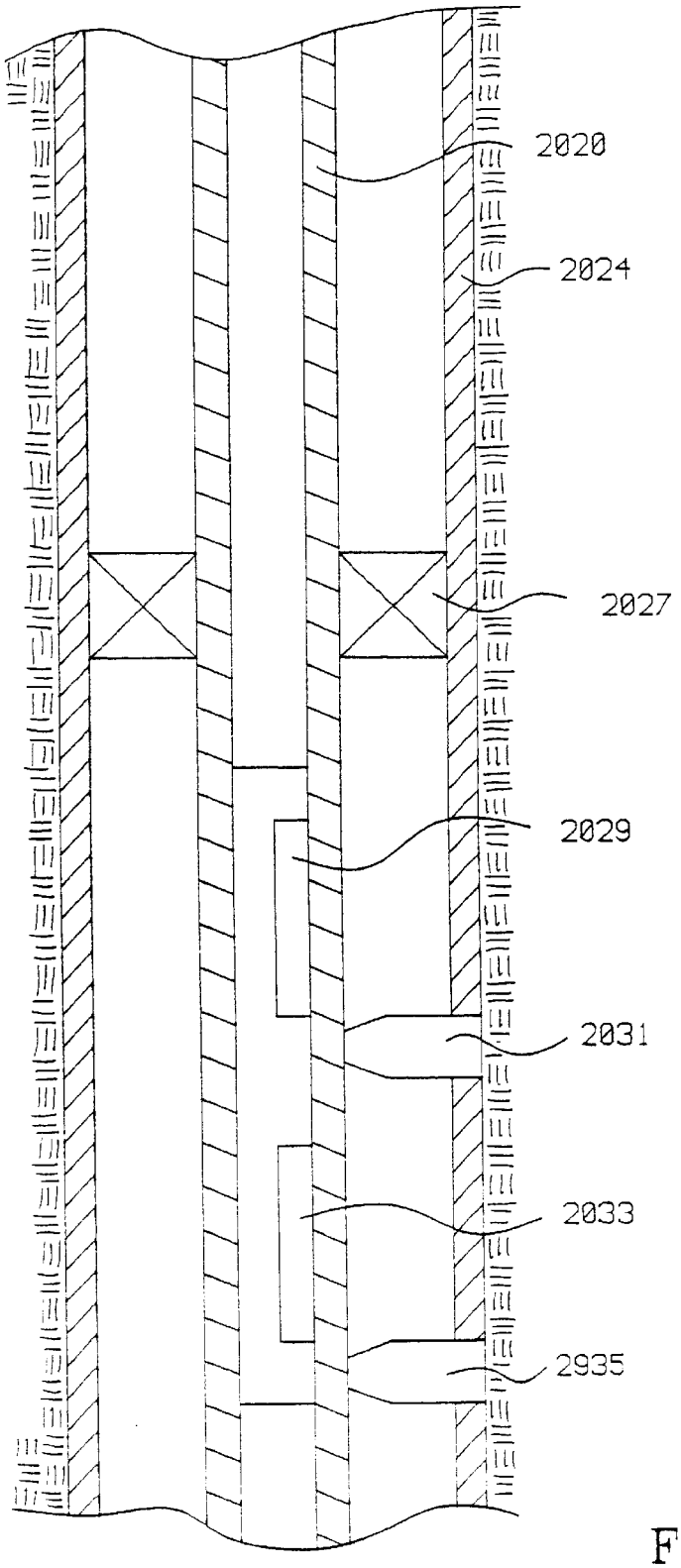
FIG. 44B is another pictorial representation of the utilization of the present invention during completion and drill stem testing operations.

In the view of FIG. 44A, upper and lower packers are utilized to straddle a relatively narrow geological formation of interest. FIG. 44B depicts an alternative configuration which may be utilized with the present invention, which does not utilize packers to straddle the formation. As in shown in FIG. 44B, completion string 2020 is shown as being packed off against casing 2024 by packer 2027, which forms a fluid and gas tight seal, which prevents the flow or migration of wellbore fluids upward through the annular region between completion string 2020 and casing 2024. Two perforating gun assemblies are located beneath packer 2027. In accordance with the present invention, each is equipped with control and monitoring electronics.

As is shown in FIG. 44B, perforating gun 2031 has associated with it control and monitoring electronics 2029. In the view of FIG. 44B, perforating gun 2031 is depicted as it blasts perforations through casing 2024. Likewise, perforating gun 2035 has associated with it control and monitoring electronics 2033. Perforating gun 2035 is likewise shown as it blasts perforations through casing 2024. As discussed above in detail, in accordance with the present invention, each of these perforating guns is responsive to a different, acoustically transmitted actuation signal which is communicated from a surface location (preferably, but not necessarily) through the wellbore fluid and tubulars. When the control and monitoring electronics 2029, 2033 detect a "match", an ignition is triggered which causes the perforation of casing 2024.

Figure 45A:
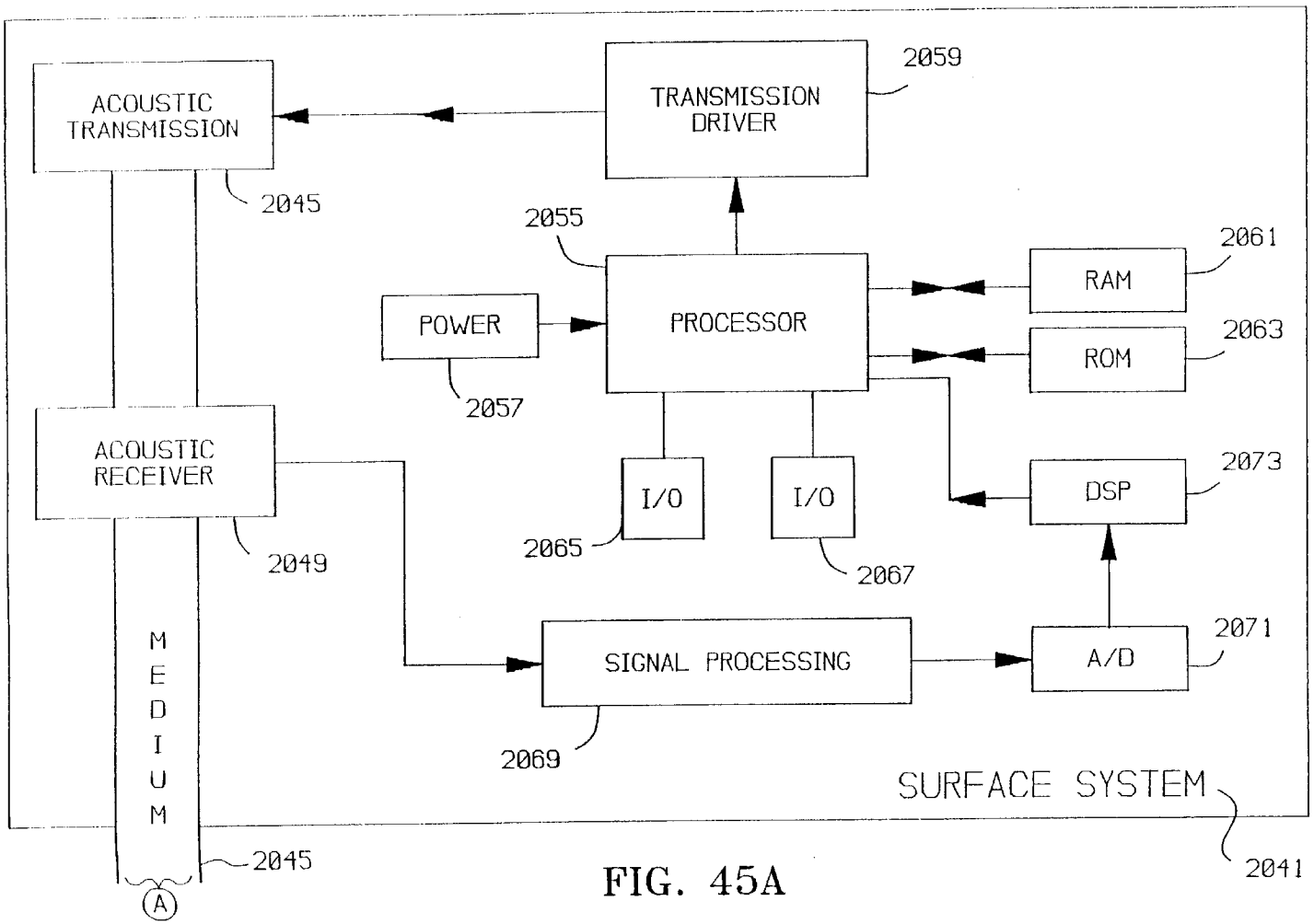
FIG. 45 is a block diagram representation of the surface and subsurface systems utilized in the present invention during completion and drill stem testing operations.
Figure 45B:
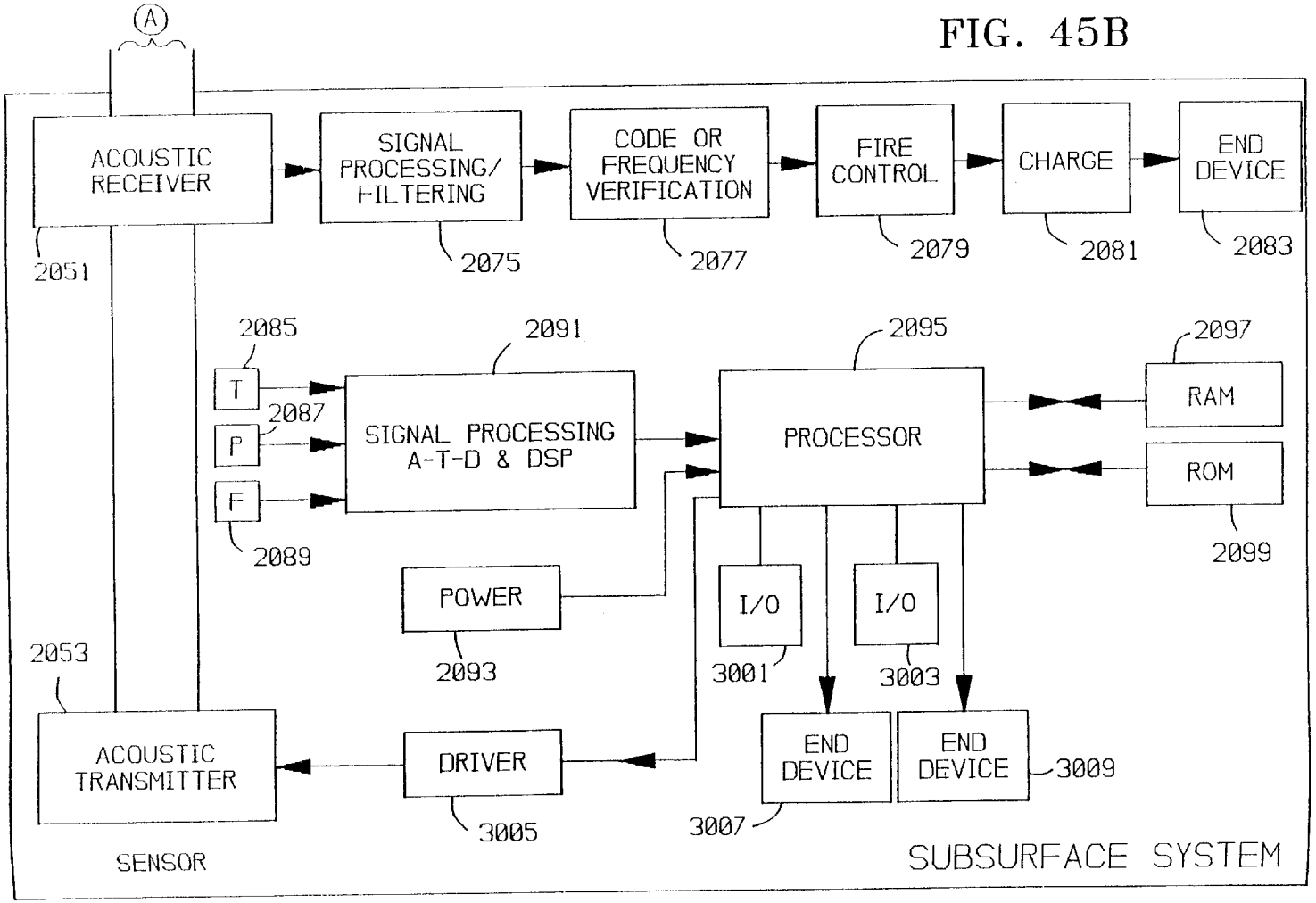
Figure 46:
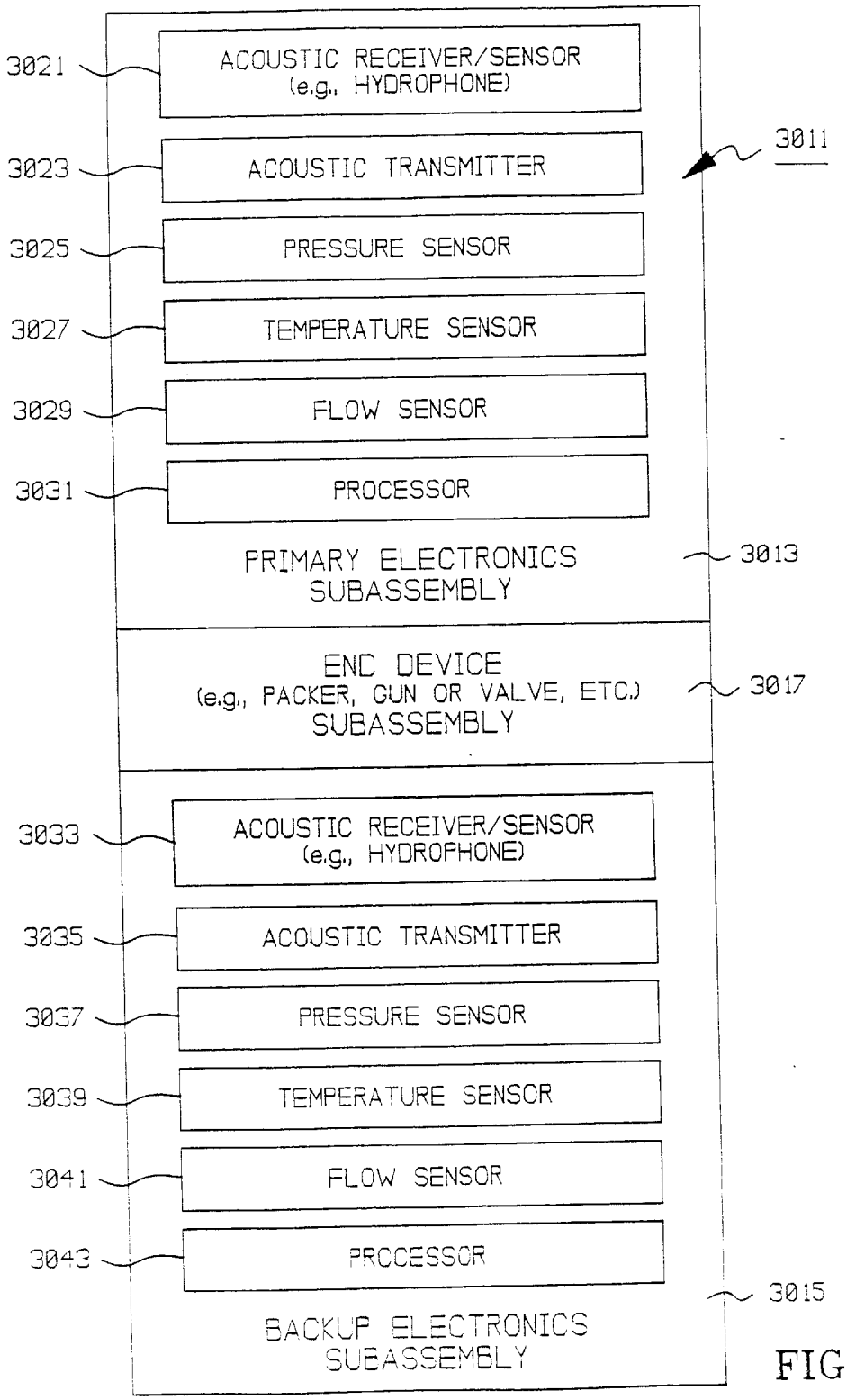
FIG. 46 is a block diagram representation of one particular embodiment of the present invention which includes redundancy in the electronic and processing components in order to increase system reliability.

FIG. 45 is a block diagram depiction of the surface and subsurface electronics and processing utilized in the preferred embodiment of the present invention. As is shown, a surface system 2041 communicates through a medium 2045 (such as a column of wellbore fluid, a wellbore tubular string, or a combination since the acoustic signal may migrate between fluid and tubular pathways within the wellbore or, alternatively, transmission may occur through the formations between the surface location and the subsurface location). As is shown, surface system 2041 includes an acoustic transmitter 2047 and an acoustic receiver 2049, which are both acoustically coupled to transmission medium 2045. The subsurface system 2043 includes an acoustic receiver 2051 and an acoustic transmitter 2053 which are likewise acoustically coupled to transmission medium 2045. The acoustic transmitters and receivers may comprise any of the above described transmitters or receivers, or any other conventional or novel acoustic transmitters or receivers.

The subsurface system 2041 will now be described with reference to FIG. 45. As is shown, processor 2055 (and the other power consuming components) receives power from power source 2057. Processor 2055 is programmed to actuate transmitter driver 2059, which in turn actuates acoustic transmitter 2047. Processor 2055 may comprise any conventional processor or industrial controller; however, in the preferred embodiment of the present invention, processor 2055 is a processor suitable for use in a general purpose data processing device. Processor 2055 utilizes random access memory 2061 to record data and program instructions during data processing operations. Processor 2055 utilizes read-only memory 2063 to read program instructions. Processor 2055 may display or print data and receive data, commands, and user instructions through input/output devices 2065, 2067, which may comprise video displays, printers, keyboard input devices, and graphical pointing devices.

In operation, processor 2055 utilizes transmitter driver 2059 to actuate acoustic transmitter 2047 in accordance with program instructions maintained in RAM 2061, ROM 2063, as well as commands received from the operator through input/output devices 2065, 2067.

Acoustic receiver 2049 is adapted to detect acoustic transmissions passing through transmission medium 2045. The output of acoustic receiver 2049 is provided to signal processing 2069 where the signal is conditioned. The analog signal is passed to analog-to-digital device 2071, where the analog signal is digitized. The digitized data may be passed through digital signal processor 2073 which may provide one or more buffers for recording data. The data may then pass from digital signal processor 2073 to processor 2055.

In the present invention, it is not necessary that acoustic transmitter 2047 and acoustic receiver 2049 transmit and/or detect the same type of acoustic signals. In the preferred embodiment of the present invention, the acoustic receiver 2049 is preferably of the type described above as an "acoustic tone generator", in order to accommodate relatively large amounts of data which may be passed from the subsurface system 2043 to the surface system 2041 for recordation and analysis. The acoustic transmitter 2047 is solely utilized to transmit relatively simple commands, or other information such as analysis parameters for downhole use during analysis and/or processing, into the wellbore, and thus need not generally accommodate large data rates. Accordingly, the acoustic transmitter 2047 may comprise one of the relatively simple transmission technologies discussed above, such as the positive pressure pulse apparatus.

The preferred subsurface system 2043 will now be described with reference to FIG. 45. As is shown, acoustic receiver 2051 is acoustically coupled to communication medium 2045. Acoustic signals which are transmitted from surface system 2041 are detected by acoustic receiver 2051 and passed to signal processing and filtering unit 2075, where the signal is conditioned. The signal is then passed to code or frequency verification module 2077, which operates in the manner discussed above. If there is a match between the code associated with the particular subsurface system 2043 and the detected acoustic transmission, then fire control module 2079 is actuated, which initiates charge 2081, which is utilized to mechanically actuate end device 2083. All of the foregoing has been discussed above in great detail.

In this particular and preferred embodiment of the present invention, acoustic receiver 2051 serves a dual function: first, it is utilized to detect coded actuation commands which are processed as described above; second, it is utilized as an acoustic listening device which passes wellbore "noise" for processing and analysis. As is shown, a variety of inputs are provided to signal processing/analog-to-digital and digital signal processing block 2091, including: the output of acoustic receiver 2051, the output of temperature sensor 2085, the output of pressure sensor 2087, and the output of flow meter 2089. All of the sensor data is provided as an input to processor 2095 which is powered by power supply 2093 (as are all the other power-consuming electrical components). Processor 2095 is any suitable microprocessor or industrial controller which may be pre-programmed with executable instructions which may be carried in either or both of random access memory 2097 and read-only memory 2099. Additionally, processor 2095 may communicate through input/output devices 3001, 3003, in a conventional manner, such as through a video display, keyboard input, or graphical pointing device. In accordance with the present invention, processor 2095 is not equipped with such displays and input devices in its normal use but, during laboratory use and testing, keyboards, video displays, and graphical pointing devices may be connected to processor 2095 to facilitate programming and testing operations. In accordance with the present invention, processor 2095 is connected to one or more end devices, such as end device 3007 and end device 3009. During drill stem test operations, end devices 3007, 3009 preferably comprise the valves which are utilized to check or allow the flow of fluids between the formation and the wellbore. The use of valves during drill stem test operations will be described in greater detail below. As is shown in FIG. 45, processor 2095 is connected through driver 3005 to acoustic transmitter 2053. In this manner, processor 2095 may communicate data or commands to any surface or subsurface location. For example, processor 2095 may be programmed with instructions which require processor 2095 to generate an actuation command for another wellbore end device, once a predetermined wellbore condition has been detected. As another example, processor 2095 may be programmed with instructions which require processor 2095 to utilize acoustic transmitter 2053 to communicate processed or raw data from a subterranean location to a remote location, such as a surface location, to allow recordation and analysis of the data.

The present invention is contemplated for use during completion operations. Consequently, the downhole electronics and processing components are exposed to high temperatures, high pressures, high velocity fluid flows, corrosive fluids, and abrasive particulate matter. Additionally, those components are also subject to intense shock waves and pressure surges associated with perforating operations. While many electrical and electronic components have been ruggedized to withstand hostile environments, during completion operations, the risk of failure is not negligible. Accordingly, in accordance with the present invention, a "redundancy" in the electrical and electronic components is provided in order to minimize the possibility of a tool failure which would require an abortion of the completion operations and retrieval of the equipment. This redundancy is depicted in block diagram form in FIG. 46. As is shown, "module" 3011 is made up of primary electronics subassembly 3113, backup electronics subassembly 3015, and end device of assembly 3017. Preferably, end device 3017 comprises any conventional or novel end device, such as a packer, perforating gun or valve. As is shown, primary electronics subassembly 3113 includes acoustic receiver/sensor 3021, acoustic transmitter 3023, pressure sensor 3025, temperature sensor 3027, flow sensor 3029, and processor 3031. Backup electronic subassembly 3015 includes acoustic receiver/sensor 3033, acoustic transmitter 3035, pressure sensor 3037, temperature sensor 3039, flow sensor 3041, and processor 3043. The redundant system can operate under any of a number of conventional or available redundancy methodologies. For example, the primary electronic subassembly 3113 and the backup electronic subassembly 3015 may operate simultaneously during completion and drill stem test operations. In this manner, each processor can check and compare measurements and calculations at each critical step of processing in order to determine a measure of the operating condition of each subassembly. Alternatively, one subassembly (such as the primary electronic subassembly 3113) may be utilized solely until it is determined by processor 3113, or by the human operators at the surface location, that primary electronic subassembly 3113 is no longer operating properly; in that event, a command may be directed from the surface location to the subsurface location, activating backup electronic subassembly 3115 which can replace primary electronic subassembly 3113. It should be appreciated that any selected number of redundant or backup electronic subassemblies may be provided with each tool in order to provide greater assurance of the operational integrity of the completion and drill stem testing tools.

Figure 47A:
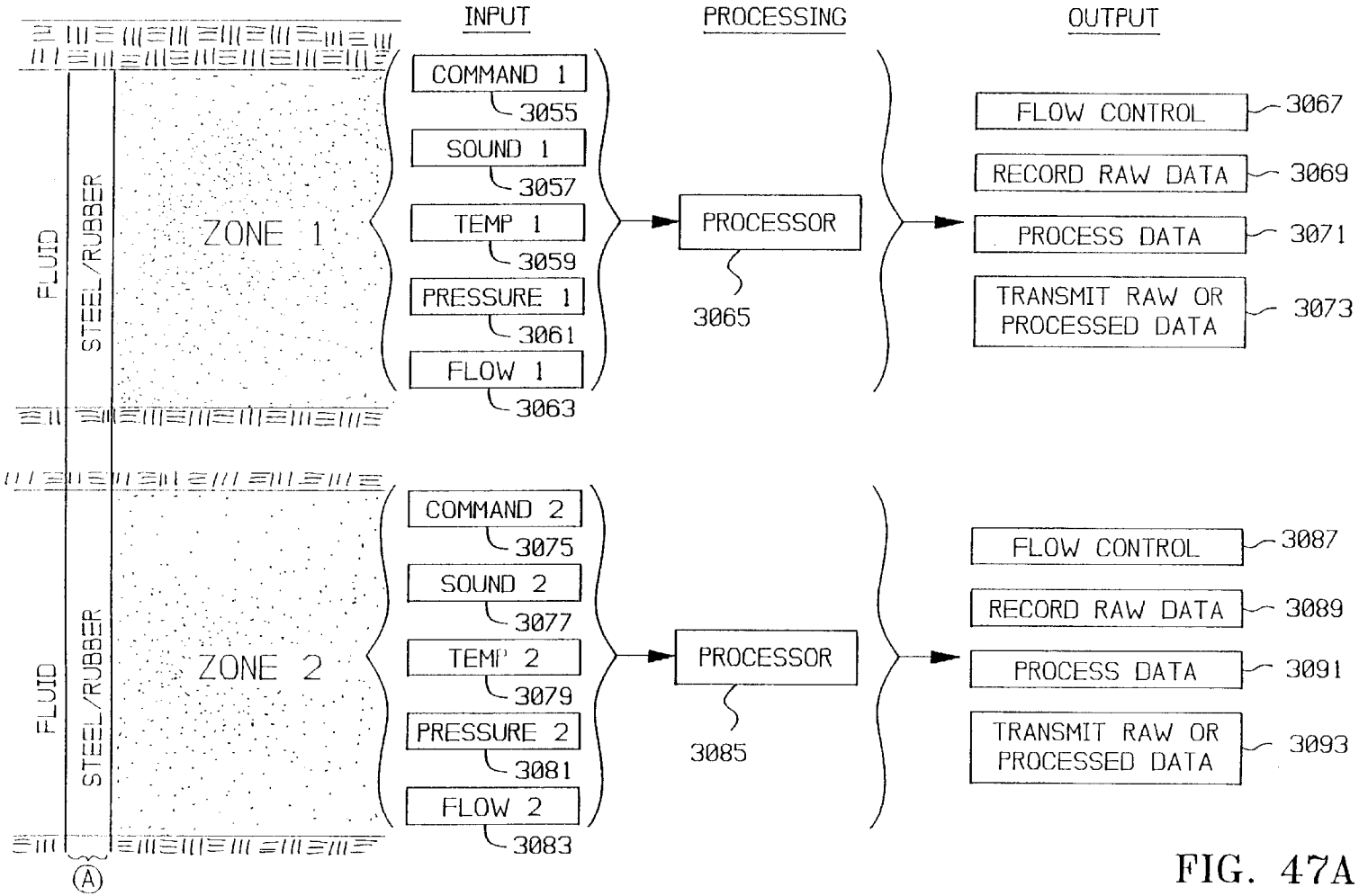
FIG. 47 is a data flow representation of utilization of the present invention during completion and drill stem testing operations.
Figure 47B:
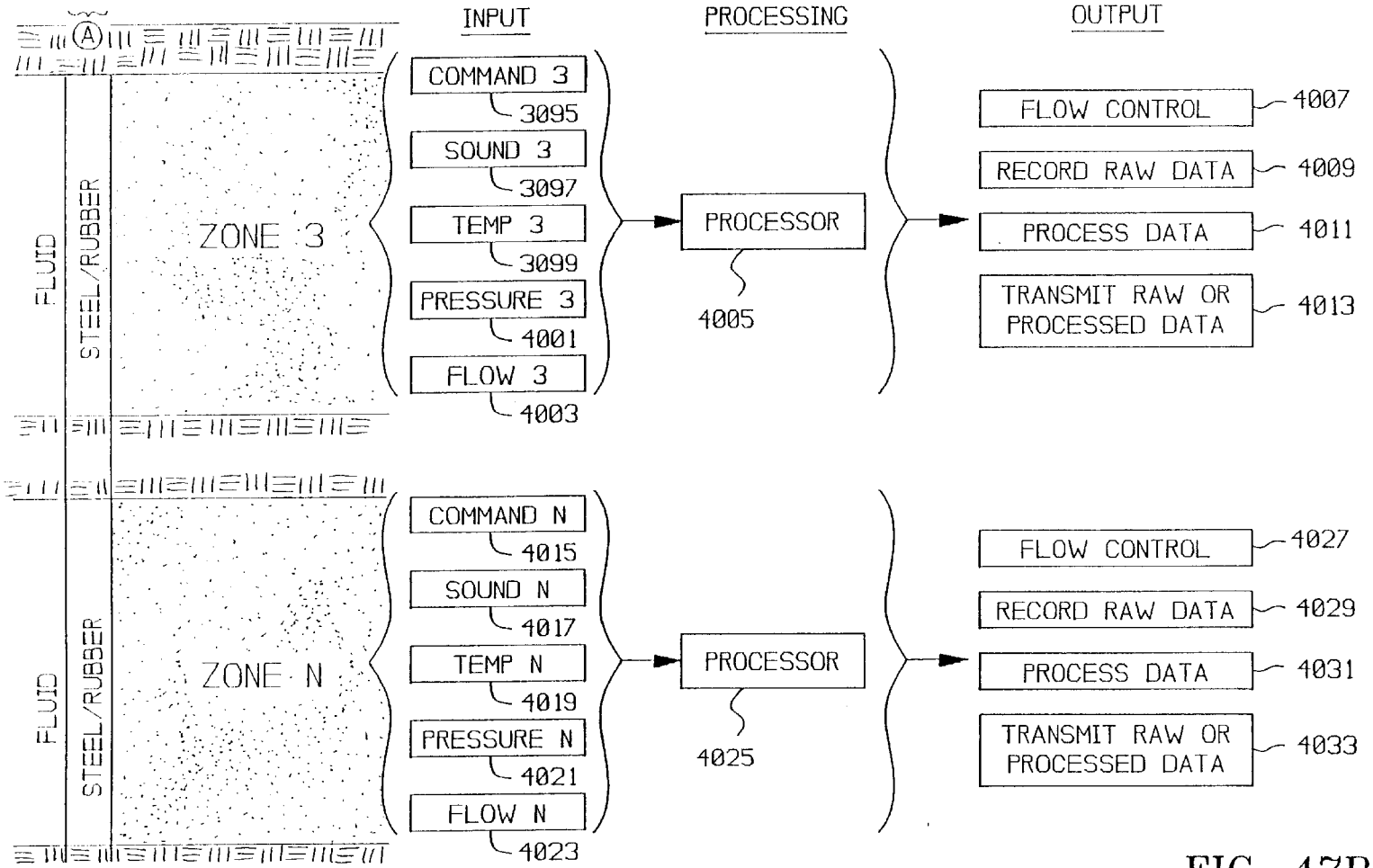

The basic operation of the improved completion system of the present invention will now be described with reference to FIG. 47. As is shown, potential communication channels composed of steel and/or rubber 3055 and fluid 3053 extend through Zone 1, Zone 2, Zone 3, and Zone N. Within Zone 1, processor 3065 is responsive to input in the form of commands 3055 which are received from a surface or subsurface location, detected sound 3057, detected temperature 3059, detected pressure 3061, and detected flow 3063. Processor 3065 is preprogrammed with executable program instructions which require the processor to receive the input and perform particular predefined operations. In the view of FIG. 47, some exemplary output activities are depicted, such as flow control 3067, record raw data 3069, process data 3071, and transmit raw or processed data 3073. In accordance with the flow control 3067, processor 3065 may be utilized to open and/or close a particular valve or valves associated with processor 3065 in order to permit, block, or moderate the flow of fluids between the completion string and the wellbore. This is particularly useful during drill stem test operations, wherein flow is blocked for a predefined interval, and pressures are recorded in order to evaluate the adjoining producing formation. Processor 3065 may utilize electrically actuable tool control means for moving the valve or valves between flow positions or conditions. The step of "record raw data" 3069 serves multiple purposes. First, the raw data may be preserved for later processing and analysis by a microprocessor 3065. Alternatively, the raw data may be preserved in memory for eventual retrieval, by either physical removal of the completion string or transfer of the data by any conventional wireline or other data recording devices. The step of "process data" 3071 contemplates a variety of data processing activities, such as generating historical records of high and low values for temperature, pressure, and flow, generating rolling averages of values for temperature, pressure, and flow, or any other conventional or novel manipulation of the censored data. Alternatively, the process data step 3071 may include local control by processor 3065 of the end devices in order to moderate the flow of wellbore fluids in accordance with predetermined flow criteria, such as particular flow volumes or flow velocities. For example, processor 3065 may monitor wellbore temperatures and pressures, and open or close end devices to moderate the flow in accordance with a predetermined flow value associated with particular temperatures and pressures. The step of transmit raw or processed data 3073 comprises the passing through acoustic transmissions of either raw or processed data from processor 3065 to any other surface or subsurface location.

As is also shown in FIG. 47, processor 3085 receives as an input detected commands 3007, detected sounds 3077, detected temperatures 3079, detected pressures 3081, and detected flows 3083. Processor 3085 operates like processor 3065 to provide any of the following outputs or perform any of the following tasks: flow control 3087, record raw data 3089, process data 3091, and transmit raw or processed data 3093. Processor 3085 is associated with Zone 2, and the sensed data that it receives relates to Zone 2, which may not be connected to Zone 1 except through the wellbore.

Likewise, processor 4005 is associated with Zone 3, and receives as input sensed commands 3095, sensed sound 3097, sensed temperature 3099, sensed pressure 4001, and sensed flow 3003. Processor 4005 may obtain any number of the following outputs or perform any of the following tasks: flow control 4007, record raw data 4009, process data 4011, and transmit raw or processed data 4013.

Zone N is a zone that is isolated from Zones 1, 2 and 3. As with the other zones, Zone N may receive or transmit acoustic signals through either the fluid or the steel and rubber which comprise conventional completion strings. Processor 4025 receives as an input detected commands 4015, detected sound 4017, detected temperatures 4019, detected pressures 4021, and detected flow 4023. Processor 4025 may provide any one of the following outputs: flow control 4026, record raw data 4029, process data 4031, and transmit raw or processed data 4033.

It should be apparent from the foregoing that the present invention allows for local processing and control of each zone either independently of one another or in a coordinated fashion, since each zone can communicate data or commands through the transmission and reception of acoustic signals through either the formation itself, the wellbore fluids, or the wellbore tubulars, such as the completion string and/or casing. Additionally, the activities of the various processors can be monitored and controlled from a surface location by either an automated system or by a human operator.

Figure 48:
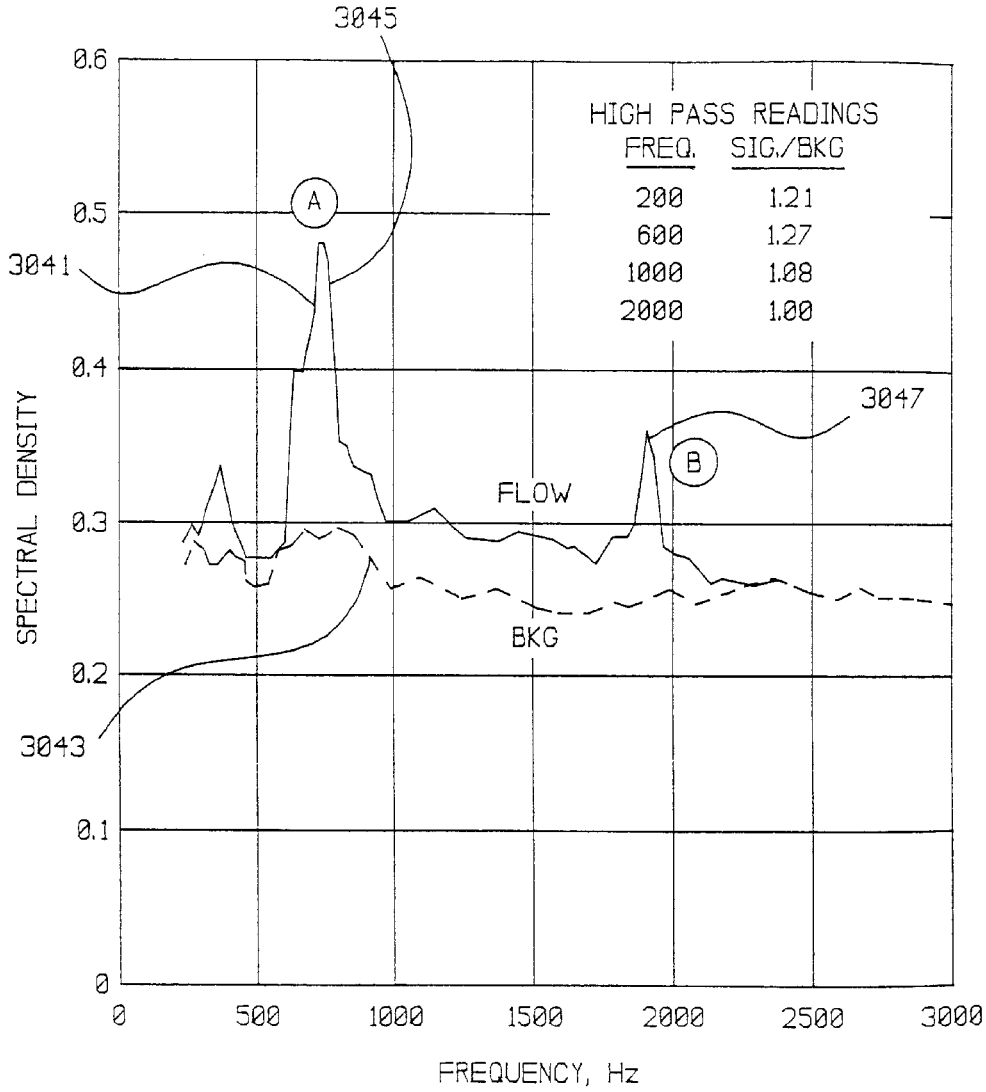
FIG. 48 is a graphical representation of a frequency domain plot of wellbore acoustics, which demonstrates that acoustic devices can be utilized to monitor the flow of fluids into the wellbore.

The use of an acoustic receiver or sensing device to monitor subterranean sounds or noise will now be discussed in detail. In the prior art, logging sondes have been lowered into wells in order to monitor subterranean sounds in order to determine one or more attributes about the wellbore. Typically, the sondes include a receiver which travels upward and downward within the wellbore on the wireline, mapping detected sounds (and temperature) with wellbore depth. This process is described in an article entitled "*Temperature and Noise Logging for Non-Injection Related Fluid Movement*" by R. M. McKinley of Exxon Production Research Company of Houston, Tex. 77252-2189. This logging technique is premised upon the realization that fluid flow, particularly fluid expansion through constrictions, such as perforations, creates audible sounds that are easily distinguishable from the background noise. FIG. 48 is a graphical plot of frequency in hertz versus the spectral density of a Fourier transform of noise monitored in a test well versus the spectral density of the noise. This graph is a test result from the McKinley article. As is shown, the acoustic sound or noise detected from flow is represented in this graph by the solid line 3041. Note that the sounds associated with the flow are significant in comparison with the background noise which is depicted by the dashed line 3043. The detected noise associated with the flow has two significant peaks: peak 3045 and peak 3047. In the McKinley article it was determined that peak 3045 (also labeled with "A") corresponds to the chamber resonance whose amplitude and frequency depend upon the environment. McKinley also concluded that the second peak 3047 (also identified by "B") corresponds to the fluid turbulence which has an amplitude that is dependent upon the rate of flow.

In accordance with the present invention, in a test environment, a variety of wellbore geometries and flow rates are monitored and recorded in order to determine the spectral profile associated with different geometries and different flow rates. Additionally, the same testing can be conducted, using different types of fluids (that is with different compositions, densities, and suspended particulate matter).

A data base of these different profiles can be amassed and stored in computer memory. Before the completion string is run to the wellbore, the operator selects the spectral profile or profiles which more likely match the particular completion job which is about to be performed. The processors are programmed to perform Fourier transforms on detected noise at particular predefined intervals during the completion operation. The transformed detected data may be compared with one or more spectral profiles that are likely to be encountered in the particular completion job. Based upon the library of spectral profiles and the sensed data, the downhole processors can determine the likely fluid velocity of fluid entering the wellbore through the perforations. This information may be recorded in memory or processed and transmitted to the surface utilizing acoustic transmissions.

This noise data can provide a reliable confirmation that good perforations have been obtained in the zone or zones of interest. Additionally, this noise data can be utilized intermittently throughout drill stem test operations in order to quantify the rates and volumes of fluid flow from different zones of interest.

Figure 49:
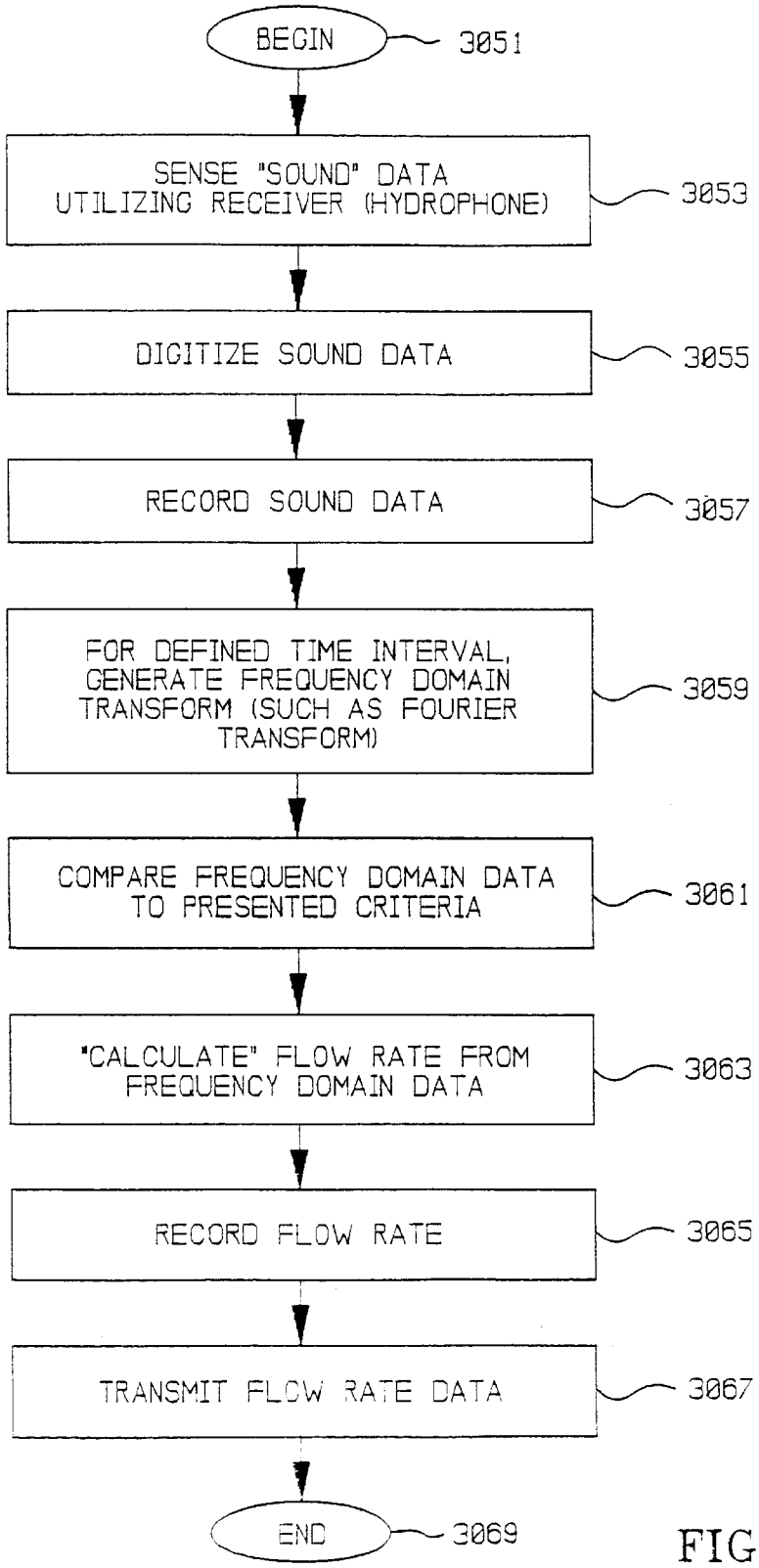
FIG. 49 is a flowchart representation of utilization of the acoustic monitoring in order to determine flow rates.

FIG. 49 is a flowchart representation of a data processing implemented monitoring of noise data. The process begins at software block 3051 and continues at software block 3053, wherein the hydrophone or any other noise receiver is utilized to sense and condition sound data within the wellbore in the region of the zone of interest. Then, in accordance with software block 3055, the sound data is digitized. Preferably, in accordance with software block 3057, the raw digitized data is recorded for subsequent processing. Then, in accordance with software block 3059, the processor generates a frequency domain transform for a defined time interval, utilizing the recorded data. Preferably, a Fourier transform is utilized to map time-domain sensed data into the frequency domain. Then, in accordance with software block 3061, the controller is utilized to compare the frequency domain data to preselected criteria. The preselected criteria may be developed by the controller from the library of test data, or it may be communicated to the controller from the surface. Next, in accordance with software block 3063, the controller is utilized to calculate the flow rate from the frequency domain data. As discussed above, the amplitude from the amplitude of the second peak of the frequency domain data. Then, in accordance with software block 3065, the controller records the flow rate data. Then, optionally, the controller transmits the flow data to a surface or subterranean location, and the process ends at software block 3069.

Figure 50:
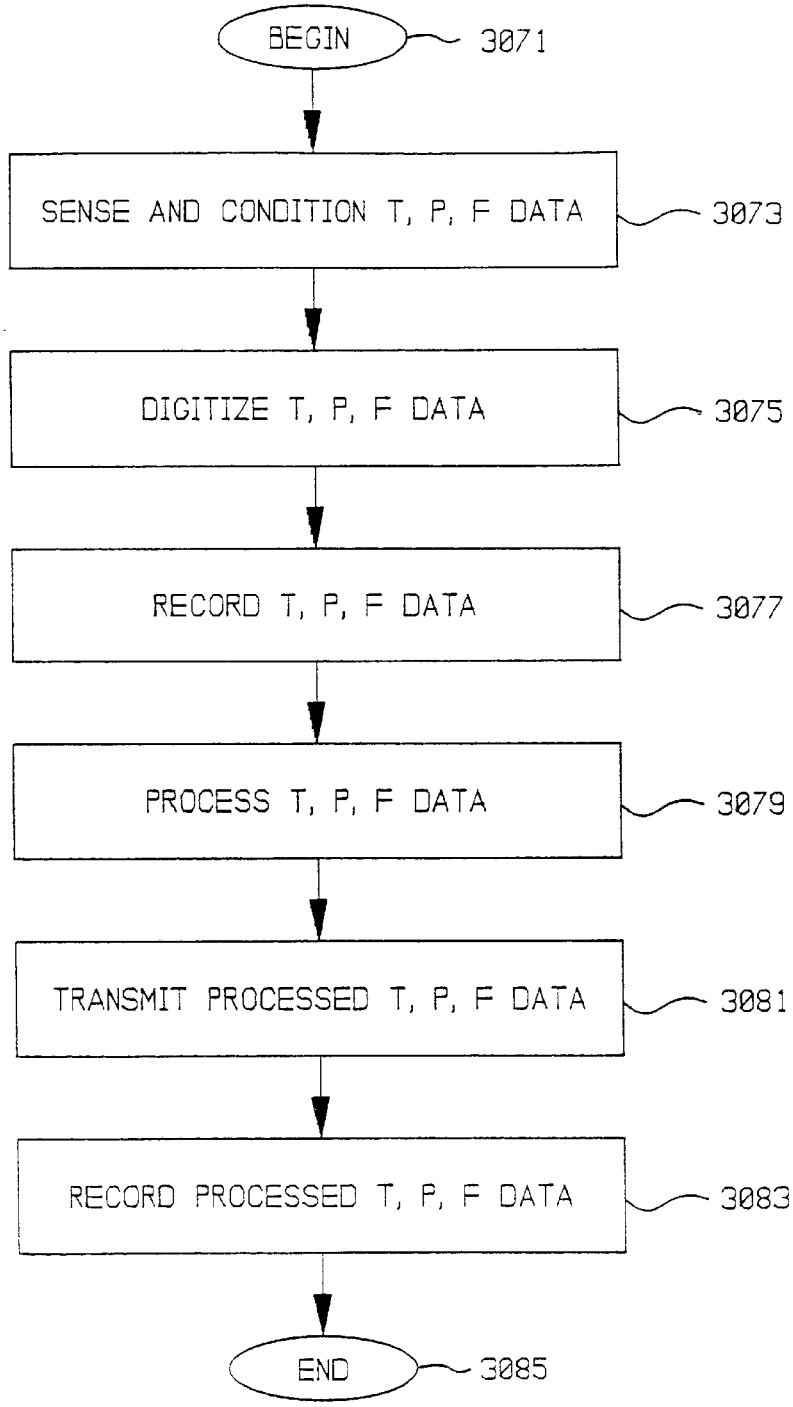
FIG. 50 is a flowchart representation of data processing implemented steps of sensing, monitoring and transmitting data relating to temperature, pressure, and flow during and after drill stem test operations.

During completion and drill stem test operations, the controller is also processing, recording, and transmitting temperature, pressure, and flow data, as is depicted in simplified form in FIG. 50. The process begins at software block 3071 and continues at software block 3073, wherein the controller utilizes the sensors to sense temperature, pressure, and flow data. Next, in accordance with software block 3075, the sensed and conditioned analog data is digitized. Next, in accordance with software block 3077, the digitized data is recorded in memory. Then, in accordance with software block 3079, the controller processes the temperature, pressure and flow data in any conventional or novel manner. For example, the processor may generate a record of recorded highs and lows for temperature, pressure, and flow. Alternatively, the processor may generate rolling averages for temperature, pressure and flow for predefined intervals. In accordance with software block 3081, the processor transmits processed temperature, pressure, and flow data to any subsurface or surface location for further use and/or analysis. Then, in accordance with software block 3083, the processor records the processed values for temperature, pressure and flow, and the process ends at software block 3085.

Figure 51A:
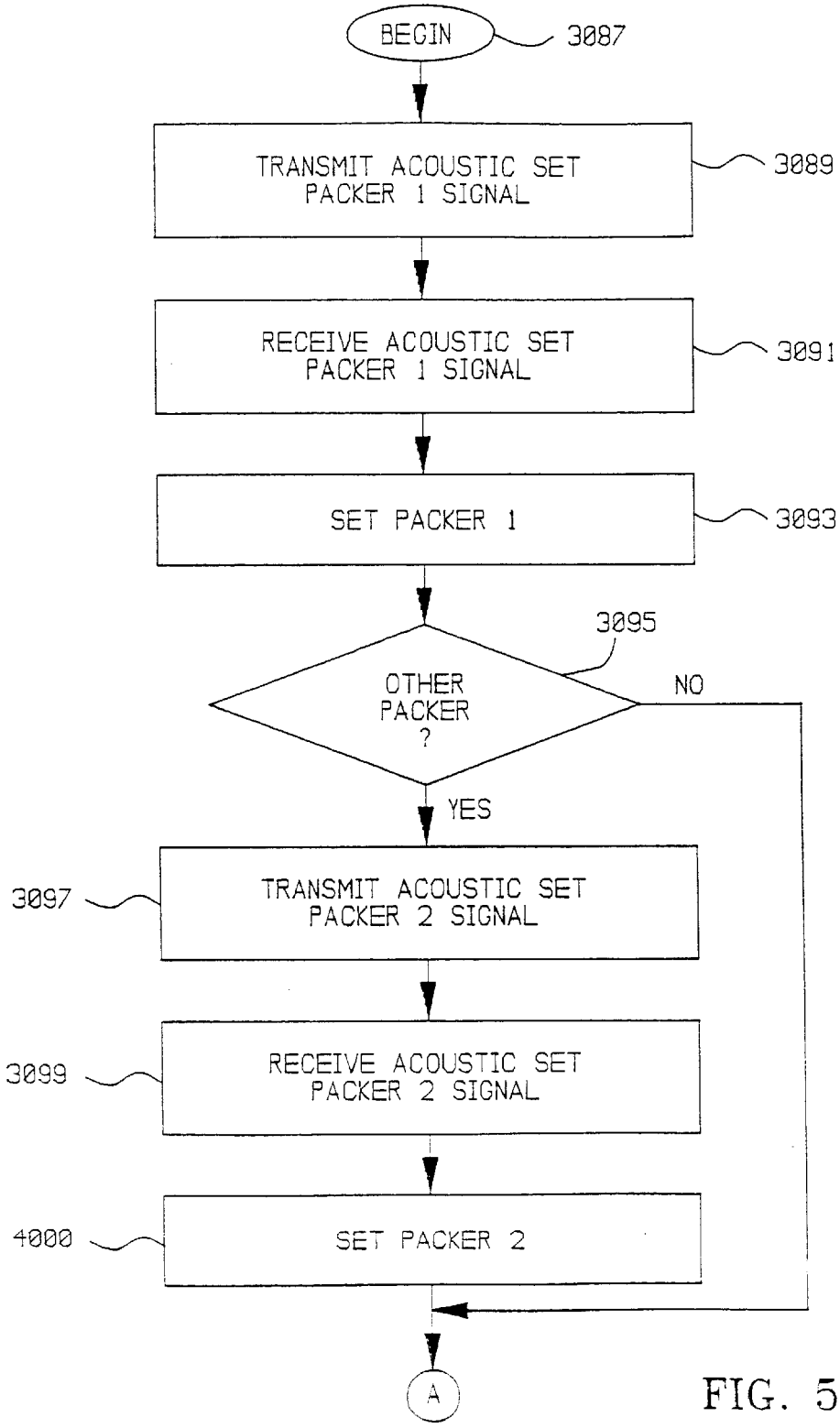
FIG. 51 is a flowchart representation of the method of utilizing the present invention during drill stem test operations.
Figure 51B:
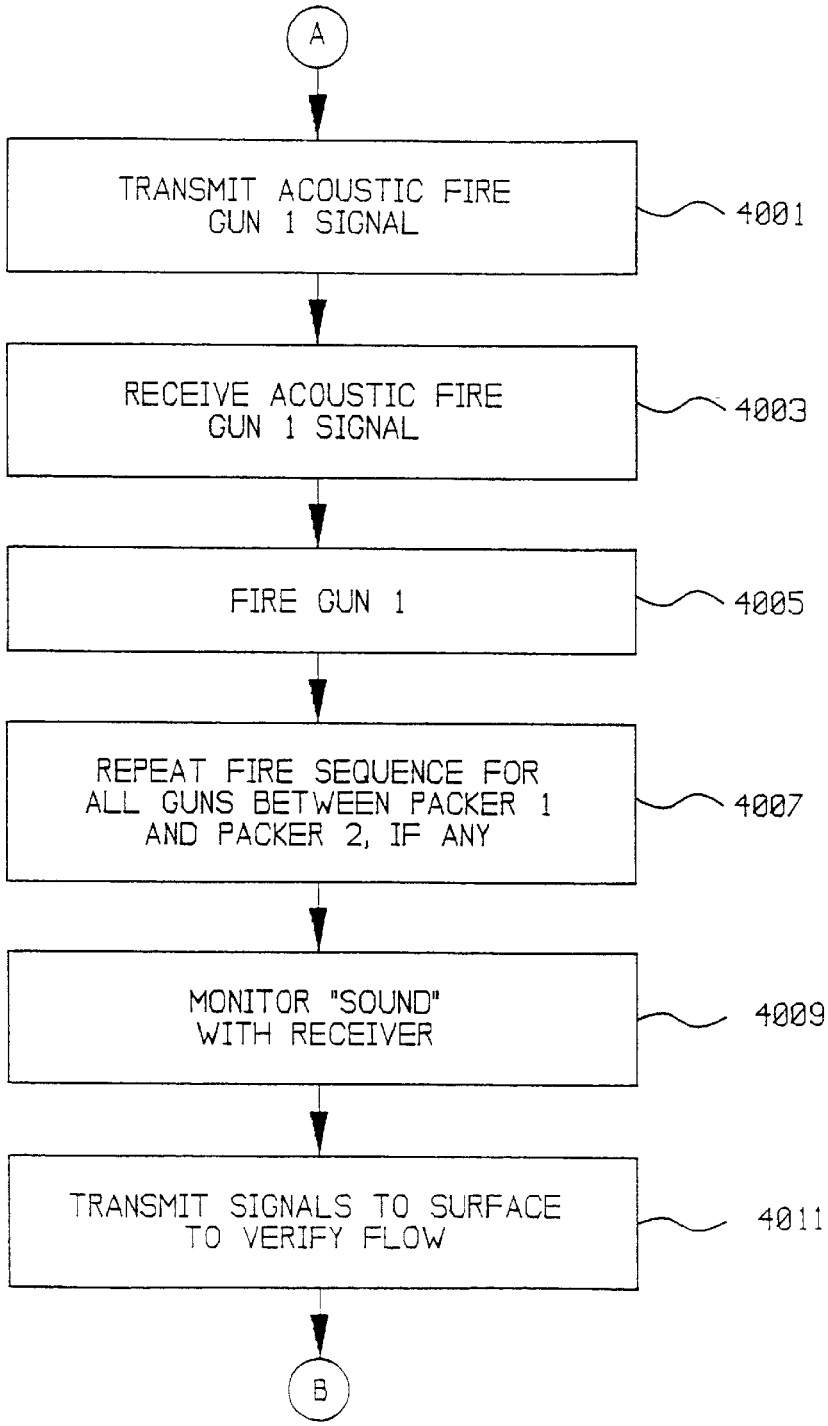
Figure 51C:
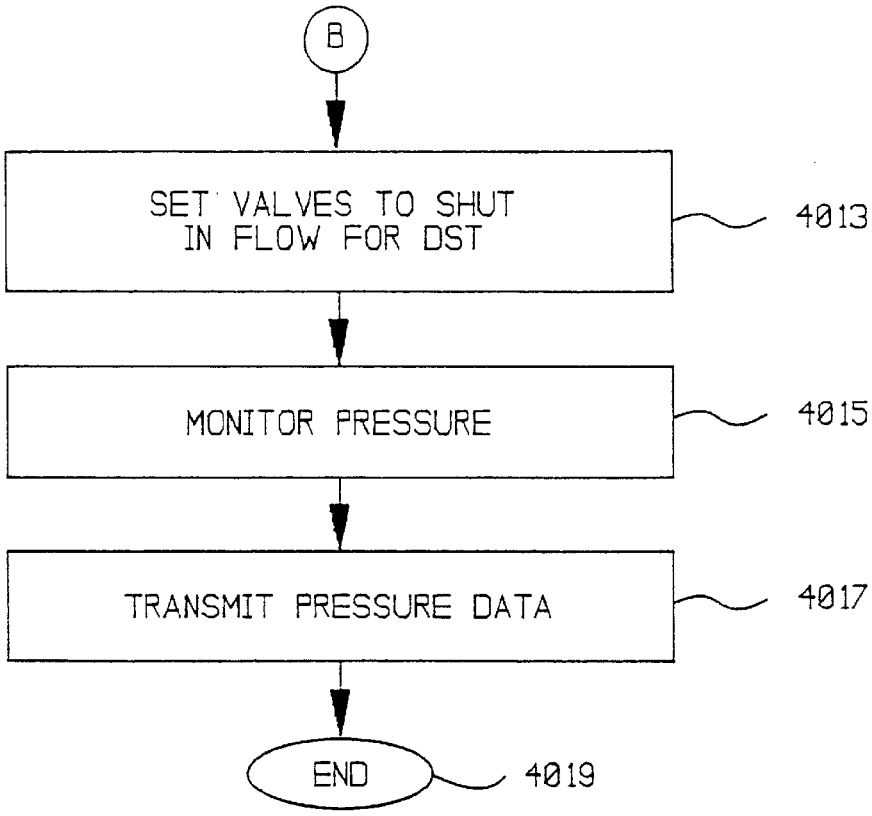

FIG. 51 provides in flow chart form a broad overview of a completion and drill stem test operation, which commences at software block 3087. In software block 3089, an acoustic signal is transmitted from a surface to a subsurface location in order to set packer number 1. In software block 3091, the acoustic signal is received and decoded, resulting in setting of packer number 1 in accordance with software block 3093. Then, in accordance with software block 3095, it is determined whether other packers need to be set; if not the process advances to software block 4001; if so, the process continues at software blocks 3097, 3099, and 4000, wherein a "set packer 2" signal is transmitted and received, and packer number 2 is set.

Then, in accordance with software block 4001, an acoustic signal is transmitted from the surface to a subsurface location which is intended to initiate the firing of perforating gun number 1. In accordance with software block 4003, the acoustic signal is received and processed, and initiates the firing of perforating gun number 1 in accordance with software block 4005. Then, in accordance with software block 4007, the fire sequence is repeated for all guns between packer number 1 and packer number 2, if there are others.

Then, in accordance with software block 4009, the one or more local processors are utilized to monitor the sounds or noise in the region of the zone of interest. Next, in accordance with software block 4001, the controller records data, or transmits signals to the surface, which verify the flow of fluids into the wellbore and thus provide a positive indication that the casing has been successfully perforated. Next, in accordance with software block 4013, the controller sets the valve to shut in the flow for the drill stem test operation. Then, in accordance with software blocks 4015, 4017, the controller monitors pressure and transmits pressure data to the surface. The process continues for so long as the operator desires to gather drill stem test data. At the completion of the drill stem test operations, the valves are switched to an open condition to allow flow of fluid into the wellbore. The well may be then be killed and the completion and drill stem test string removed from the well, or the completion string may be maintained in position to serve as the production conduit. In either event, the controller is utilized to actuate the valves and set their positions to obtain the completion and/or production goals established by the well operator. The process ends at software block 4019.

While the invention has been shown in only one of its forms, it is not thus limited but is susceptible to various changes and modifications without departing from the spirit thereof.

What is claimed is:

1. A wellbore tool for logging wellbore conditions during completion operations, comprising:

(a) a completion string composed of a plurality of wellbore tubular;

(b) at least one flow control end device carried by said completion string;

(c) a plurality of wellbore sensors carried by said completion string proximate said at least one flow control end device including a temperature sensor, a pressure sensor, and a sound sensor;

(d) a data processor adapted for receiving sensor data input from said plurality of wellbore sensors and for processing and recording data in a semiconductor memory;

(e) a transmitter for transmitting at least a portion of said processed data to a remote location; and (f) wherein during said processing operations a frequency domain transform is applied to sound sensor data in order to calculate a flow rate of fluid passing through said at least one flow control end device.

* * * * *